US007227542B2

(12) United States Patent
Koyama

(10) Patent No.: US 7,227,542 B2
(45) **Date of Patent: *Jun. 5, 2007**

(54) LIQUID CRYSTAL DISPLAY DEVICE AND METHOD OF DRIVING THE SAME

(75) Inventor: Jun Koyama, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 345 days.

This patent is subject to a terminal disclaimer.

(21) Appl. No.: 10/860,172

(22) Filed: Jun. 4, 2004

(65) Prior Publication Data

US 2004/0222955 A1 Nov. 11, 2004

Related U.S. Application Data

(62) Division of application No. 10/067,884, filed on Feb. 8, 2002, now Pat. No. 6,747,623.

(30) Foreign Application Priority Data

Feb. 9, 2001 (JP) ..... 2001-034377

(51) Int. Cl.
*G09G 5/00* (2006.01)

(52) U.S. Cl. ..... 345/204; 345/90

(58) Field of Classification Search ..... 345/87, 345/88–102, 204, 205, 206
See application file for complete search history.

(56) References Cited

U.S. PATENT DOCUMENTS

| | | | |
|---|---|---|---|
| 4,432,610 | A | 2/1984 | Kobayashi et al. |
| 4,636,788 | A | 1/1987 | Hilbrink |
| 4,752,118 | A | 6/1988 | Johnson |
| 4,773,738 | A | 9/1988 | Hayakawa et al. |
| 4,996,523 | A | 2/1991 | Bell et al. |
| 5,091,722 | A | 2/1992 | Kitajima et al. |
| 5,125,045 | A | 6/1992 | Murakami et al. |
| 5,200,846 | A | 4/1993 | Hiroki et al. |
| 5,225,823 | A | 7/1993 | Kanaly |
| 5,247,190 | A | 9/1993 | Friend et al. |

(Continued)

FOREIGN PATENT DOCUMENTS

EP 717 445 6/1996

(Continued)

OTHER PUBLICATIONS

Baldo et al.; "Very High-Efficiency Green Organic Light-Emitting Devices Based on Electrophosphorescence", Applied Physics Letters, vol. 75, No. 1, Jul. 5, 1999, pp. 4-6.

(Continued)

*Primary Examiner*—Nitin Patel
(74) *Attorney, Agent, or Firm*—Fish & Richardson P.C.

(57) ABSTRACT

An object of the present invention is to provide a liquid crystal display device making it possible to lower the power consumption thereof when a still image is displayed. In a liquid crystal display device having memory circuits in each of the pixel, and each group of the pixels shares one D/A converter circuit. In this way, the area of the D/A converter circuit per pixel can be reduced. Accordingly, the number of the memory circuits arranged in each of the pixels can be made large.

28 Claims, 32 Drawing Sheets

U.S. PATENT DOCUMENTS 5,339,090 A 8/1994 Crossland et al.
5,349,366 A 9/1994 Yamazaki et al.
5,376,944 A 12/1994 Mogi et al.
5,424,752 A 6/1995 Yamazaki et al.
5,471,225 A 11/1995 Parks
5,479,283 A 12/1995 Kaneko et al.
5,600,169 A 2/1997 Burgener et al.
5,608,549 A 3/1997 Usami
5,642,129 A 6/1997 Zavracky et al.
5,673,422 A 9/1997 Kawai et al.
5,699,078 A 12/1997 Yamazaki et al.
5,712,652 A 1/1998 Sato et al.
5,771,031 A 6/1998 Kinoshita et al.
5,793,344 A 8/1998 Koyama
5,798,746 A 8/1998 Koyama
5,818,898 A 10/1998 Tsukamoto et al.
5,841,482 A 11/1998 Wang et al.
5,854,628 A 12/1998 Nakagawa
5,907,313 A 5/1999 Kubota et al.
5,945,866 A 8/1999 Fonash et al.
5,945,972 A 8/1999 Okumura et al.
5,959,598 A 9/1999 McKnight
5,977,940 A 11/1999 Akiyama et al.
5,990,629 A 11/1999 Yamada et al.
6,115,019 A 9/2000 Perner
6,165,824 A 12/2000 Takano et al.
6,246,386 B1 6/2001 Perner
6,259,846 B1 7/2001 Roach et al.
6,274,887 B1 8/2001 Yamazaki et al.
6,333,737 B1 12/2001 Nakajima
6,335,728 B1 1/2002 Kida et al.
6,344,672 B2 2/2002 Huffman
6,344,843 B1 2/2002 Koyama et al.
6,356,028 B1 3/2002 Legagneux et al.
6,366,026 B1 4/2002 Saito et al.
6,380,876 B1 4/2002 Nagao
6,384,818 B1 5/2002 Yamazaki et al.
6,392,618 B1 5/2002 Kimura
6,441,829 B1 8/2002 Blalock et al.
6,445,368 B1 9/2002 Nakajima
6,456,267 B1 9/2002 Sato et al.
6,496,130 B2 12/2002 Nagao
6,535,192 B1 3/2003 Sung et al.
6,542,139 B1 4/2003 Kanno
6,545,654 B2 4/2003 Jacobsen et al.
6,545,708 B1 4/2003 Tamayama et al.
6,549,196 B1 4/2003 Taguchi et al.
6,556,176 B1 4/2003 Okuyama et al.
6,563,480 B1 5/2003 Nakamura
6,564,237 B2 5/2003 Ohashi et al.
6,579,736 B2 6/2003 Yamazaki
6,580,454 B1 6/2003 Perner et al.
6,583,775 B1 6/2003 Sekiya et al.
6,630,916 B1 10/2003 Shinoda
6,636,191 B2 10/2003 Cok
6,636,194 B2 10/2003 Ishii
6,664,943 B1 12/2003 Nakajima et al.
6,670,938 B1 12/2003 Yoshida
6,683,596 B2 1/2004 Ozawa
6,693,616 B2 2/2004 Koyama et al.
6,730,966 B2 5/2004 Koyama
6,731,264 B2 5/2004 Koyama et al.
6,731,272 B2 5/2004 Huang
6,738,054 B1 5/2004 Yamaguchi
6,747,623 B2 * 6/2004 Koyama ..... 345/87
6,750,836 B1 6/2004 Katayama et al.
6,753,834 B2 6/2004 Mikami et al.
6,765,562 B2 7/2004 Yamazaki et al.
6,774,876 B2 8/2004 Inukai
6,775,246 B1 8/2004 Kuribayashi et al.
6,819,317 B1 11/2004 Komura et al.
2001/0005193 A1 6/2001 Yokoyama
2002/0000969 A1 1/2002 Ozawa
2002/0003521 A1 1/2002 Matsueda et al.
2002/0018029 A1 2/2002 Koyama
2002/0018131 A1 2/2002 Kochi
2002/0021274 A1 2/2002 Koyama et al.
2002/0021295 A1 2/2002 Koyama et al.
2002/0024054 A1 2/2002 Koyama et al.
2002/0024485 A1 2/2002 Koyama et al.
2002/0036604 A1 3/2002 Yamazaki et al.
2002/0036611 A1 3/2002 Ishii
2002/0039087 A1 4/2002 Inukai
2002/0041266 A1 4/2002 Koyama et al.
2002/0057244 A1 5/2002 Koyama et al.
2002/0067327 A1 6/2002 Ozawa et al.
2002/0089483 A1 7/2002 Yamazaki et al.
2002/0113763 A1 8/2002 Koyama
2002/0130828 A1 9/2002 Yamazaki et al.
2002/0167504 A1 11/2002 Matsumoto
2003/0067632 A1 4/2003 Ohta et al.
2003/0071772 A1 4/2003 Kimura
2003/0098875 A1 5/2003 Kurokawa et al.
2003/0103025 A1 6/2003 Kurokawa et al.
2003/0234755 A1 12/2003 Koyama
2004/0085269 A1 5/2004 Mikami
2004/0164322 A1 8/2004 Kondo et al.
2004/0183766 A1 9/2004 Koyama et al.
2004/0222955 A1 11/2004 Koyama

FOREIGN PATENT DOCUMENTS

EP 0 999 595 5/2000
EP 1 098 290 5/2001
EP 1 182 638 2/2002
JP 04-350627 12/1992
JP 06-102530 4/1994
JP 08-101609 4/1996
JP 08-101669 4/1996
JP 05-173506 7/1996
JP 08-194205 7/1996
JP 08-241048 9/1996
JP 08-286170 11/1996
JP 09-212140 8/1997
JP 10-092576 4/1998
JP 10-214060 8/1998
JP 10-232649 9/1998
JP 10-247735 9/1998
JP 10-253941 9/1998
JP 10-312173 11/1998
JP 11-064814 3/1999

OTHER PUBLICATIONS

Shimoda et al., "High Resolution Light Emitting Polymer Display Driven By Low Temperature Polysilicon Thin Film Transistor With Integrated Driver," Asia Display '98, Jan. 1, 1998, pp. 217-220.

Schenk et al.; "Polymers for Light Emitting Diodes," EuroDisplay '99, Proceedings of the 19th IDRC, Sep. 6, 1999, pp. 33-37.

Han et al.; "3.8 Green OLED with Low Temperature Poly-Si TFT," EuroDisplay '99, Proceedings of the 19th IDRC, Sep. 1, 1999, pp. 27-30.

Tsutsui et al.; "High Quantum Efficiency In Organic Light-Emitting Devices With Irridium-Complex As A Triplet Emissive Center," Japanese Journal of Applied Physics, vol. 38, part 2, No. 12B, Dec. 15, 1999, pp. L1502-L1504.

Baldo et al.; "Highly Efficient Phosphorescent Emission From Organic Electroluminescent Devices," Nature, vol. 395, Sep. 10, 1998, pp. 151-154.

Tsutsui et al.; "Electroluminescence In Organic Thin Films," Photochemical Processes in Organized Molecular Systems, Sep. 22, 1990, pp. 437-450.
T. Shimoda et al.; "Current Status and Future Of Light-Emitting Polymer Display Driven by Poly-Si," SID Digest '99, SID International Symposium Digest of Technical Papers, Jan. 1, 1999, pp. 372-375.
Office Action (U.S. Appl. No. 09/923,433), Jul. 28, 2004, 9 pages.
Office Action (U.S. Appl. No. 09/919,832), Sep. 8, 2004, 11 pages.
Office Action (U.S. Appl. No. 09/930,956), Nov. 4, 2004, 17 pages.
Jun Koyama et al.; "A 4.0-in. Poly Si TFT-LCD with Integrated 6-bit Digital Data Driver Using CGS Technology"; *AM-LCD '99 / Digest of Technical Papers*; 1999 International Workshop on Active-Matrix Liquid-Crystal Displays—TFT Technologies and Related Materials; pp. 29-32; Jul. 14-16, 1999.
Pending Claims of Application No. 10/454,829, May 1, 2006.

* cited by examiner

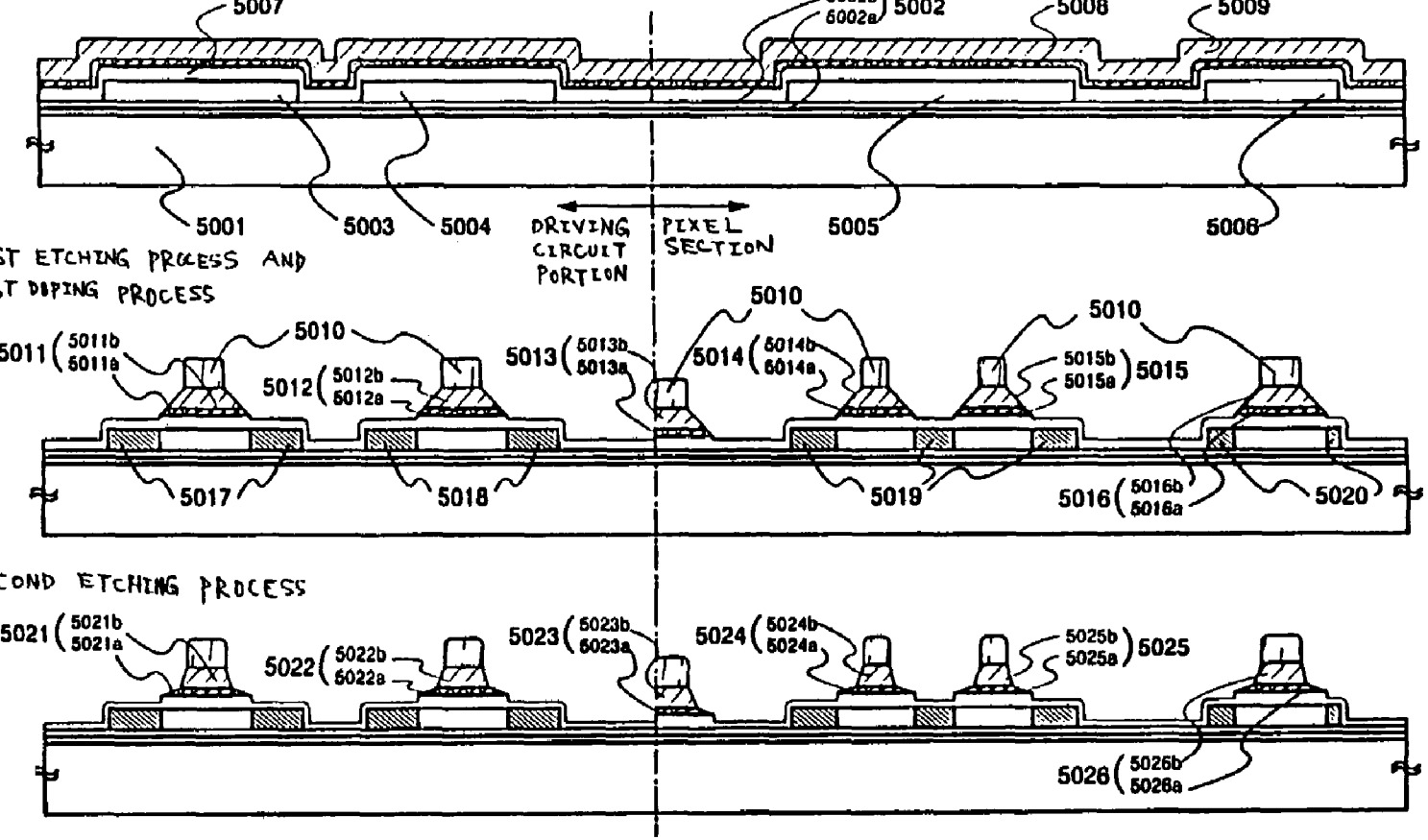
FIG. 24A FORMATION OF ISLAND-LIKE SEMICONDUCTOR LAYER AND GATE INSULATING FILM AND FIRST AND SECOND CONDUCTIVE FILMS FOR GATE ELECTRODE
FIG. 24B FIRST ETCHING PROCESS AND FIRST DOPING PROCESS
FIG. 24C SECOND ETCHING PROCESS

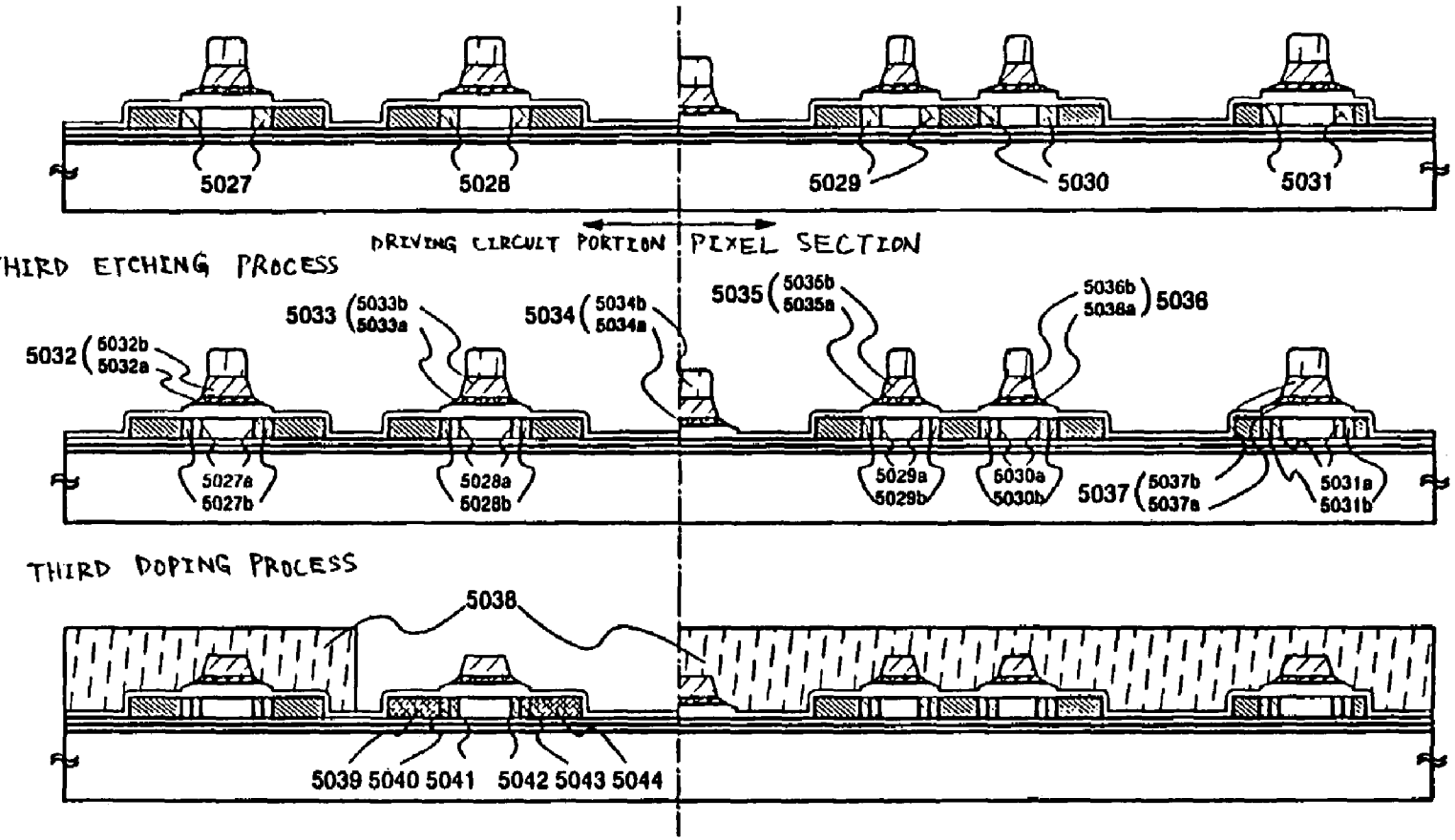
FIG.25A SECOND DOPING PROCESS
FIG.25B THIRD ETCHING PROCESS
FIG.25C (C) THIRD DOPING PROCESS

FORMATION OF FIRST AND SECOND INTERLAYER INSULATING FILMS AND WIRINGS

PREPARATION OF OPPOSING SUBSTRATE AND INJECTION OF LIQUID CRYSTAL MATERIAL

LIQUID CRYSTAL DISPLAY DEVICE AND METHOD OF DRIVING THE SAME

CROSS-REFERENCE TO RELATED APPLICATIONS

This application is a divisional application of U.S. application Ser. No. 10/067,884, filed on Feb. 8, 2002 now U.S. Pat. No. 6,747,623, now allowed, which claims the benefit of a foreign priority application filed in Japan on Feb. 9, 2001, as application serial no. 2001-034377. This application claims priority to both of these applications, and both of these applications are incorporated by reference.

BACKGROUND OF THE INVENTION

1. Field of the Invention

The present invention relates to a display device and a method of driving the same. The present invention relates particularly to an active matrix type display device having a thin film transistor (referred to as a TFT hereinafter) formed on an insulator, and a method of driving the same, more particularly to an active matrix type display device using digital signals as picture signals, and a method of driving the same.

2. Related Art

In recent years, display devices having elements formed using a semiconductor thin film on an insulator, particularly on a glass substrate, have been spreading. For example, active matrix type display devices using a TFT have been spreading. In an active matrix display device, pixels are arranged in a matrix form and TFTs are arranged onto the respective pixels (the TFTs being referred to as pixel TFTs hereinafter). The pixel TFTs are used to control the brightness of the respective pixels, thereby displaying images.

Recently, there has been developing a technique of using a polycrystal semiconductor to form not only pixel TFTs constituting pixels but also TFTs constituting a driving circuit at the same time. This technique contributes greatly to miniaturization and low power consumption of display devices. Following this, an active matrix type display device has been becoming essential for the display section of portable information-processing equipment, the applicable field of which has been markedly expanding in recent years, or the like section. Examples of the active matrix type display device include an active matrix liquid crystal display device using a liquid crystal element, and an active matrix type organic light emitting diode (OLED) display device using an OLED element. In the present specification, attention is paid mainly to the active matrix type liquid crystal display device.

The above-mentioned liquid crystal element is composed of two electrodes, oriented films formed on the respective electrodes, and a liquid crystal material sandwiched between faces of the two electrodes on which the respective oriented films are formed. As the liquid crystal material, any material having a known structure can be used.

FIG. 6 schematically illustrates a conventional active matrix type liquid crystal display device of a system in which digital picture signals are used to perform display (referred to as a digital system herein after). At the center thereof, a pixel section 1308 is arranged.

In the pixel section 1308, plural pixels are arranged in a matrix form. Plural source signal lines and plural gate signal lines for inputting signals into the respective pixels are arranged.

A source signal line driving circuit 1301 for controlling signals to be inputted into the source signal lines is arranged over the pixel section 1308.

The source signal line driving circuit 1301 has a shift register 1303, the first latch circuit 1304, the second latch circuit 1305, D/A (digital/analogue) converter circuit 1306, which is illustrated as DAC in FIG. 6, an analogue switch 1307, and so on. Gate signal line driving circuits 1302 for controlling signals to be inputted to gate signal lines are arranged at the right and left sides of the pixel section 1308. Only one gate signal line driving circuit 1302 may be arranged at one side of the pixel section 1308. However, the case in which the gate signal line driving circuits are arranged at both the sides of the pixel section 1308 is more preferred from the viewpoints of driving efficiency and driving reliability.

The source signal line driving circuit 1301 has a configuration as illustrated in FIG. 7. The source signal line driving circuit, the example of which is illustrated in FIG. 7, is a source signal line driving circuit corresponding to a display device which has pixels, the number of which is x in the horizontal direction, so as to display gradation by the input of 3-bit digital picture signals (the gradation being referred to as 3-bit digital gradation).

The source signal line driving circuit illustrated in FIG. 7 has a shift register circuit (SR) 1401, the first latch circuit (LAT1) 1402, the second latch circuit (LAT2) 1403, D/A converter circuit (DAC) 1404, and so on. In FIG. 7, the analogue switch 1307 illustrated in FIG. 6 is not illustrated. If necessary, a buffer circuit, a level shift circuit, and so on, which are not illustrated in FIG. 7, may be arranged.

Referring to FIGS. 6 and 7, the following will describe the operation of the display device. First, clock signals (clock pulses, inverting clock pulses) and a start pulse are inputted to the shift register 1303, which are represented by "SR" in FIG. 7. As a result, pulses are successively inputted from the shift register circuit 1303 to the first latch circuit 1304, which are represented by "LAT1" in FIG. 7, so as to hold digital picture signals (digital data) which are similarly inputted to the first latch circuit 1304.

The most significant bit (MSB) of the digital picture, signals is represented by D3, and the least significant bit (LSB) of the digital picture signals is represented by D1. After the holding of the digital data corresponding to one horizontal term is completed in the first latch circuit 1304, during a retrace line period the digital picture signals held in the first latch circuit 1304 are simultaneously transferred to the second latch circuit 1305, which is represented by "LAT2" in FIG. 7, by the input of a latch signal (latch pulse).

Thereafter, the shift register circuit 1303 is again operated to start the holding of digital data corresponding to the next horizontal term. At the same time, the digital data held in the second latch circuit 1305 are converted to analogue signals in the D/A converter circuit 1306, which is represented by "DAC" in FIG. 7. The analogue signals are inputted to the source signal lines, represented by "S1" to "Sx" in FIG. 7, and written in the respective pixels.

FIG. 8 illustrates a configuration of the pixel section of an ordinary active matrix type liquid crystal display device.

In each of pixels, a condenser 1001, a switching TFT 1002, and a liquid crystal element 1003 are arranged. The gate electrode of the switching TFT 1002 in each of the pixels is connected to some line of the gate signal lines G1 to Gy. One of the source region and the drain region of the switching TFT 1002 in each of the pixels is connected to some line of the source signal lines S1 to Sx, and the other is connected to either electrode of the condenser 1001 and either electrode of the liquid crystal element 1003.

The analogue signals inputted to the source signal lines S1 to Sx are inputted to the condensers 1001 and the liquid crystal elements 1003 across the drain and the source of the switching TFTs 1002 which have become conductive by the signals inputted to the gate signal lines G1 to Gy. Depending on the voltages of the signals, the transmittivity of the liquid crystal elements 1003 varies so that the brightness of the respective pixels is represented.

When an electric field along a given direction is constantly applied between the two electrodes of the liquid crystal element, ions in the liquid crystal material are prejudiced, thereby resulting in a problem that the liquid crystal element deteriorates. Thus, in display devices or the like wherein the ordinary liquid crystal element is used, there is used a driving method of changing, at regular intervals, the polarity of the voltage applied to the liquid crystal element so as to change the direction of the electric field applied to the two electrodes of the liquid crystal element.

For example, the following driving methods are known: a driving method called gate line inversion, a driving method called source line inversion, and a driving method called frame inversion.

In the driving method called gate line inversion, the polarities of signal voltages applied to liquid crystal elements are made different between gate signal lines adjacent to each other. In the driving method called source line inversion, the polarities of signal voltages applied to liquid crystal elements are made different between source signal lines adjacent to each other. In the driving method called frame inversion, the polarity of the signal voltage applied to the liquid crystal is inverted in every period when an image corresponding to one frame is displayed (the period being referred to as a frame period hereinafter).

Referring to timing charts shown in FIGS. 8 and 9, the following will describe the operation of this conventional active matrix type liquid crystal display device.

About the timing chart shown in FIG. 9, an operation based on the frame inversion driving is used.

Signals having a polarity contrary to signals inputted to the source signal line in the first frame period (F1) are inputted from the source signal line in the second frame period (F2). In the third frame period (F3), signals having a polarity different from that of the signals inputted in the second frame period (F2) are inputted.

In the first frame period (F1), the gate signal line G1 is firstly selected. As a result thereof, the switching TFT 1002 whose gate electrode is connected to the gate signal line G1 conducts. Thereafter, signals are inputted through the source signal lines S1 to Sx.

In the timing chart of FIG. 9, attention is paid to a certain source signal line Sm (m is a natural number of x or less) and only signals inputted to this source signal line Sm are shown. The period during which one gate signal line is selected is referred to as one horizontal term (one line period: L). Particularly, the period during which the gate signal line G1 is selected is referred to as the first line period L1.

After the input of a signal to the pixels having the switching TFTs 1002 connected to the gate signal line G1 finishes, a signal is inputted to the gate signal line G2 so that all of the switching TFTs 1002 connected to the gate signal line G2 conduct. In this way, the input of signals in the second line period L2 starts.

The above-mentioned operation is repeated about all of the gate signal lines G1 to Gy so that the repeated operation finishes in the $y^{th}$ line period Ly. As a result, one frame period ends.

Next, the second frame period (F2) starts. In the second frame period (F2), the polarity of signals inputted to the source signal line is different from the polarity of the signal voltage, of the source signal line, inputted to the source signal line in the first frame period (F1). In this way, images are displayed.

After the second frame period (F2) finishes, the third frame period (F3) starts. In the third frame period (F3), signal voltage having a polarity different from that of the signal voltage in the second frame period (F2) is inputted to the source signal line. In other words, signal voltage having the same polarity as in the first frame period is inputted to the source signal line.

The above-mentioned operation is repeated to display images.

In an ordinary active matrix type liquid crystal display device, display in its screen is renewed about 60 times per second in order to make the display of moving images smooth. In other words, it is necessary to supply digital picture signals in every frame period by the above-mentioned operation and perform writing in all of the pixels every time. Even if the picture to be displayed is a still image, the same signals must be continuously supplied in every frame period. It is therefore necessary that an external circuit, the driving circuit and so on continuously perform repetitive processing of the same digital picture signals.

There is also known a method of writing digital picture signals for a still image once in an external memory circuit and subsequently supplying the digital picture signals from the external memory circuit to a liquid crystal display device in every frame period. In either case, it is necessary that the external memory circuit and the driving circuit operate continuously.

Particularly in portable information-processing equipment, it is desired to make the power consumption thereof low. In portable information-processing equipment, the period during which a still image is continuously displayed occupies most of all periods. Notwithstanding this fact, the external circuit, the driving circuit and so on must operate continuously at the time when the still image is displayed, as described above. This fact prevents the power consumption from being made low.

SUMMARY OF THE INVENTION

Thus, an object of the present invention is to provide a liquid crystal display device making it possible to make the power consumption thereof low, and a method of driving the same.

The liquid crystal display device of the present invention comprises plural memory circuits for each pixel, and comprises one D/A converter circuit for each group of the plural pixels.

In the pixels having the above-mentioned structure, digital picture signals can be memorized in the plural memory circuits. The memorized digital picture signals can be converted to the corresponding analogue signals by the D/A converter circuit. The analogue signals make it possible to change the brightness of the respective pixels.

The following will describe the driving method of the display device of the present invention.

If data are once written in the respective pixels in the case of displaying a still image in the liquid crystal display device of the present invention, the same data are subsequently written in the pixels. Therefore, even if signals are not inputted in every frame period, the still image can be continuously displayed by reading out the signals memorized in the memory circuits again. That is, after signals corresponding to at least one frame period are subjected to processing-operation in order to display a still image, the external circuit, the source signal line driving circuit, and soon can be kept in a standstill state. In this way, the power consumption of the display device can be largely reduced.

The above is a basic description on the display device of the present invention and the method of driving the same.

The single D/A converter circuit is set up for each group of the plural pixels. Therefore, the D/A converter circuit is shared by the plural pixels.

In other words, one of the pixels sharing the D/A converter circuit is selected. Digital picture signals memorized in the selected pixel are inputted to the D/A converter circuit. In the D/A converter circuit, the inputted digital picture signals are converted to analogue signals. In this way, the brightness of the selected pixel is changed by the analogue signals.

The following will describe, for example, a case in which each pixel has a liquid crystal element.

One of the pixels sharing the D/A converter circuit is selected. Digital picture signals memorized in the selected pixel are inputted to the D/A converter circuit. In the D/A converter circuit, the inputted digital picture signals are converted to analogue signals. The analogue signals are inputted to the liquid crystal element which the selected pixel has. In this way, the brightness of the pixel is changed.

The following will describe the structure of the display device of the present invention.

In order to make the description simple, basic operation of the display device of the present invention will be firstly described about an example wherein no D/A converter circuit is shared, that is, an example wherein a D/A converter circuit is arranged for each pixel.

Plural memory circuits are arranged inside pixels, and digital picture signals are memorized in each of the pixels.

If data are once written in the pixels in the case of a still image, the same data are subsequently written in the pixels. Therefore, even if signals are not inputted in every frame period, the still image can be continuously displayed by reading out the signals memorized in the memory circuits again. That is, after signals corresponding to at least one frame period are subjected to processing-operation in order to display a still image, the external circuit, the source signal line driving circuit, and so on can be kept in a standstill state. In this way, the power consumption of the display device can be largely reduced.

This manner will be described.

Referring to the block view of FIG. 11, the following will describe a structural example of an active matrix type display device having the pixels comprising the above-mentioned memory circuits.

In FIG. 11, the display device is composed of a pixel section 1318, a source signal line driving circuit 1311, a gate signal line driving circuit 1312, and a DAC (D/A converter circuit) controller 1322.

A start pulse, clock pulses, digital data and latch pulses are inputted to the source signal line driving circuit 1311. A start pulse and clock pulses are inputted to the gate signal line driving circuit 1312. A reference voltage is inputted to the DAC controller 1322.

The source signal line driving circuit 1311 is paid attention to and will be described in detail. The source signal line driving circuit 1311 is composed of a shift register 1313, the first latch circuit 1314, the second latch circuit 1315 and switch 1317.

The source signal line driving circuit 1311 has a structure as illustrated in FIG. 12. The source signal line driving circuit, the example of which is illustrated in FIG. 12, is a source signal line driving circuit corresponding to a display device which has pixels, the number of which is x in the horizontal direction, so as to display gradation by the input of 3-bit digital picture signals (the gradation being referred to as 3-bit digital gradation).

This source signal line driving circuit has a shift register circuit (SR) 201, the first latch circuit (LAT1) 202, the second latch circuit (LAT2) 203, switch 204, and soon. If necessary, a buffer circuit, a level shift circuit, and so on, which are not illustrated in FIG. 12, may be arranged.

Referring to FIGS. 11 and 12, the following will describe the operation of the source signal line driving circuit. First, clock signals (clock pulses, inverting clock pulses) and a start pulse are inputted to the shift register 1313, which are represented by "SR" in FIG. 12. As a result, pulses are successively inputted from the shift register circuit 1313 to the first latch circuit 1314, which are represented by "LAT1" in FIG. 12, so as to hold digital picture signals (digital data) which are similarly inputted to the first latch circuit 1314. The pulses inputted from the shift register circuit 1313 to the first latch circuit 1314 are referred to as sampling pulses hereinafter.

The most significant bit (MSB) of the digital picture signals is represented by D3, and the least significant bit (LSB) of the digital picture signals is represented by D1. After the holding of the digital data corresponding to one horizontal term is completed in the first latch circuit 1314, during a retrace line period the digital picture signals held in the first latch circuit 1314 are simultaneously transferred to the second latch circuit 1315, which is represented by "LAT2" in FIG. 12, by the input of a latch signal (latch pulse).

Thereafter, the shift register circuit 1313 is again operated to start the holding of digital data corresponding to the next horizontal term. At the same time, the digital data held in the second latch circuit 1315 are selected, correspondingly to the respective bits, by bit selecting signals through the switch 1317, which is represented by "SW" in FIG. 12. The data are inputted to the source signal lines, represented by "S1" to "Sx" in FIG. 12, and are then written in the respective pixels.

FIG. 10 illustrates a circuit configuration of the pixel to which signals are inputted from FIG. 12 in detail. The pixel corresponds to 3-bit digital gradation, and has a liquid crystal (LC), a retaining capacitor (capacitor element: Cs), memory circuits (M: 105–107), a D/A converter circuit (DAC: 111), and so on. Reference number 101 represents a source signal line; reference numbers 102–104, writing gate signal lines; and reference numbers 108–110, writing TFTs. The source signal line 101 corresponds to any one of the source signal lines S1 to Sx in FIG. 12.

In this device, the pixels, the number of which is x along the horizontal direction and is y along the vertical direction, are arranged in a matrix form. Three writing gate signal lines of the pixels in the first line are represented by 102-L1, 103-L1 and 104-L1. Three writing gate signal lines of the pixels in the $y^{th}$ line are represented by 102-Ly, 103-Ly and 104-Ly. Three writing TFTs of the pixels in the first line are represented by 108-L1, 109-L1 and 110-L1. Three writing TFTs of the pixels in the $y^{th}$ line are represented by 108-Ly, 109-Ly and 110-Ly.

FIG. 13 is a timing chart showing the method of driving the liquid crystal display device illustrated in FIGS. 10, 11 and 12. Referring to FIGS. 10–13, the driving method will be described.

In the source signal line driving circuit, digital picture signals are held in accordance with sampling pulses outputted from the shift register circuit 201 (digital data sampling).

Thereafter, a latch pulse is inputted during a retrace line period, so that the digital picture signal (digital data) transferred to the second latch circuit 203 are inputted to the source signal lines S1 to Sx.

One horizontal term can be classified into three periods, that is, the first bit writing period, the second bit writing period and the third bit writing period.

Through the switch 204, a bit selecting signal is inputted, so that the signal of the digital data D3 is inputted to the source signal lines S1 to Sx during the first bit writing period. At this time, the signal is inputted to the writing gate signal line 102-L1 so that the writing TFT 108-L1 connected to this writing gate signal line 102-L1 conducts. In this way, the signal D3 of the first bit is written in the memory circuit (M) 105.

Next, through the switch 204, a bit selecting signal is inputted during the second bit writing period, so that the signal of the digital data D2 is inputted to the source signal lines S1 to Sx. At this time, the signal is inputted to the writing gate signal line 103-L1 so that the writing TFT 109-L1 connected to this writing gate signal line 103-L1 conducts. In this way, the signal D2 of the second bit is written in the memory circuit (M) 106.

Next, through the switch 204, a bit selecting signal is inputted in the third bit writing period, so that the signal of the digital data D1 is inputted to the source signal lines S1 to Sx. At this time, the signal is inputted to the writing gate signal line 103-L1 so that the writing TFT 109-L1 connected to this writing gate signal line 103-L1 conducts. In this way, the signal D1 of the third bit is written in the memory circuit (M) 107.

In the above-mentioned way, the processing of the digital picture signals corresponding to one horizontal term finishes.

In the retrace line period of the third bit writing period, the digital picture signals written in the memory circuits (M) 105–107 are converted to analogue signals by the DAC 111. The period during which this digital/analogue conversion is performed is referred to as a DAC processing period. The analogue signals are inputted to the liquid crystal element LC and condenser (capacitor) Cs. Correspondingly to the analogue signals, the transmittivity of the liquid crystal element LC changes to represent gradation. Since the 3-bit digital picture signals are used, the brightness having 8 steps from 0 to 7 can be obtained.

By performing the above-mentioned operation for all lines of the pixels, an image corresponding to one frame is memorized in the respective pixels. The image is displayed.

The above-mentioned operation is repeated to display pictures continuously.

After digital picture signals are once memorized in the memory circuits 105–107 of the respective pixels by the first operation in the case of displaying a still image, it is advisable that the digital picture signals memorized in the memory circuits 105–107 are repeatedly read out by the DAC controller 1322 in respective frame periods. Therefore, during the period when this still image is displayed, the operation of the source signal line driving circuit can be stopped.

The above has described an example of the display device having three memory circuits in each pixel and having a function of memorizing 3-bit digital picture signals corresponding to one frame. However, the number of the memory circuits is not limited. That is, in order to memorize n-bit digital picture signals, wherein n is a natural number of 2 or more, corresponding tom frames, wherein m is a natural number, the number of memory circuits should be n×m per pixel.

By the above-mentioned method using the memory circuits arranged in the pixels, digital picture signals are memorized. When a still image is displayed, the digital picture signals memorized in the memory circuits are repeatedly used in respective frame periods. In this way, the still image can be continuously displayed without driving the external circuit, the source signal line driving circuit nor the like. Thus, the power consumption of the liquid crystal display device can be greatly reduced.

The above description is about the basis of the present invention.

In the case that the memory circuit and the D/A converter circuit (DAC) are arranged for each pixel, the element constituting the DAC occupies a large part of the pixel. Therefore, a problem that the area of the memory circuit inside the pixel is limited remains. Thus, it is difficult that the bit number for memorization per pixel is increased.

Consequently, it is difficult that the information amount of inputted digital signals is made large to realize high gradation and signals corresponding to many frame periods are memorized.

Therefore, in order to provide a liquid crystal display device which has a memory circuit for each pixel and a function of converting digital signals to analogue signals in its pixel section and further has a small area ratio of a D/A converter circuit in each pixel, each group of the plural pixels shares one D/A converter circuit.

The liquid crystal display device of the present invention is characterized in that a memory circuit is arranged in each pixel and each group of the plural pixels shares a D/A converter circuit. In this way, there can be provided a liquid crystal display device making it possible to arrange memory circuits corresponding to many bit numbers, and a method of driving the same.

The following will describe a structure of the liquid crystal display device of the present invention.

The present invention provides:

a liquid crystal display device for displaying a picture by inputting n-bit digital picture signals wherein n is a natural number of 2 or more, comprising a pixel section having plural pixels, each of the pixels comprising memory circuits, the number of which is n×m wherein m is a natural number, a condenser, and a liquid crystal, the pixels being divided into blocks, the number of the pixels in each of the blocks being k which is a natural number of 2 (inclusive) to n (inclusive), and each of the blocks comprising a D/A converter circuit.

The present invention provides:

a liquid crystal display device for displaying a picture by inputting n-bit digital picture signals wherein n is a natural number of 2 or more, comprising a source signal line driving circuit, a gate signal line driving circuit, a DAC controller, and a pixel section, the pixel section comprising plural pixels, each of the pixels comprising memory circuits, the number of which is n×m wherein m is a natural number, a condenser, and a liquid crystal, digital picture signals corresponding to at most m frames being memorized, the pixels being divided into blocks, the number of the pixels in each of the blocks being k which is a natural number of 2 or more, and each of the blocks comprising a D/A converter circuit.

The present invention provides a method of driving a liquid crystal display device, in which the n-bit digital picture signals memorized in one pixel i out of the k pixels are inputted to the D/A converter circuit of each of the blocks so as to convert the digital signals to analogue signals, and the analogue signals are inputted to the condenser and the liquid crystal element which the pixel i has.

The present invention provides a method of driving a liquid crystal display device, in which the n-bit digital picture signals memorized in one pixel i out of the k pixels are inputted to the D/A converter circuit of each of the blocks so as to convert the digital signals to analogue signals, and the operation of inputting the analogue signals to the condenser and the liquid crystal element which the pixel i has is continuously performed for all of the k pixels included in each of the blocks.

The present invention provides a method of driving a liquid crystal display device, in which in a period for displaying a still image, the operation of the source signal line driving circuit is stopped by repetitively reading out the n-bit digital picture signals memorized in the memory circuits by means of the DAC controller so as to display the still image.

The present invention provides a method of driving a liquid crystal display device, in which in a period for displaying a still image, the operation of the gate signal line driving circuit is stopped by repetitively reading out the n-bit digital picture signals memorized in the memory circuits by means of the DAC controller so as to display the still image.

The present invention provides a method of driving a liquid crystal display device, in which in a period for displaying a still image, the operation of the source signal line driving circuit and the operation of the gate signal line driving circuit are stopped by repetitively reading out the n-bit digital picture signals memorized in the memory circuits by means of the DAC controller so as to display the still image.

The present invention provides a method of driving a liquid crystal display device, wherein the source signal line driving circuit comprises a shift register, a first latch circuit, a second latch circuit and a switch, sampling pulses are outputted by a start pulse, a clock pulse, and an inversion clock pulse inputted to the shift register, n-bit digital picture signals are held in the first latch circuit by the sampling pulses, the n-bit digital picture signals held in the first latch circuit are transferred to the second latch circuit by a latch pulse, the n-bit digital picture signals transferred to the second latch circuit are outputted through the switch to source signal lines, and the n-bit digital picture signals outputted to the source signal lines are memorized in the memory circuits.

The present invention provides a method of driving a liquid crystal display device, in which the source signal line driving circuit successively inputs the n-bit digital picture signals, bit by bit, to the memory circuits.

The present invention provides a method of driving a liquid crystal display device, in which the source signal line driving circuit comprises an x-address decoder, and in the memory circuits, data can be selectively written on individual vertical lines.

The present invention provides a method of driving a liquid crystal display device, in which the gate signal line driving circuit comprises a y-address decoder, and in the memory circuits, data can be selectively written on individual horizontal lines.

The present invention provides a method of driving a liquid crystal display device, in which the source signal line driving circuit comprises an x-address decoder, the gate signal line driving circuit comprises a y-address decoder, and in the memory circuits, data can be selectively written in individual pixels having arbitrary coordinates.

The present invention may be a liquid crystal display device in which the pixels, the source signal line driving circuit, the gate signal line driving circuit, and the DAC controller are formed on a single substrate.

The present invention may be a liquid crystal display device in which the memory circuits are static random access memories (SRAM).

The present invention may be a liquid crystal display device in which the memory circuits are ferroelectric random access memories (FRAM).

The present invention may be a liquid crystal display device in which the memory circuits are dynamic random access memories (DRAM).

The present invention also provides a television, a personal computer, a portable terminal, a video camera, or ahead mount display wherein a liquid crystal display device of the present invention is used.

BRIEF DESCRIPTION OF THE DRAWINGS

FIGS. 24A to 24C are views illustrating a process for producing the liquid crystal display device of the present invention.

FIGS. 25A to 25C are views illustrating a process for producing the liquid crystal display device of the present invention.

PREFERRED EMBODIMENTS OF THE INVENTION

The configuration of pixels in a liquid crystal display device of an embodiment according to the present invention will be described hereinafter.

FIG. 1 is a circuit diagram illustrating the above-mentioned configuration.

The pixels in the display device of the present embodiment are divided to several blocks. Each of the blocks shares one D/A converter circuit, which is represented by DAC in FIG. 1. Referring to FIG. 1, the configuration of the pixel section of the liquid crystal display device of the present embodiment will be described, paying attention to a block 10 composed of pixels, the number of which is k. The number k is a natural number of 2 or more.

In the present embodiment, all of the pixels included in the same block are arranged on the same horizontal line inside the pixel section. In other words, all writing TFTs, for controlling memory circuits corresponding to the same bit, of the pixels included in the same block are connected to the same gate signal line.

Figure 1A:
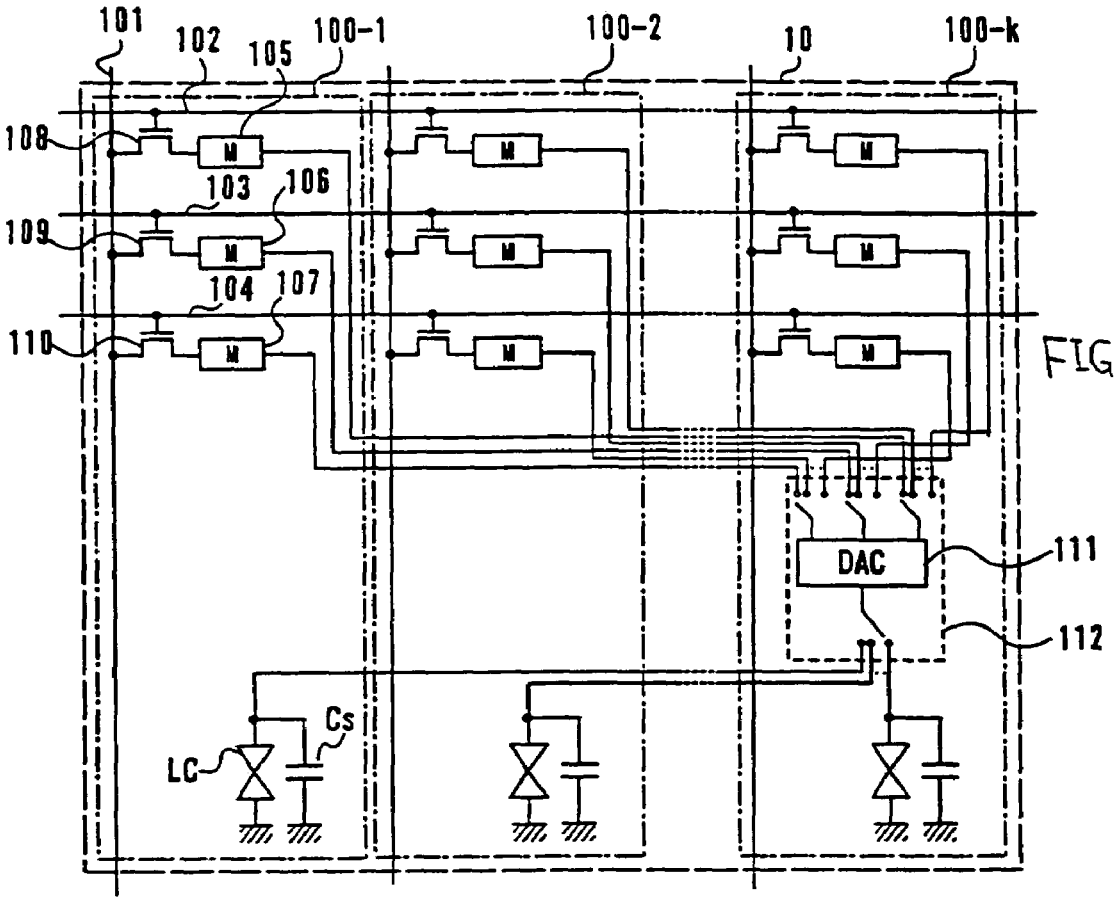
FIGS. 1A and 1B are views illustrating a configuration of pixels of the liquid crystal display device of the present invention.

For example, in FIG. 1(A), writing TFTs 108 control memory circuits 105 corresponding to the most significant bit of digital data. A writing gate signal line 102 is connected to the gate electrode of the writing TFT 108 in each of all pixels 100-1 to **100-*k* included in a block 10**.

In the present embodiment, k pixels in each of the blocks are represented by 100-1 to **100-*k***.

Figure 10:
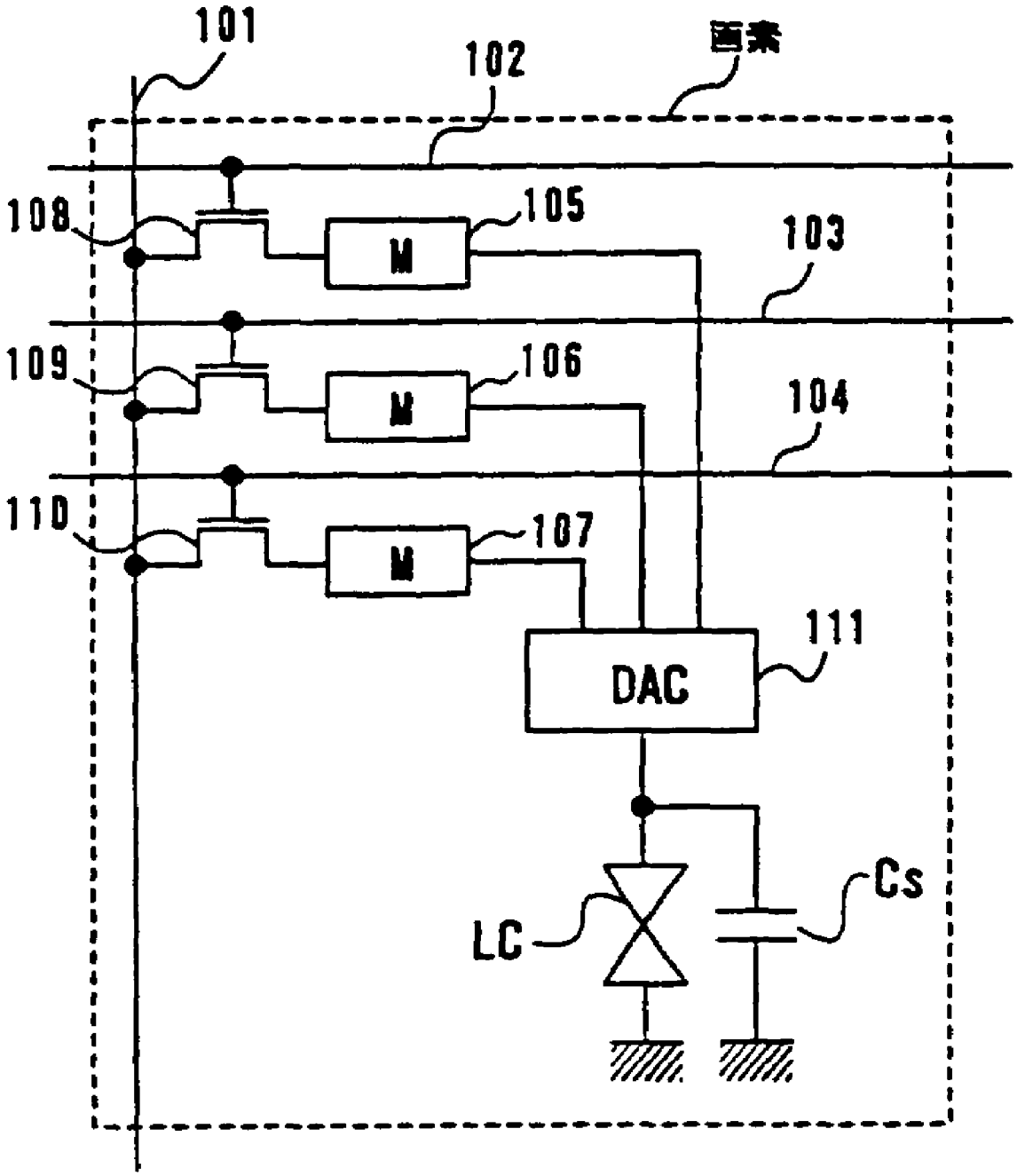
FIG. 10 (PRIOR ART)
FIG. 10 is a view illustrating a configuration of a pixel of a liquid crystal display device.

In FIG. 1A, the same members or portions in FIG. 10 are represented by the same reference numbers as in FIG. 10. The operation until digital signals are held in the memory circuits in the respective pixels is the same as described in the item "Summary of the Invention". Therefore, the description thereof is omitted.

In the block 10, the pixels 100-1 to **100-*k* share one DAC 111**.

Each of the 100-1 to **100-*k* has a source signal line 101, writing gate signal lines 102 to 104, memory circuits (M) 105 to 107, writing TFTs 108 to 110**, a condenser Cs and a liquid crystal LC.

Each of the circuits 105–107 is a memory circuit for memorizing a 1-bit signal. Thus, each of the pixels 100-1 to **100-*k*** can totally memorize 3-bit signals. Pixels used in the present invention are not limited to the pixels each of which has the 3-bit memory circuits. Thus, the present invention can be applied to liquid crystal display devices composed of pixels having memory circuits for memorizing arbitrary bit number signals.

Figure 1B:
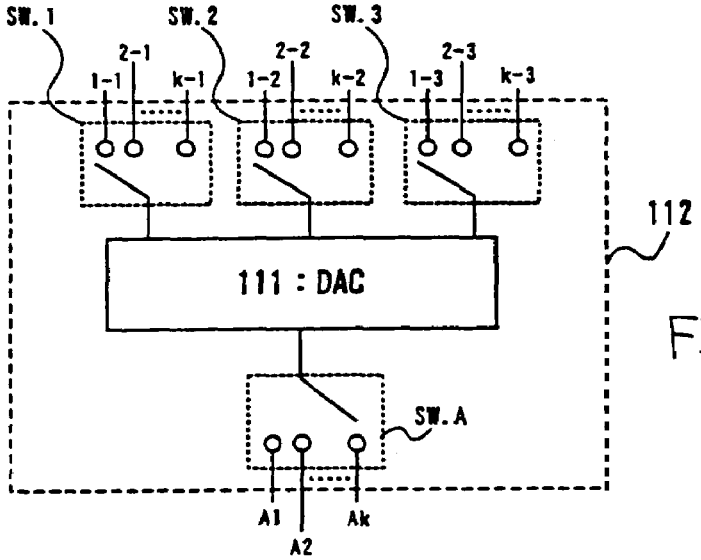

FIG. 1B is an enlarged view of a periphery 112 of the DAC 111. The following will describe the operation of converting digital signals memorized in the memory circuits 105 to 107.

In FIG. 1B, signals from the memory circuits 105 to 107 of the respective pixels are selected, in the corresponding bit unit, through switches SW.1 to SW.3, respectively. The switch for selecting signals from the memory circuit corresponding to the least significant bit is represented by SW.1, and the switch for selecting signals from the memory circuit corresponding to the most significant bit is represented by SW.3.

Digital signals corresponding to 3-bits are held in the memory circuits 105 to 107 of the respective pixels, and subsequently signals 1-1, 1-2, and 1-3 from the memory circuits 105 to 107 of the first pixel 100-1 are selected through the switches SW.1 to SW.3, respectively, to be inputted to the DAC 111. The 3-bit signals are converted to analogue signals by the DAC 111. At the same time, a terminal A1 is selected through a switch SW.A to input the analogue signals outputted from the DAC 111, as outputs corresponding to the pixel 100-1, to the condenser Cs and the liquid crystal LC of the pixel 100-1. In this way, the signals corresponding to the firs pixel 100-1 are processed.

Thereafter, signals 2-1, 2-2, and 2-3 from the memory circuits 105 to 107 of the second pixel 100-2 are selected through the switches SW.1 to SW.3, respectively, to be inputted to the DAC 111. The 3-bit signals are converted to analogue signals by the DAC 111. At the same time, a terminal A2 is selected through a switch SW.A to input the analogue signals outputted from the DAC 111, as outputs corresponding to the pixel 100-2, to the condenser Cs and the liquid crystal LC of the pixel 100-2. In this way, the signals corresponding to the second pixel 100-2 are processed.

Substantially the same operation is performed for all of the k pixels sharing the DAC 111. In this way, the signals memorized in the memory circuits of all the pixels can be converted to analogue signals.

The above-mentioned operation is performed for all the blocks in the same way, so that the digital signals memorized in all the pixels can be converted to analogue signals. The above-mentioned operation can be simultaneously performed for all the blocks.

According to the present invention, the plural pixels can share the DAC by the above-mentioned structure. For example, in the case in which the k pixels share the DAC, the area of the DAC in each of the pixels can be made to about 1/k of that in the case in which the DAC is not shared. In this way, the area of the DACs in the pixels can be made small. Accordingly, a larger number of memory circuits can be arranged.

EXAMPLES

Examples of the present invention will be described hereinafter.

Example 1

In the present example, the periphery 112 of the DAC in the circuit described as the above-mentioned embodiment will be specifically shown, and the operation thereof will be described.

Figure 2A:
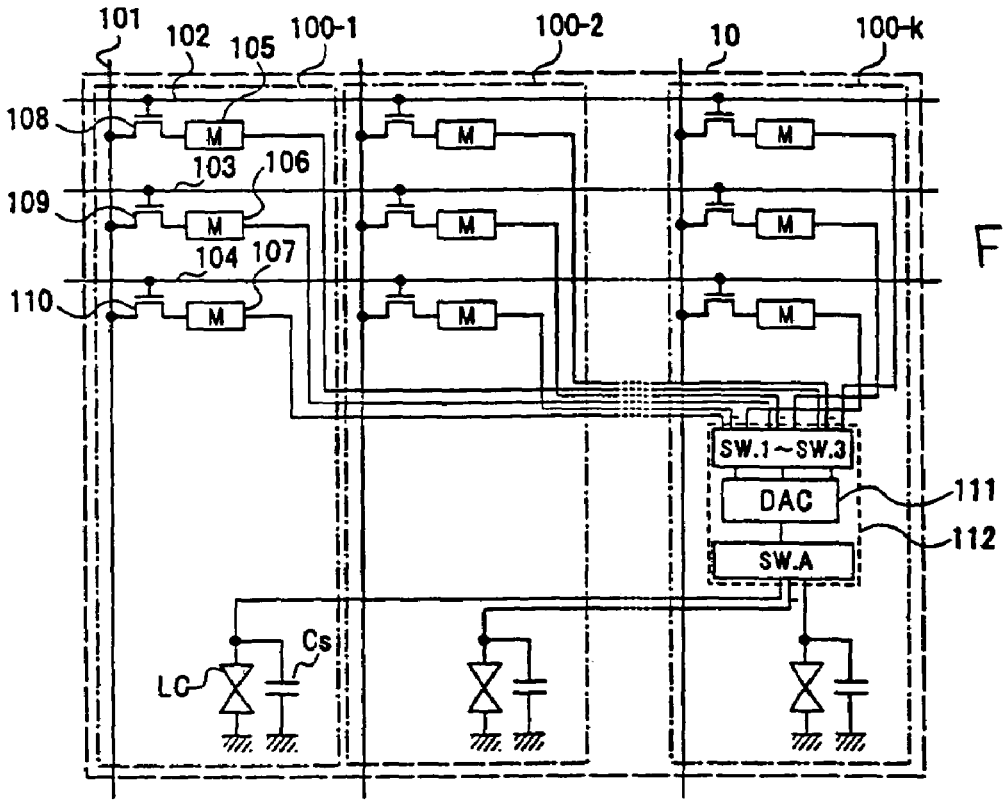
FIGS. 2A and 2B are views illustrating a configuration of pixels of the liquid crystal display device of the present invention.
Figure 2B:
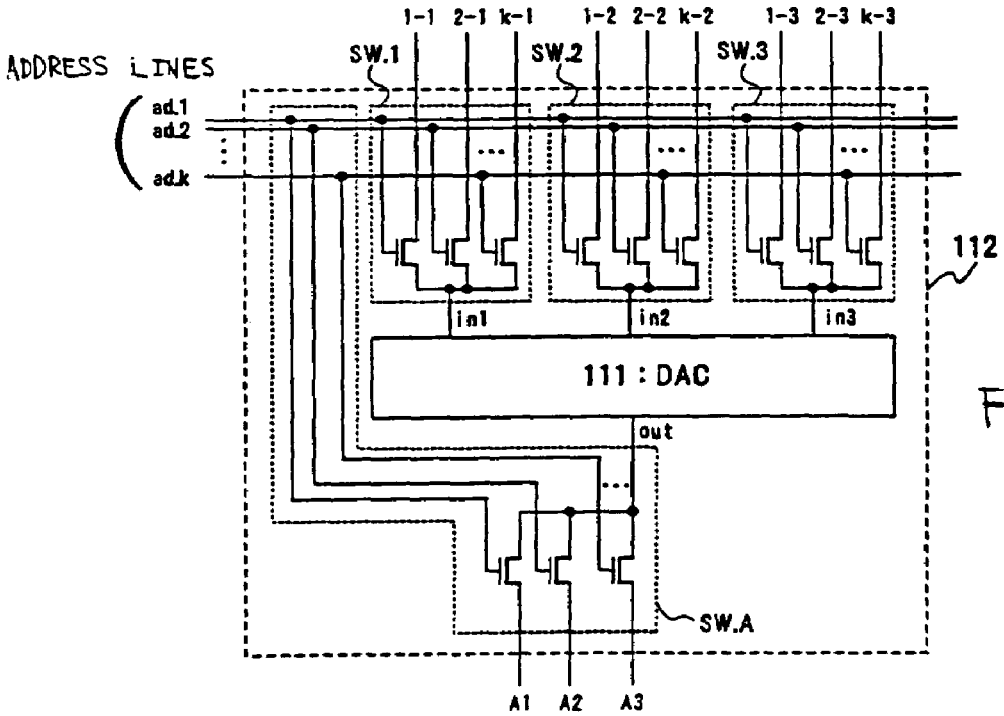

FIG. 2A is a circuit diagram showing the configuration of the pixel section of the present example. FIG. 2B illustrates a structural example of the periphery 112 of the DAC in FIG. 2A. In FIG. 2, the same members or portions as in FIG. 1 are represented by the same reference numbers and the explanation thereof is omitted.

In FIG. 2, pixels corresponding to a 3-bit digital gradation display device are illustrated. However, the present example can be applied to liquid crystal display devices composed of pixels having memory circuits in an arbitrary bit number.

Figure 11:
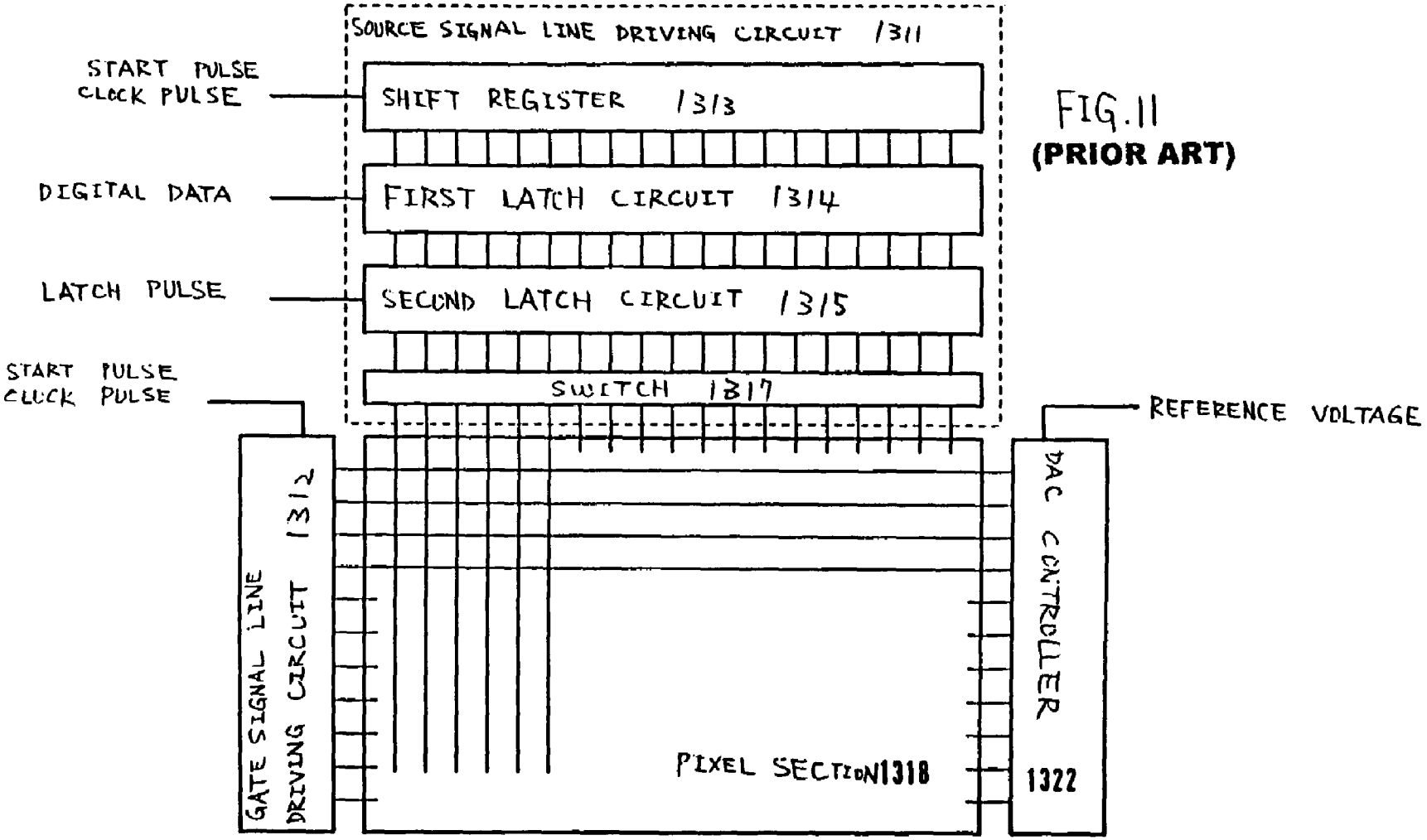
FIG. 11 (PRIOR ART)
FIG. 11 is a view illustrating a configuration of a liquid crystal display device.

The manner which should be carried out until digital signals are inputted to memory circuits of the respective pixels in FIG. 2A is the same as described with reference to FIGS. 11 to 13.

Referring to timing charts of FIGS. 2 and 4, the operation of the periphery 112 of the DAC will be described hereinafter.

First, the operation carried out until digital data are held in the memory circuits of the respective pixels will be described.

In a source signal line driving circuit, digital picture signals corresponding to a horizontal term are held in accordance with sampling pulses outputted from a shift register circuit (digital data sampling).

Thereafter, during are trace line period, a latch pulse is inputted so that the digital picture signals (digital data) transferred to the second latch circuit are inputted to a source signal line.

One horizontal term can be classified to three periods, that is, the first bit writing period, the second bit writing period and the third bit writing period.

In the first bit writing period, the signal of the digital data D3 is inputted to the source signal line by a bit selecting signal. At this time, the signal is inputted to the writing gate signal line 102-L1 so that the writing TFT 108-L1 connected to this writing gate signal line conducts. In this way, the signal D3 of the first bit is written in the memory circuit (M) 105.

Next, in the second bit writing period, the signal of the digital data D2 is inputted to the source signal line by a bit selecting signal. At this time, the signal is inputted to the writing gate signal line 103-L1 so that the writing TFT 109-L1 connected to this writing gate signal line conducts. In this way, the signal D2 of the second bit is written in the memory circuit (M) 106.

Next, in the third bit writing period, the signal of the digital data D1 is inputted to the source signal line by a bit selecting signal. At this time, the signal is inputted to the writing gate signal line 103-L1 so that the writing TFT 109-L1 connected to this writing gate signal line conducts. In this way, the signal D1 of the third bit is written in the memory circuit (M) 107.

The period until the DAC processing period during the next horizontal term after the third bit writing period is used to convert the written digital picture signals to analogue signals in the DAC 111 (DAC processing period).

It is allowable to make the period for writing the digital signals short, that is, make sampling of the shift register in the source signal line driving circuit speedy. In this way, the retrace line period of the shift register may be made long.

The following will describe the operation of the DAC processing period.

In FIG. 2B, the switches SW.1 to SW.3 and SW.A are composed of TFTs and address lines ad.1 to ad.k. The address lines ad.1 to ad.k are used when inputs from the pixels 100-1 to 100-*k*, respectively, to the DAC 111 are selected and further outputs from the DAC 111 to the pixels 100-1 to 100-*k*, respectively, are selected.

The TFT whose gate electrode is connected to the address line ad.1 to which a signal is inputted turns into a conductive state. The fact that a certain address line is selected means that the TFT whose gate electrode is connected to the address line is in a conductive state.

Figure 4:
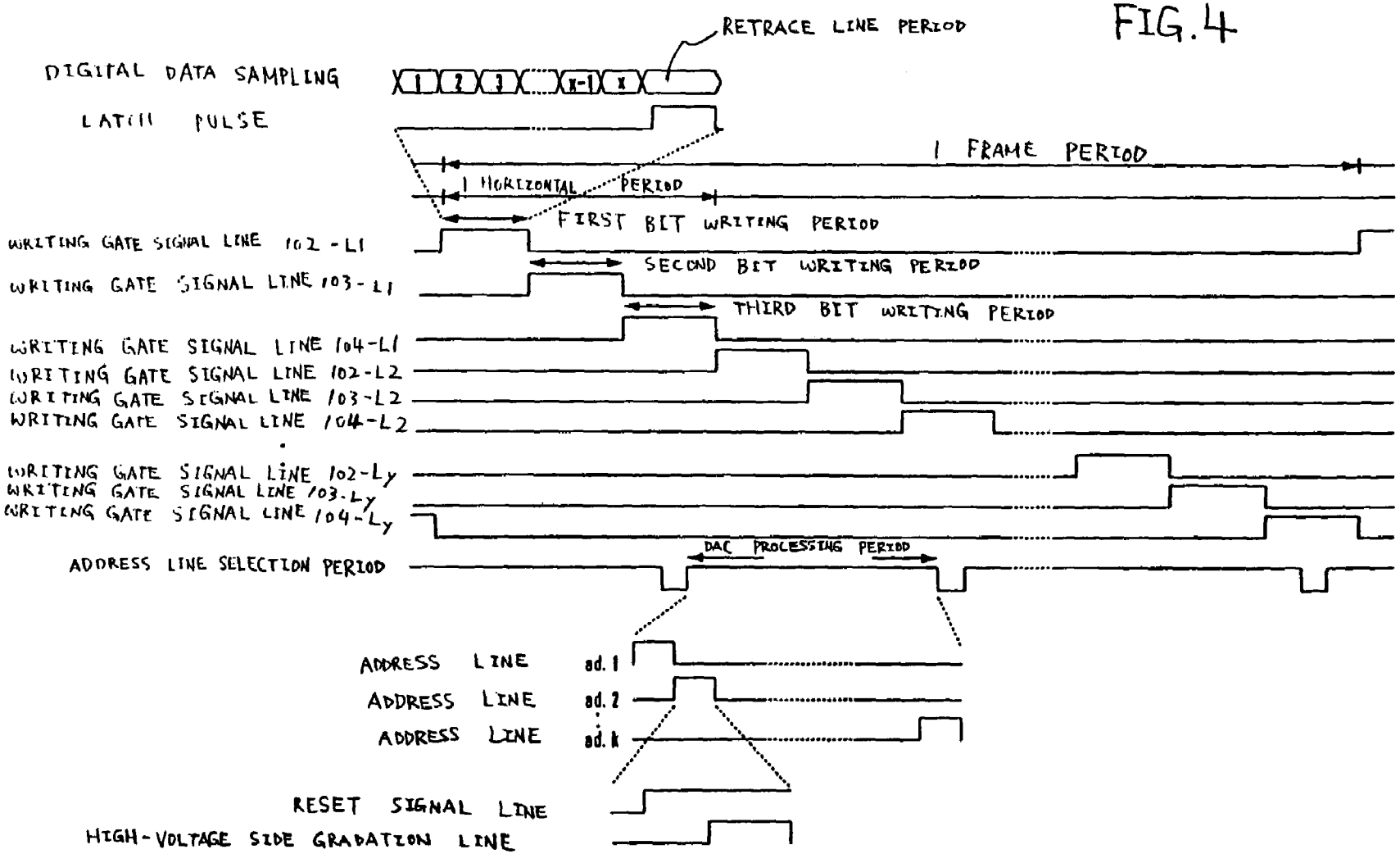
FIG. 4 is a timing chart showing a method of driving the liquid crystal display device of the present invention.

In the timing chart of FIG. 4, the operation in the case in which all of the TFTs connected to the address lines are n-channel type TFTs is shown. These TFTs may be p-channel type TFTs or n-channel type TFTs. It is however necessary that the polarities of the TFTs connected to the same address line are the same.

When the address line ad.1 is selected, the other address lines ad.2 to ad.k are not selected.

Signals from the memory circuit of the selected pixel are inputted, through the TFTs which are in a conductive state by the connection of their gate electrodes to the address line ad.1, to the DAC 111 so as to be converted to analogue signals. The analogue signals are inputted to the condenser CS and the liquid crystal element LC of the selected pixel. In accordance with the inputted analogue signals, the transmittivity of the liquid crystal element LC changes so that the brightness thereof is represented. The brightness having 8 steps from 0 to 7 can be obtained because of the 3-bit signals.

Next, the address line ad.2 is selected, and the other address lines ad.1, and ad.3 to ad.k are not selected. At this time, signals from the memory circuit of the selected pixel are inputted, through the TFTs wherein gate electrodes are connected to the address line ad.2, to the DAC 111 so as to be converted to analogue signals. The analogue signals are inputted to the condenser CS and the liquid crystal element LC of the selected pixel. In accordance with the inputted analogue signals, the transmittivity of the liquid crystal element LC changes so that the brightness thereof is represented. The brightness having 8 steps from 0 to 7 can be obtained because of the 3-bit signals.

The same operation is repeated about all the address lines. Digital signals memorized in the memory circuits of all the pixels 100-1 to 100-*k* in the block 100 are converted to analogue signals. The analogue signals resulting from the conversion are used to represent the brightness of the liquid crystal elements.

Figure 14:
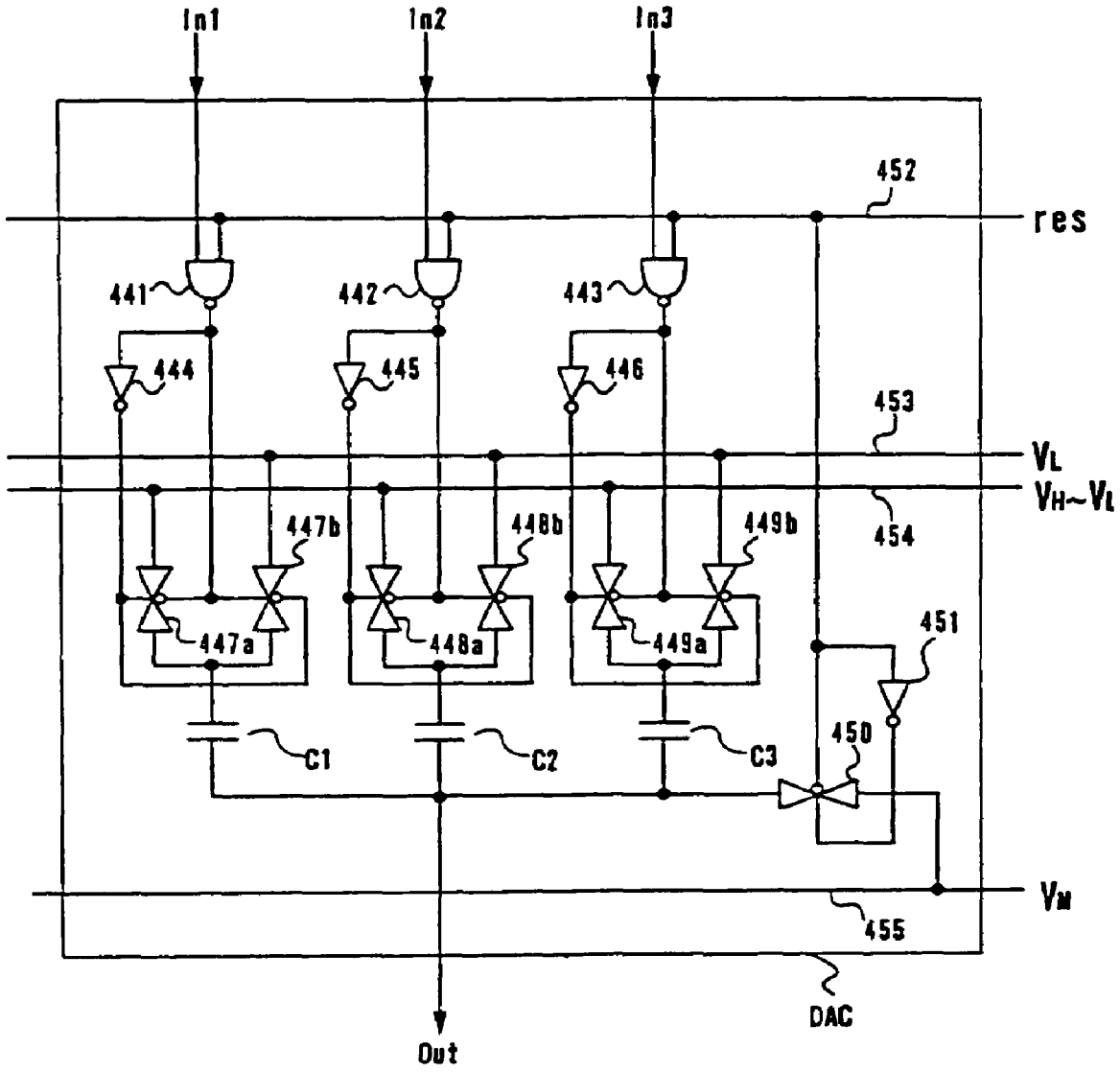
FIG. 14 is a view illustrating a configuration of a DAC of the liquid crystal display device of the present invention.

A specific configuration of the DAC is illustrated in FIG. 14. Terminals represented by "In1" to "In3" and "Out" in FIG. 14 correspond to terminals "In1" to "In3" and out in FIG. 2B.

In FIG. 14, the DAC is composed of NAND circuits 441 to 443, inverters 444 to 446 and 451, switches 447*a* to 449*a*, switches 447*b* to 449*b*, a switch 450, condensers C1 to C3, a reset signal line 452, a low-voltage side gradation power line 453, a high-voltage side gradation power line 454, and a middle-voltage side gradation power line 455.

First, the switch 450 turns into a conductive state by a signal res inputted to the reset signal line 452, and then the voltage, at the side connected to the terminal Out (the side being referred to as the counter electrode side hereinafter), of the condensers C1 to C3 is fixed to voltage $V_M$ of the middle-voltage side gradation power line 455. The voltage of the high-voltage side gradation power line 454 is set to be equal to voltage $V_L$ of the low-voltage side gradation power line 453. Even if digital signals are inputted to the terminals In1 to In3 at this time, no signals are written in the condensers C1 to C3.

Thereafter, the signal res on the reset signal line 452 changes so that the switch 450 turns off. As a result, the fixation of the voltage, at the side of terminal Out, of the condensers C1 to C3 is cancelled. Next, the voltage of the high-voltage side gradation power line 454 changes to voltage $V_H$ which is different from the voltage $V_L$ of the low-voltage side gradation power line 453. At this time, in accordance with signals inputted to the terminals In1 to In3, the outputs of the NAND circuits 441 to 443 change so that either of the two switches which constitutes each of the switches 447 to 449 turns on. As a result, the voltage $V_H$ of the high-voltage side gradation power line or the voltage $V_L$ of the low-voltage side gradation power line is applied to the electrodes of the condensers C1 to C3.

The capacity values of the condensers C1 to C3 are set correspondingly to the respective bits.

The voltages at the counter electrodes sides change by the voltages applied to the condensers C1 to C3, so that the voltage of the outputs change. That is, analogue signals corresponding to the digital signals inputted to the terminals In1 to In3 are outputted from the terminal Out.

In the DAC having the above-mentioned configuration, various gradations can be represented by dividing a reference voltage by means of the condensers C1 to C3.

Such a capacitor-dividing type DAC is described on pages 29–32 of AMLCD Digest of Technical Papers.

The above has described the DAC for converting 3-bit digital signals to analogue signals. However, the above description can be applied to a DAC for converting digital signals in a different bit number to analogue signals.

As the configuration of the DAC in the display device of the present invention, a DAC having any known configuration can freely be used. There may be used, for example, a resistor-dividing type DAC, wherein a reference voltage is divided by means of resistors.

Referring to FIG. 4, the following will describe the operation of the respective DAC processing periods in the case of using the DAC having the configuration illustrated in FIG. 14. In the description, the reference numbers in FIG. 14 are also used.

In each of the DAC processing periods, the following operation is performed whenever any one of the address lines ad.1 to ad.k is selected.

A signal res is inputted to the reset signal line 452. Thereafter, the voltage of the high-voltage side gradation line 454 changes to $V_H$. In this way, the digital picture signals inputted to the DAC are converted to analogue signals.

Any signal to the reset signal line 452 and the high-voltage side gradation line 454 is inputted from the DAC controller.

The above-mentioned operation is performed about all the blocks, so as to convert the digital signals memorized in the memory circuits of all the pixels to analogue signals.

In order to convert the digital signals in the pixels which all the blocks have to analogue signals as effectively as possible, it is desired that the numbers of the pixels constituting the respective blocks are the same.

The configurations of the switches SW.1 to SW.3, and SW.A are not limited to those illustrated in FIG. 2B, and may have any known configuration.

If digital signals are once written in the memory circuits which the respective pixels have during the display of a still image, the digital signals memorized in the respective pixels are converted to analogue signals by the above-mentioned operation of the DAC, so that the image can be displayed. At this time, the operation of the source signal line driving circuit, the gate signal line driving circuit, the external circuit and so on can be stopped. It is therefore sufficient that at this time only the DAC controller for controlling the operations of the DACs in the respective blocks in the pixel section acts.

In the above-mentioned way, provided is a liquid crystal display device wherein the area of the DAC in each pixel is small and power consumption is low.

Example 2

In the present example, a configuration of pixels sharing a DAC in a manner different from that of the above-mentioned Embodiment or Example 1 will be described.

Figure 3A:
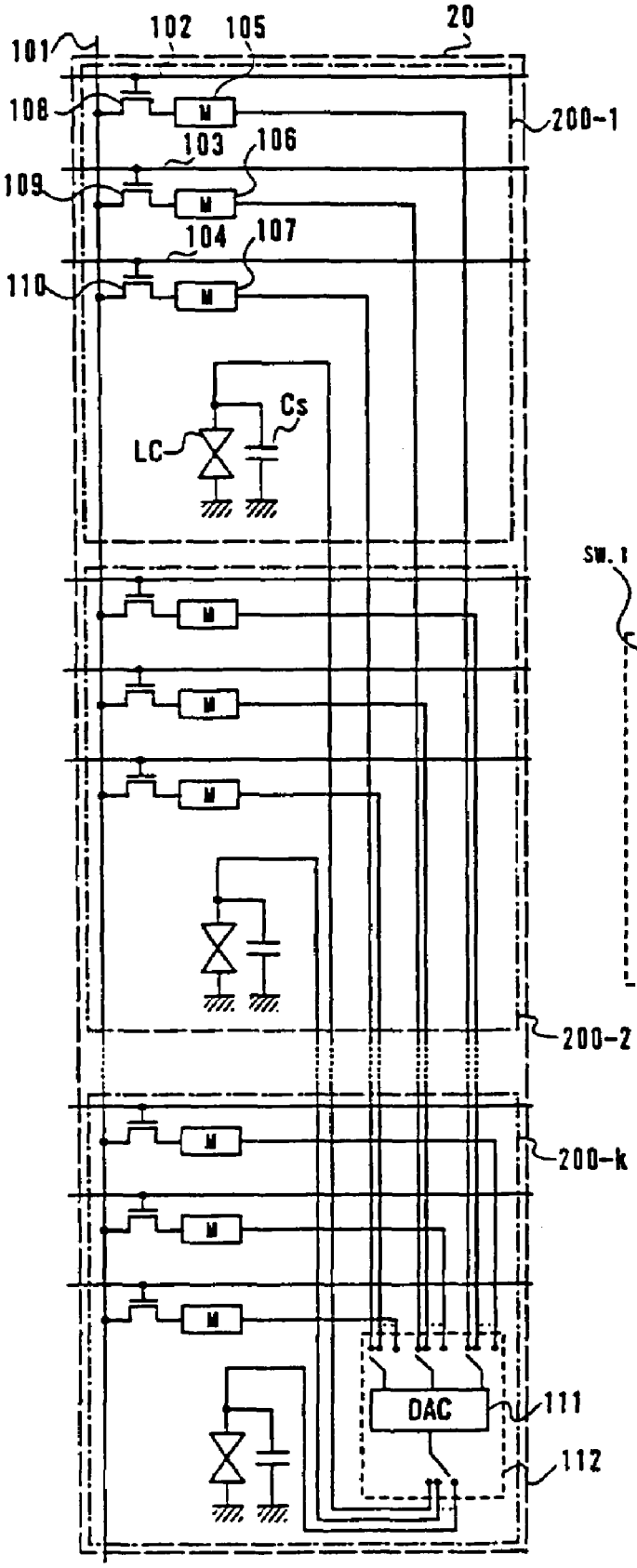
FIGS. 3A and 3B are views illustrating a configuration of pixels of the liquid crystal display device of the present invention.

Referring to FIG. 3, the configuration of the pixels of the present example will be described. In FIG. 3, the same elements or portions as in FIGS. 1 and 2 are represented by the same reference numbers, and the explanation thereof is omitted.

FIG. 3 illustrates the pixels corresponding to a display device of 3-bit digital gradation. However, the present example can be applied to liquid crystal display devices composed of pixels having memory circuits in an arbitrary bit number.

In FIG. 3, plural pixels 200-1 to 200-*k* share one DAC 111. The configuration of the DAC 111 may be the same as in Example 1. Each of the pixels has memory circuits 105 to 107, a source signal line 101, writing gate signal lines 102 to 104, writing TFTs 108 to 110, a liquid crystal LC and a condenser CS.

In the present example, all of the pixels included in the block 20 have the writing TFTs connected to the same signal line. In other words, the pixels included in the block 20 are vertically arranged in the pixel section of the display device of the present invention. More specifically, all the pixels included in the block 20 are connected in the same column.

Figure 5:
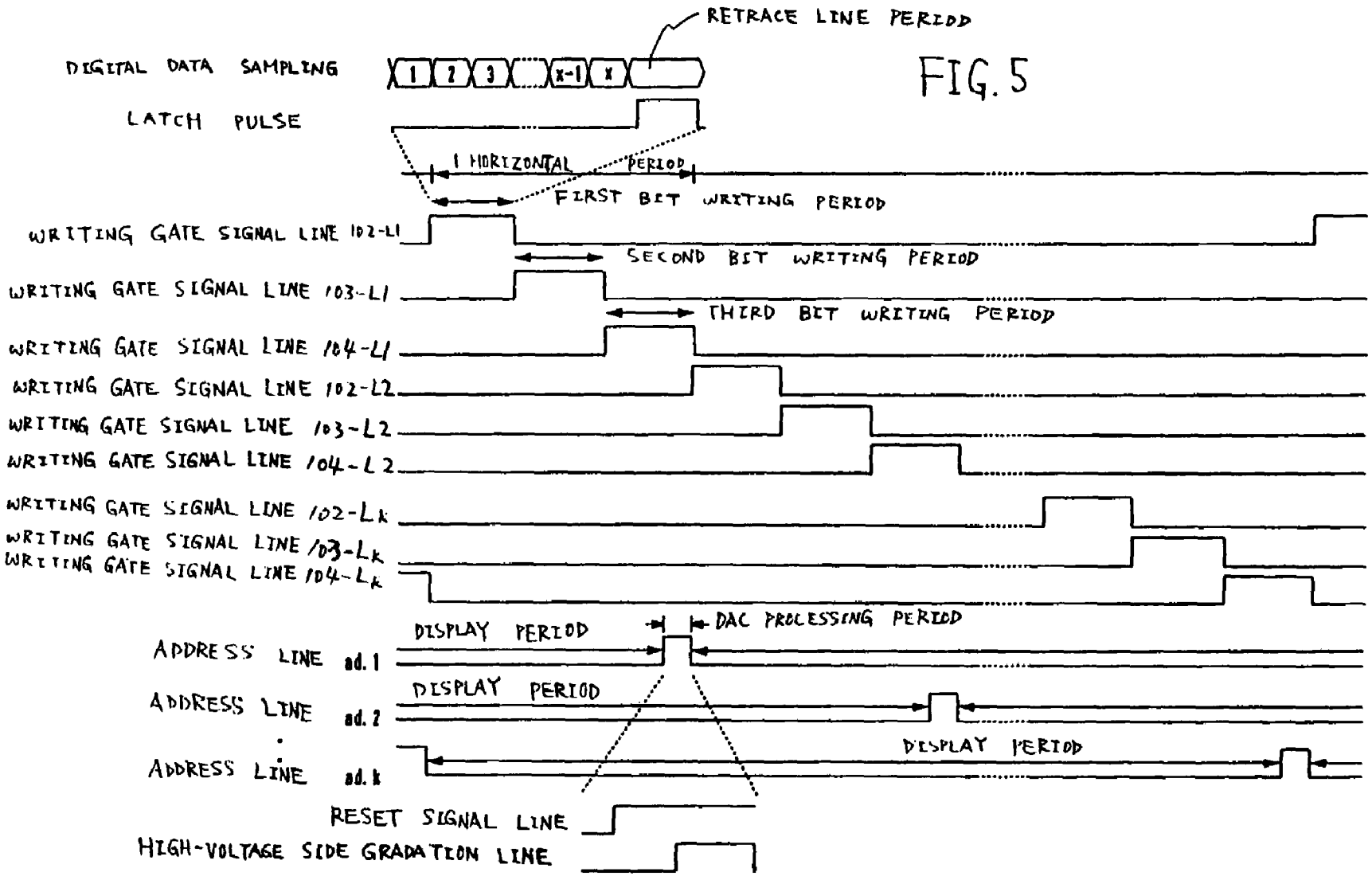
FIG. 5 is a timing chart showing a method of driving the liquid crystal display device of the present invention.
Figure 6:
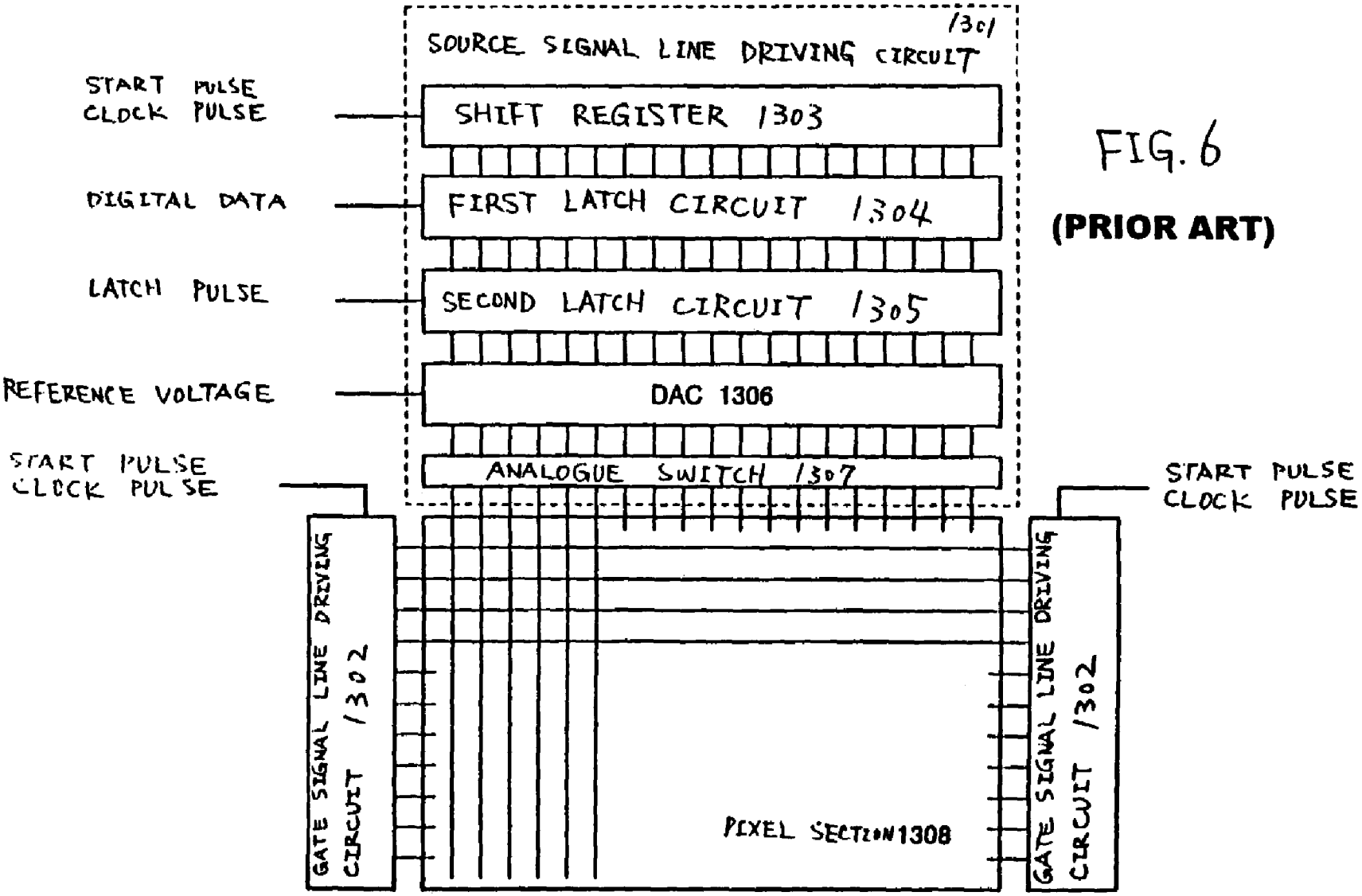
FIG. 6 (PRIOR ART)
FIG. 6 is a view illustrating a configuration of the liquid crystal display device of the present invention.
Figure 7:
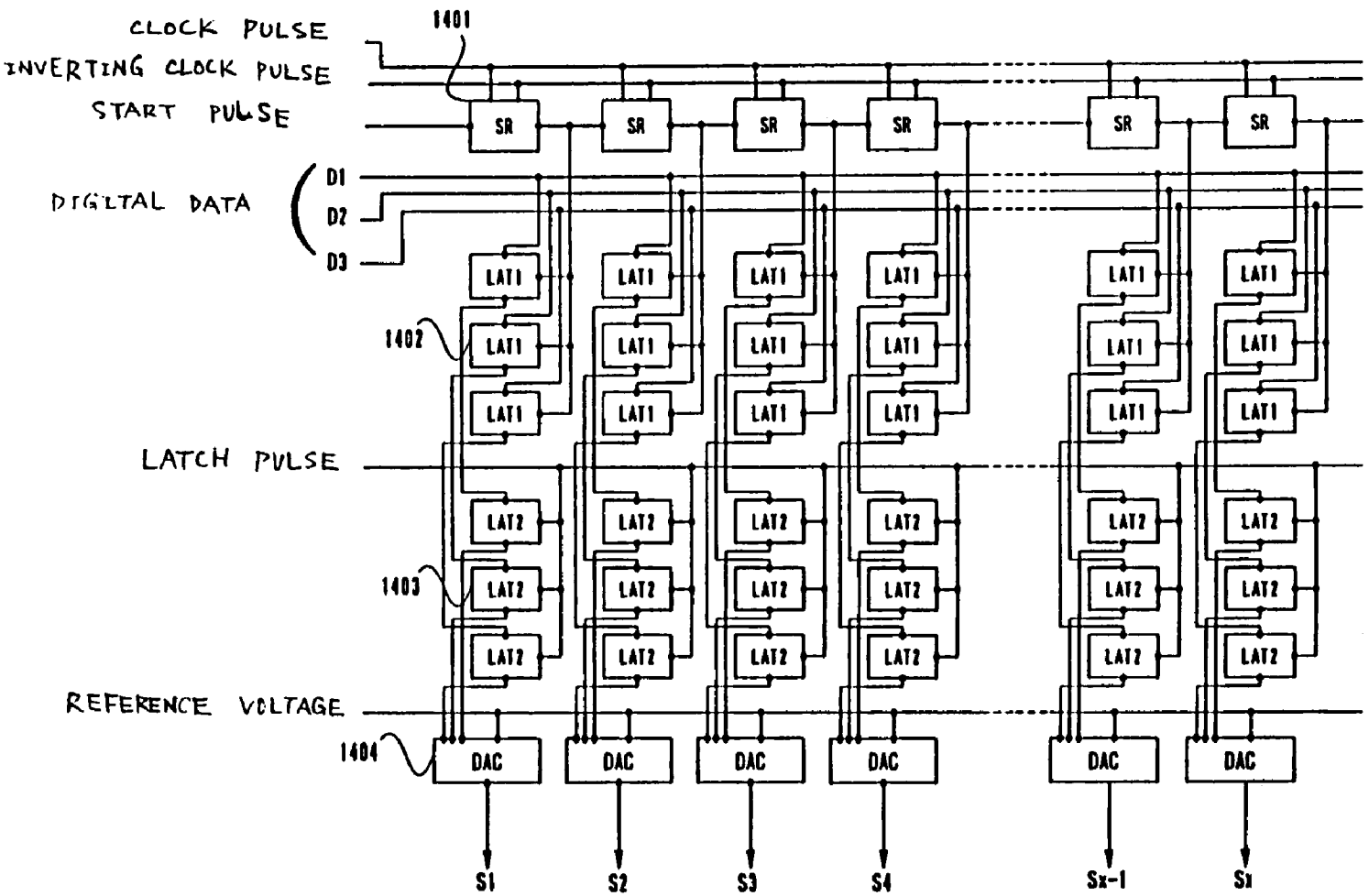
FIG. 7 (PRIOR ART)
FIG. 7 is a view illustrating a source signal line driving circuit of a conventional liquid crystal display device.
Figure 8:
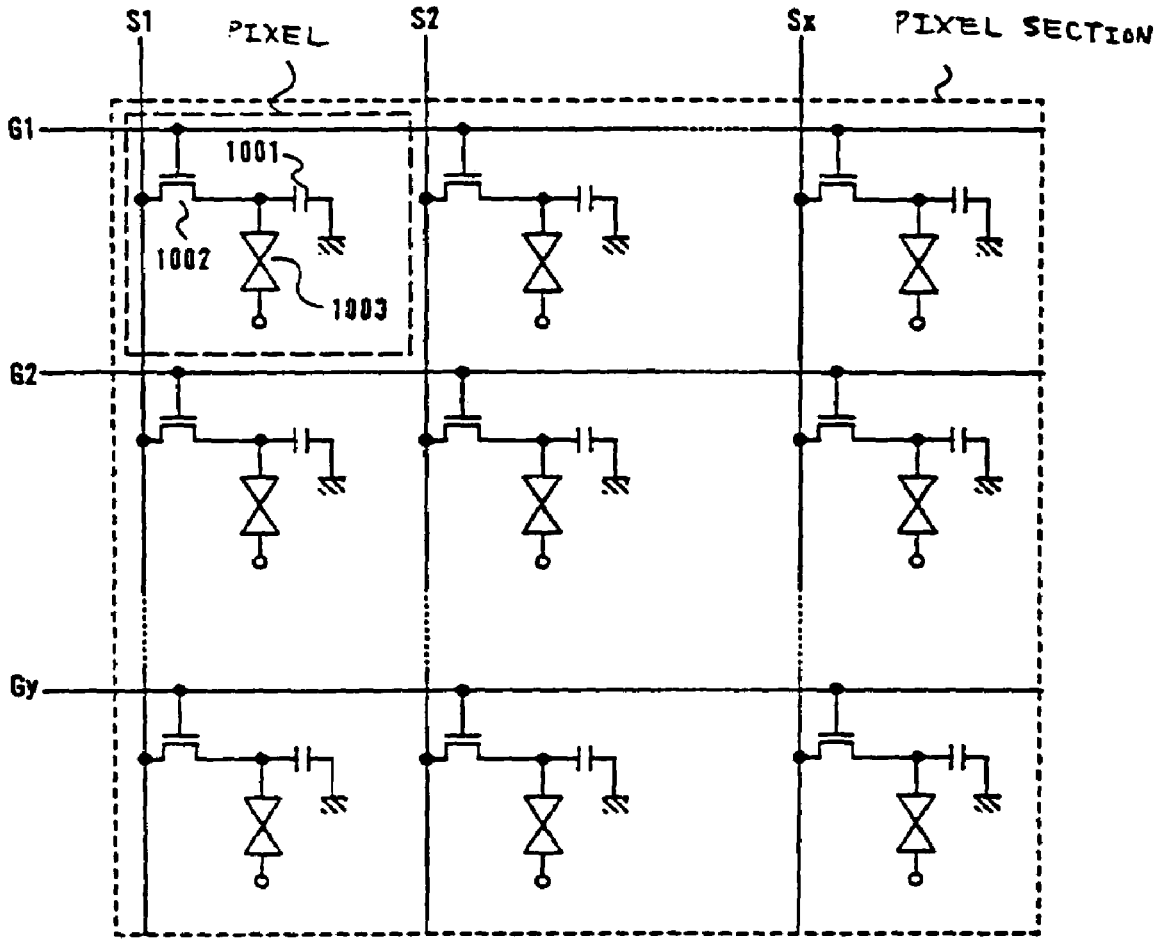
FIG. 8 (PRIOR ART)
FIG. 8 is a configuration of a pixel section of the conventional liquid crystal display device.
Figure 9:
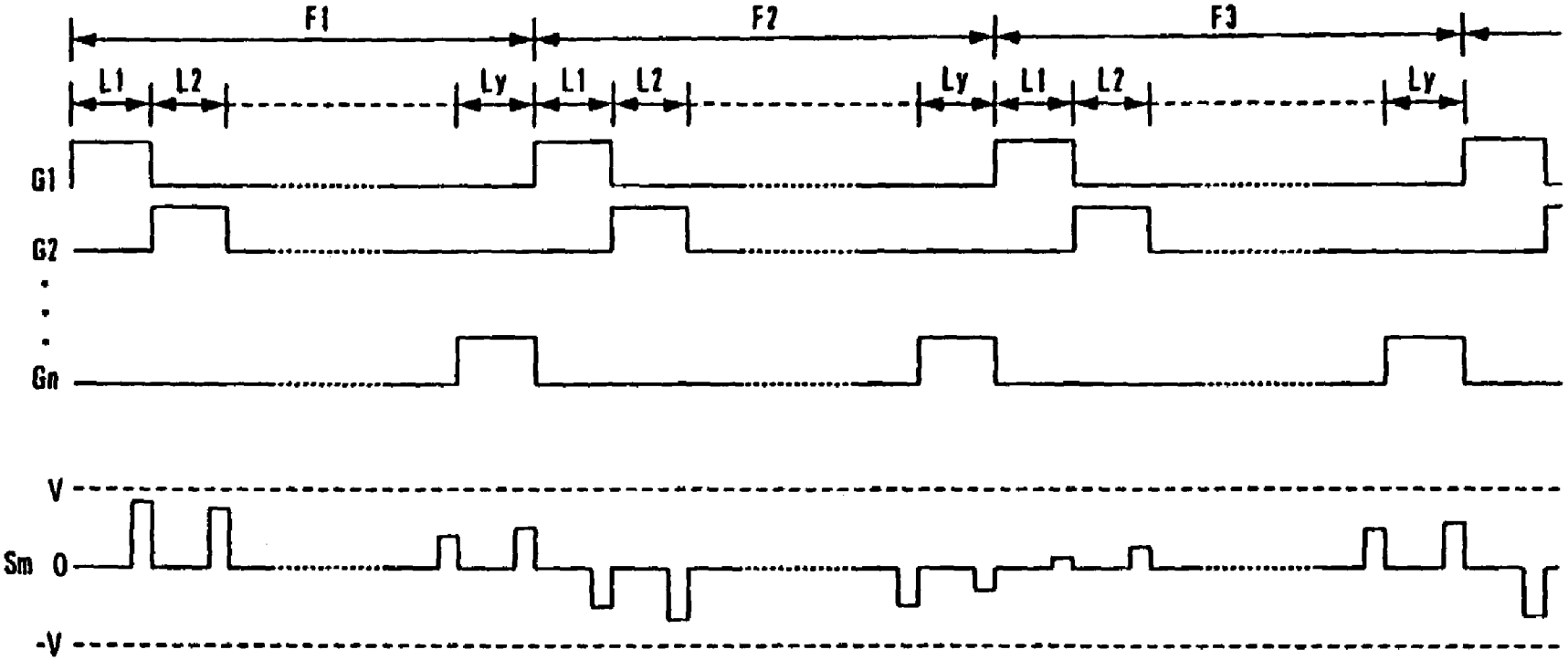
FIG. 9 (PRIOR ART)
FIG. 9 is a timing chart showing a method of driving the conventional liquid crystal display device.

Referring to FIG. 5, the method of driving the display device having this configuration will be described. In FIG. 5, the same portions as in the timing charts of FIGS. 2 and 4 are represented by the same reference numbers, and the explanation thereof is omitted.

FIG. 5 shows a timing chart of the operation in the case that the DAC having the configuration illustrated in FIG. 14 is used. However, the DAC in the liquid crystal display device of the present invention is not limited to the DAC illustrated in FIG. 14 and may be any DAC having a known configuration.

First, the operation performed until digital data are held in the memory circuits of the respective pixels will be described.

In the source signal line driving circuit, digital picture signals corresponding to one horizontal term are held in accordance with sampling pulses outputted from the shift register circuit (digital data sampling).

Thereafter, during are trace line period a latch pulse is inputted so that the digital picture signals (digital data) transferred to the second latch circuit are inputted to the source signal line.

One horizontal term can be classified into three periods, that is, the first bit writing period, the second bit writing period and the third bit writing period.

In the first bit writing period, the signal of the digital data D3 is inputted to the source signal line by a bit selecting signal. At this time, the signal is inputted to the writing gate signal line 102-L1 so that the writing TFT 108-L1 connected to this writing gate signal line conducts. In this way, the signal D3 of the first bit is written in the memory circuit (M) 105.

Next, in the second bit writing period, the signal of the digital data D2 is inputted to the source signal line by a bit selecting signal. At this time, the signal is inputted to the writing gate signal line 103-L1 so that the writing TFT 109-L1 connected to this writing gate signal line conducts. In this way, the signal D2 of the second bit is written in the memory circuit (M) 106.

Next, in the third bit writing period, the signal of the digital data D1 is inputted to the source signal line by a bit selecting signal. At this time, the signal is inputted to the writing gate signal line 103-L1 so that the writing TFT 109-L1 connected to this writing gate signal line conducts. In this way, the signal D1 of the third bit is written in the memory circuit (M) 107.

The period until the DAC processing period during the next horizontal term after the third bit writing period is used to convert the written digital picture signals to analogue signals in the DAC 111 (DAC processing period).

The following will describe the operation of this DAC processing period.

Figure 3B:
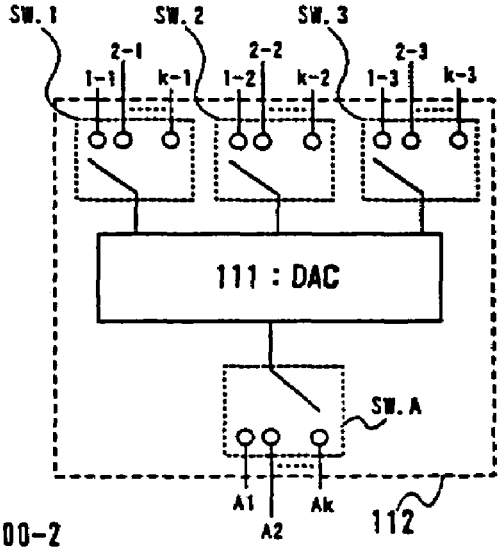

In FIG. 3B, the switches SW.1 to SW.3 and SW.A may be composed of TFTs and address lines ad.1 to ad.k in the same way as illustrated in FIG. 2B. The address lines ad.1 to ad.k are used when inputs from the pixels 200-1 to 200-*k*, respectively, to the DAC 111 are selected and further outputs from the DAC 111 to the pixels 200-1 to 200-*k*, respectively, are selected.

In the timing chart of FIG. 5, the operation in the case in which all of the TFTs connected to the address lines are n-channel type TFTs is shown. These TFTs may be p-channel type TFTs or n-channel type TFTs. It is however necessary that the polarities of the TFTs connected to the same address line are the same.

When the address line ad.1 is selected, the other address lines ad.2 to ad.k are not selected.

After the first horizontal term (L1) finishes, signals from the memory circuit of the selected pixel are inputted, through the TFTs which are in a conductive state by the connection of their gate electrodes to the address line ad.1, to the DAC 111.

A signal res is inputted to the reset signal line 452. Thereafter, the voltage of the high-voltage side gradation line 454 changes to $V_H$. In this way, the digital picture signals inputted to the DAC are converted to analogue signals. The analogue signals are inputted to the condenser CS and the liquid crystal LC of the selected pixel. In accordance with the inputted analogue signals, the transmittivity of the liquid crystal LC changes so that the brightness thereof is represented.

After the second horizontal term (L2) finishes, the address line ad.1 is selected and the other address lines ad.3 to ad.k are not selected. At this time, signals from the memory circuit of the selected pixel are inputted, through the TFTs which are in a conductive state by the connection of their gate electrodes to the address line ad.2, to the DAC 111.

A signal res is inputted to the reset signal line 452. Thereafter, the voltage of the high-voltage side gradation line 454 changes to $V_H$. In this way, the digital picture signals inputted to the DAC are converted to analogue signals. The analogue signals are inputted to the condenser CS and the liquid crystal LC of the selected pixel. In accordance with the inputted analogue signals, the transmittivity of the liquid crystal LC changes so that the brightness thereof is represented. The brightness having 8 steps from 0 to 7 can be obtained because of the 3-bit signals.

The same operation is repeated about plural horizontal terms so that the same operation is performed about all the address lines. In this way, digital signals memorized in the memory circuits of all the pixels 200-1 to 200-*k* in the block 20 are converted to analogue signals. The analogue signals resulting from the conversion are used to represent the brightness of the liquid crystal elements.

The above-mentioned operation is performed in the same way about all the blocks so that the digital data held in all the pixels are converted to analogue signals.

In the DAC-sharing manner in the present example, it is sufficient that only one DAC is selected for one line (one horizontal term). It is therefore unnecessary to perform the switching of the switches SW.1 to SW.3 and SW.A plural times in the DAC processing period during one horizontal term. As a result, it is unnecessary that, the operation of the switching is performed at a high speed.

Example 3

Figure 15:
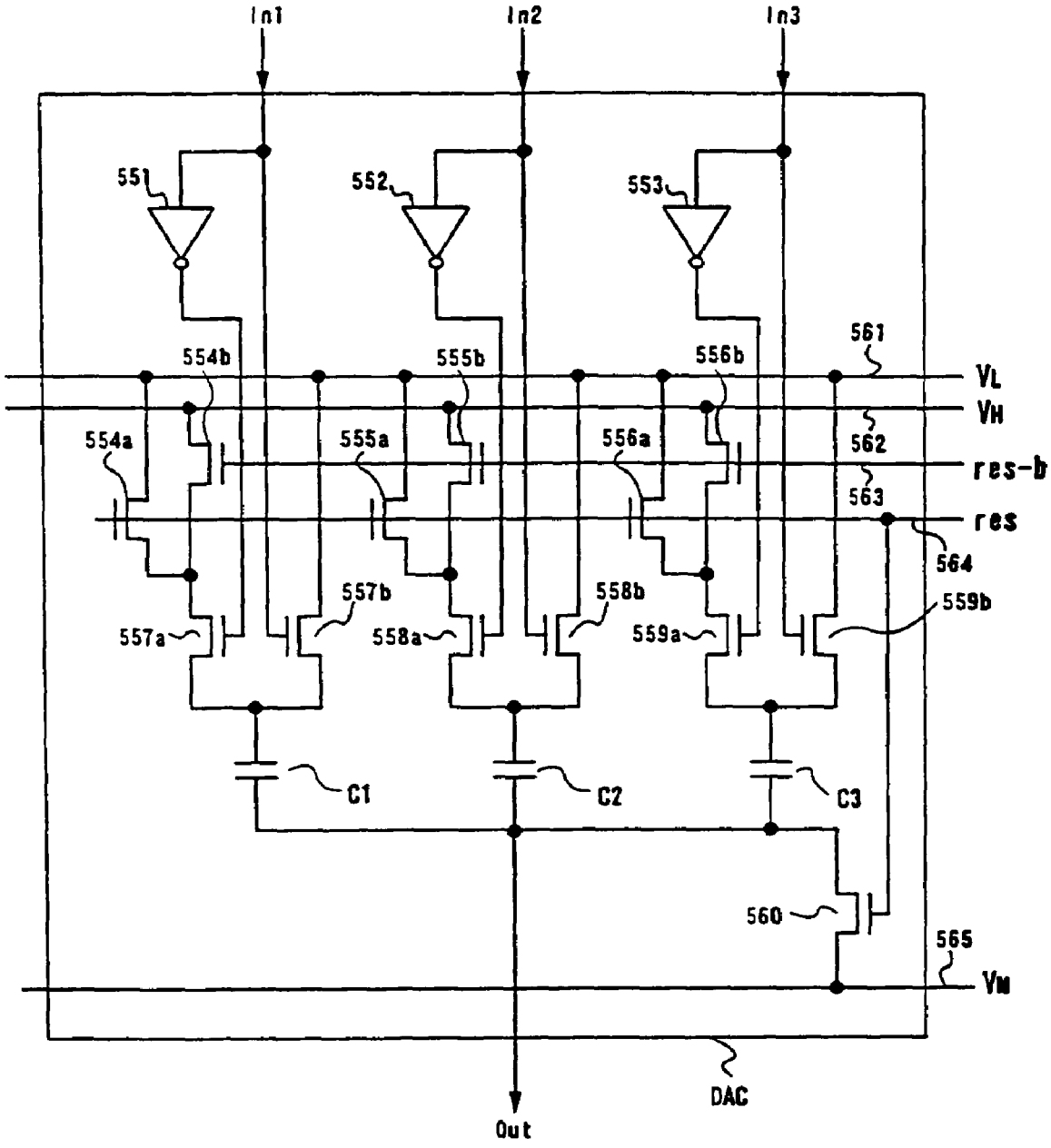
FIG. 15 is a view illustrating a configuration of a DAC of the liquid crystal display device of the present invention.

In the present example, there will be described an example of a DAC having a configuration different from that of the DAC in Examples 1 and 2, which is illustrated in FIG. 14. FIG. 15 is a circuit diagram thereof.

In FIG. 15, terminals In1 to In3 correspond to input terminals for inputting the first, second and third signals of 3-bit digital signals, respectively. A terminal Out corresponds to an output terminal for outputting signals converted to analogue signals.

In FIG. 15, the DAC is composed of inverters 551 to 553, TFTs 554*a* to 559*a*, TFT 554*b* to 559*b*, a TFT 560, condensers C1 to C3, a low-voltage side gradation power line 561, a high-voltage side gradation power line 562, an inversion reset signal line 563, a reset signal line 564, and a middle-voltage side gradation power line 565. A signal res-b on the inversion reset signal and a reset signal res have signals having polarities contrary to each other.

The TFTs 554*a* to 556*a*, the TFTs 554*b* to 556*b*, and the TFT 565 may be either n-channel type TFTs or p-channel type TFTs. It is however necessary that the TFT connected to the same reset signal line or the same inversion reset signal line has the same polarity. The TFTs 557*a* to 559*a* and the TFTs 557*b* to 559*b* may be either n-channel type TFTs or p-channel type TFTs. It is however necessary that they have the same polarity.

First, the TFT 560 turns into a conductive state by a signal res inputted to the reset signal line 564, and then the voltage, at the side connected to the terminal Out (the side being referred to as the counter electrode side hereinafter), of the condensers C1 to C3 is fixed to voltage $V_M$ of the middle-voltage side gradation power line 565. At the same time, the TFTs 554*a* to 556*a* turn into a conductive state and the TFTs 554*b* to 556*b* turn into a non-conductive state. Thus, voltage $V_L$ of the low-voltage side gradation power line 561 is applied to electrodes contrary to the terminal Out of the condensers C1 to C3. Even if digital signals are inputted to the terminals In1 to In3 at this time, no signals are written in the condensers C1 to C3.

Thereafter, the signal res on the reset signal line 564 changes so that the switch 450 turns off. As a result, the fixation of the voltage, at the side of terminal Out, of the condensers C1 to C3 is cancelled. At the same time, voltage $V_H$ of the high-voltage side gradation power line 562 is inputted, through the TFTs 554*b* to 556*b*, to the source regions or the drain regions of the TFTs 557*a* to 559*a*. On the other hand, the voltage $V_L$ of the low-voltage side gradation power line 561 is inputted to the source regions or the drain regions of the TFTs 557*b* to 559*b*.

At this time, in accordance with signals inputted to the terminals In1 to In3, the conductive states or the non-conductive states of the TFTs 557*a* to 559*a* and the TFTs 557*b* to 559*b* are selected. The voltage $V_H$ of the high-voltage side gradation power line 562 or the voltage $V_L$ of the low-voltage side gradation power line 561 is applied to the electrodes of the condensers C1 to C3.

The capacity values of the condensers C1 to C3 are set correspondingly to the respective bits.

The voltages at the counter electrode sides change by the voltages applied to the condensers C1 to C3, so that the voltage of the outputs changes. That is, analogue signals corresponding to the digital signals inputted to the terminals In1 to In3 are outputted from the terminal Out.

In the DAC having the above-mentioned configuration, various gradations can be represented by dividing a reference voltage by means of the condensers C1 to C3.

Such a capacitor-dividing type DAC is described on pages 29–32 of AMLCD99 Digest of Technical Papers.

The above has described the DAC for converting 3-bit digital signals to analogue signals. However, the above description can be applied to a DAC for converting digital signals in a different bit number to analogue signals.

As the configuration of the DAC in the display device of the present invention, a DAC having any known configuration can freely be used. There may be used, for example, a resistor-dividing type DAC, wherein a reference voltage is divided by means of resistors.

The present example may freely be combined with Example 1 or 2.

Example 4

In the present example, an example of a DAC in the manner of selecting plural gradation voltage lines will be described, referring to FIG. 16.

Figure 16:
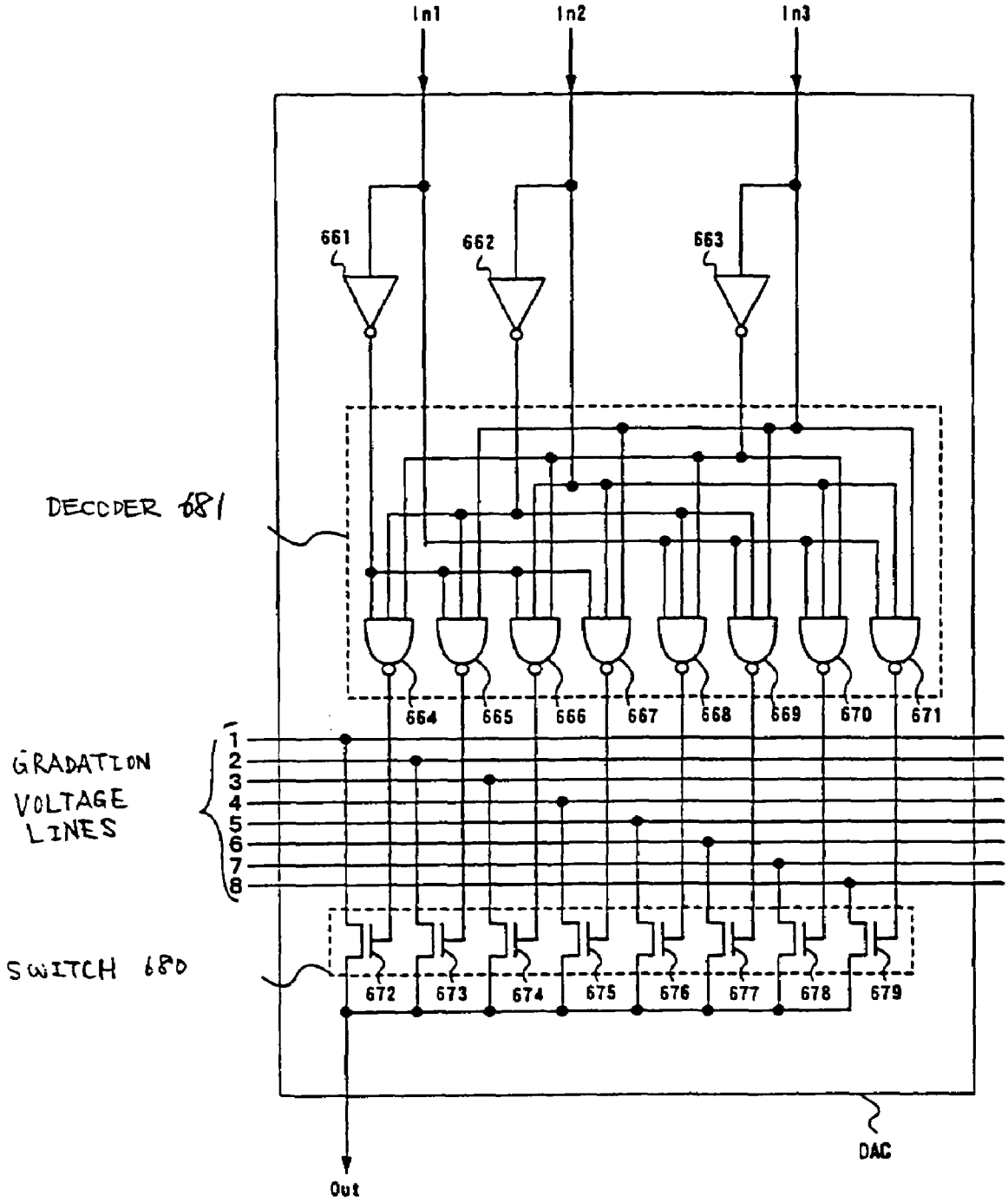
FIG. 16 is a view illustrating a configuration of a DAC of the liquid crystal display device of the present invention.

In FIG. 16, terminals In1 to In3 correspond to input terminals for inputting the first, second and third signals of 3-bit digital signals, respectively. A terminal Out corresponds to an output terminal for outputting signals converted to analogue signals.

In FIG. 16, the DAC is composed of inverters 661 to 663, NAND circuits 664 to 671, switch TFTs 672 to 679, and gradation voltage lines 1 to 8.

The switch TFTs-672 to 679 may be either p-channel type TFTs or n-channel type TFTs. It is however necessary to make the polarities of all the switch TFTs 672 to 679 equal to each other.

In the case that 3-bit digital picture signals are processed, eight gradation voltage lines are used. The switch TFTs are connected to the respective gradation voltage lines. Signals inputted from the terminal In1s to In3, which pass through a decoder 681 which is composed of the NAND circuits 664 to 671, drive the switch TFTs 672 to 679, which constitute a switch 680, selectively. In this way, one of the gradation voltage lines 1 to 8 which corresponds to the digital data inputted to the terminals In1 to In3 is selected. The voltage of the selected gradation voltage line is outputted.

A transmission gate may be used instead of the switch 680.

The above has described the DAC for converting 3-bit digital signals to analogue signals. However, the above description can be applied to a DAC for converting digital signals in a different bit number to analogue signals.

As the configuration of the DAC in the display device of the present invention, a DAC having any known configuration can freely be used.

The present example may freely be combined with Example 1 or 2.

Example 5

Figure 17:
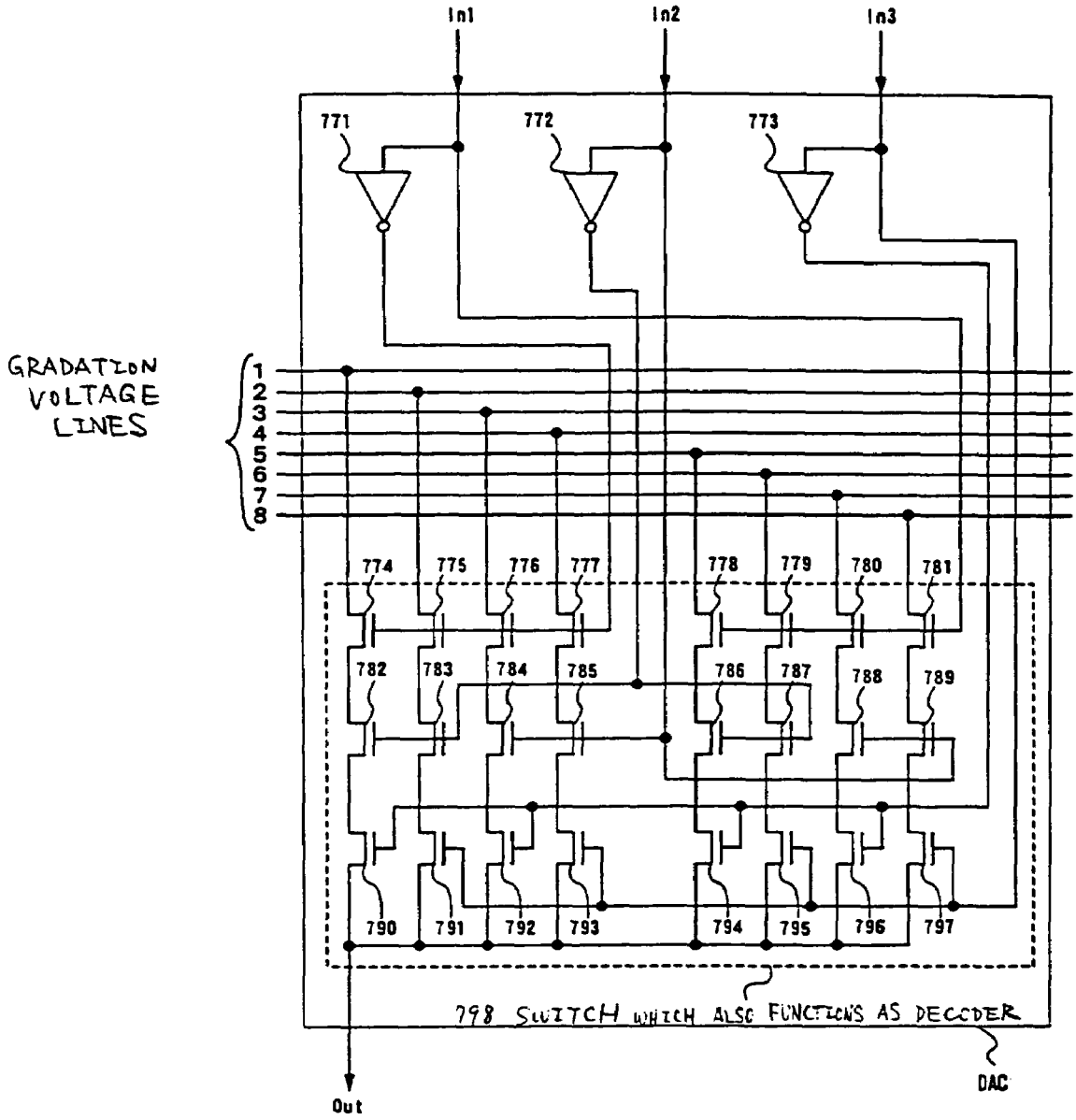
FIG. 17 is a view illustrating a configuration of a DAC of the liquid crystal display device of the present invention.

In the present example, an example using a DAC having a configuration different from that of the DAC of Example 4, which is illustrated in FIG. 16, will be described. FIG. 17 is a circuit diagram thereof.

In FIG. 17, the DAC is composed of inverters 771 to 773, TFTs 774 to 797, and gradation voltage lines 1 to 8.

The TFTs constitute a switch 798 which also functions as a decoder (the switch being referring to as the decoder/switch 798). The TFTs 774 to 797 constituting the decoder/switch 798 may be either n-channel type TFTs or p-channel type TFTs. It is however necessary to make the polarities thereof equal to each other.

In accordance with a signal inputted from the input terminal In1, In2 or In3, some line of the gradation voltage lines 1 to 8 is selected in the decoder/switch 798. The voltage of the selected gradation voltage line is outputted, as an analogue signal, to the terminal Out.

The DAC of the present example is in the manner of selecting one of gradation voltage lines, similarly to the DAC of Example 4, which is illustrated in FIG. 16. In FIG. 16, the number of the elements constituting the DAC is large. Thus, the area of the elements in the pixels is also large. In FIG. 17, switches are connected in series, and the switches also function as a decoder. As a result, the number of the elements is reduced.

The above has described the DAC for converting 3-bit digital signals to analogue signals. However, the above description can be applied to a DAC for converting digital signals in a different bit number to analogue signals.

As the configuration of the DAC in the display device of the present invention, a DAC having any known configuration can freely be used.

The present example may freely be combined with Example 1 or 2.

Example 6

In the present example, there will be described an example wherein the second latch circuit of the source signal line driving circuit is omitted by performing writing point-successively in memory circuits of a pixel section in a liquid crystal display device of the present invention.

Figure 19:
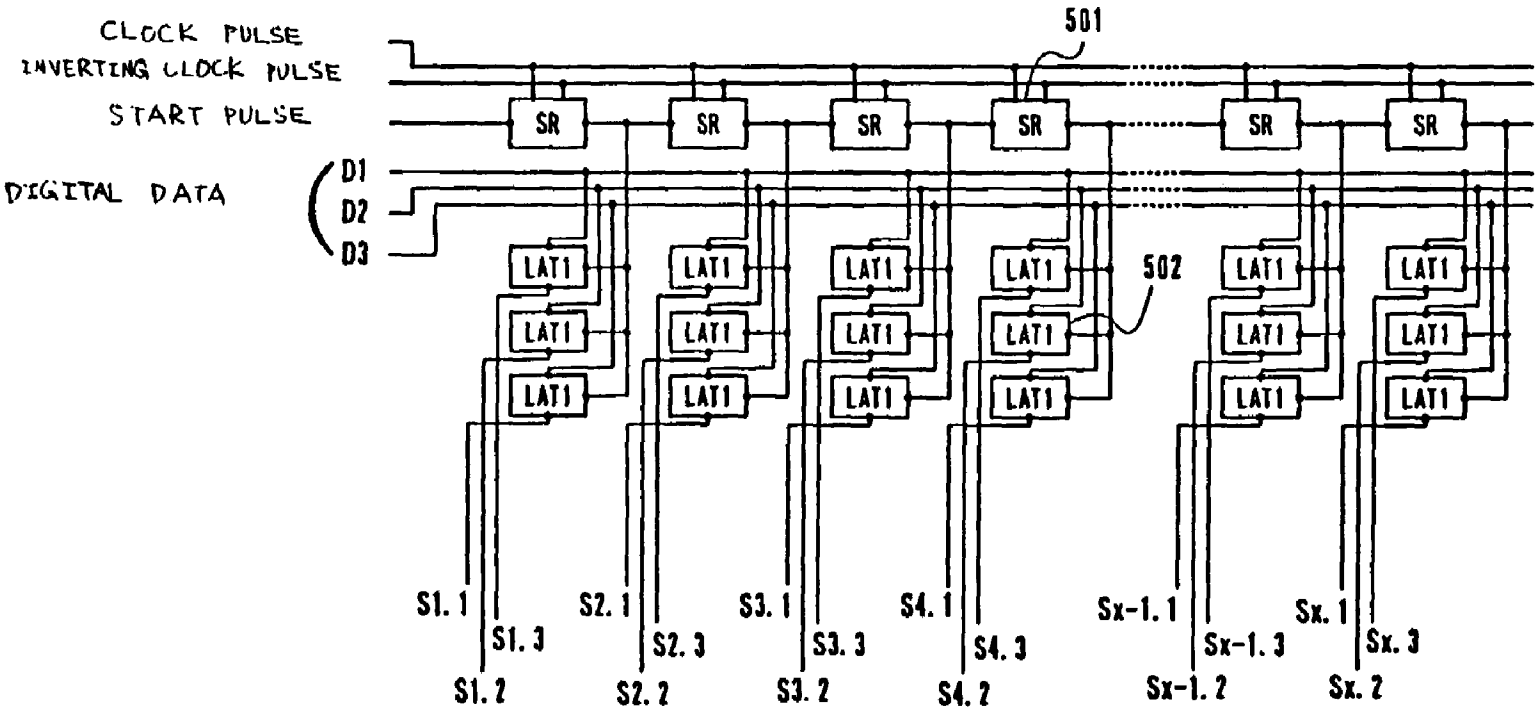
FIG. 19 is a view illustrating a configuration of a source signal line driving circuit of the liquid crystal display device of the present invention.

FIG. 19 illustrates a configuration of a source signal line driving circuit in a liquid crystal display device using pixels having memory circuits. This circuit corresponds to 3-bit digital gradation signals, and has shift registers 501 and latch circuits 502.

Figure 20:
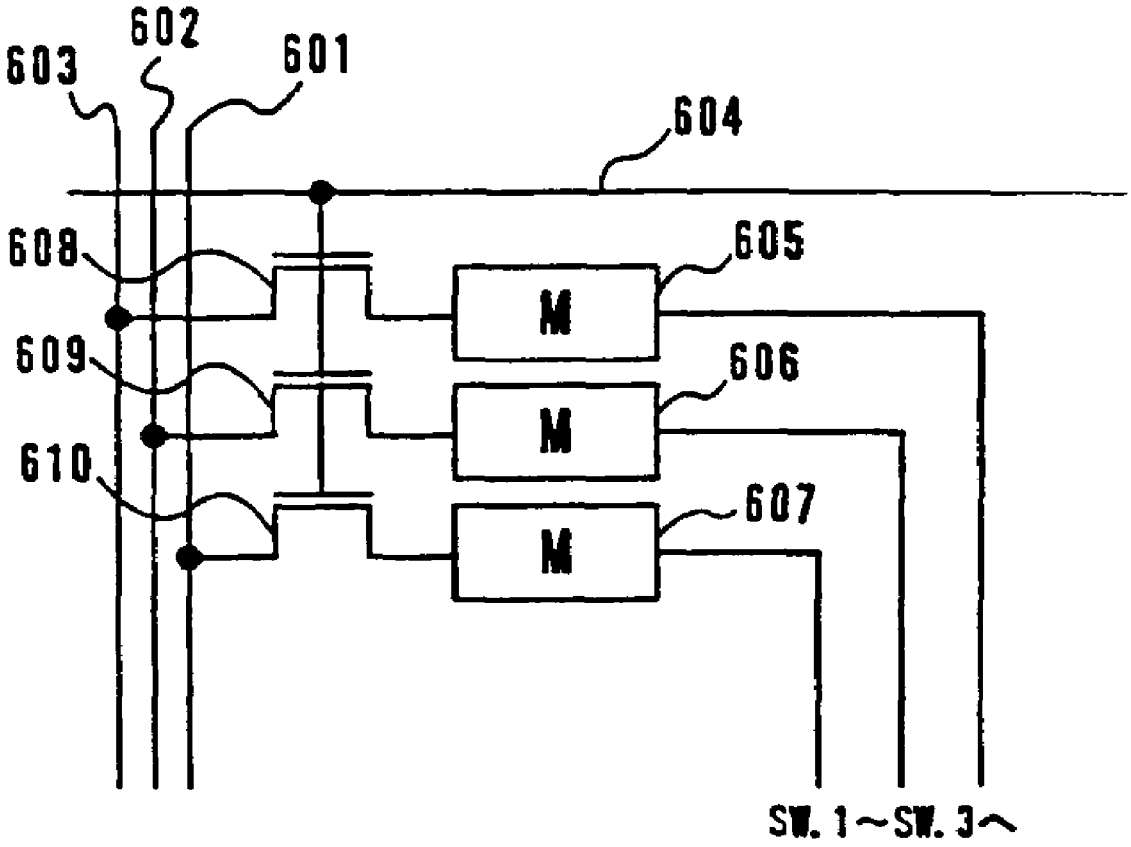
FIG. 20 is a view illustrating a configuration of a pixel of the liquid crystal display device of the present invention.

FIG. 20 is a circuit diagram of a pixel to which the following outputs are inputted: outputs to source signal lines S1.1 to Sx.1, source signal lines S1.2 to Sx.2, and source signal lines S1.3 to Sx.3 from the source signal line driving circuit illustrated in FIG. 19.

This circuit corresponds to a display device for representing gradation by 3-bit digital signals, and has memory circuits (M) 605 to 607, writing TFTs 608 to 610, and so on. Signals memorized in the memory circuits 605 to 607 are inputted to switches SW.1 to SW.3.

In FIG. 19, the three source signal lines S1.1, S1.2 and S1.3 for inputting signals to pixels on a certain line correspond to the writing source signal lines 601 to 603.

Figure 29:
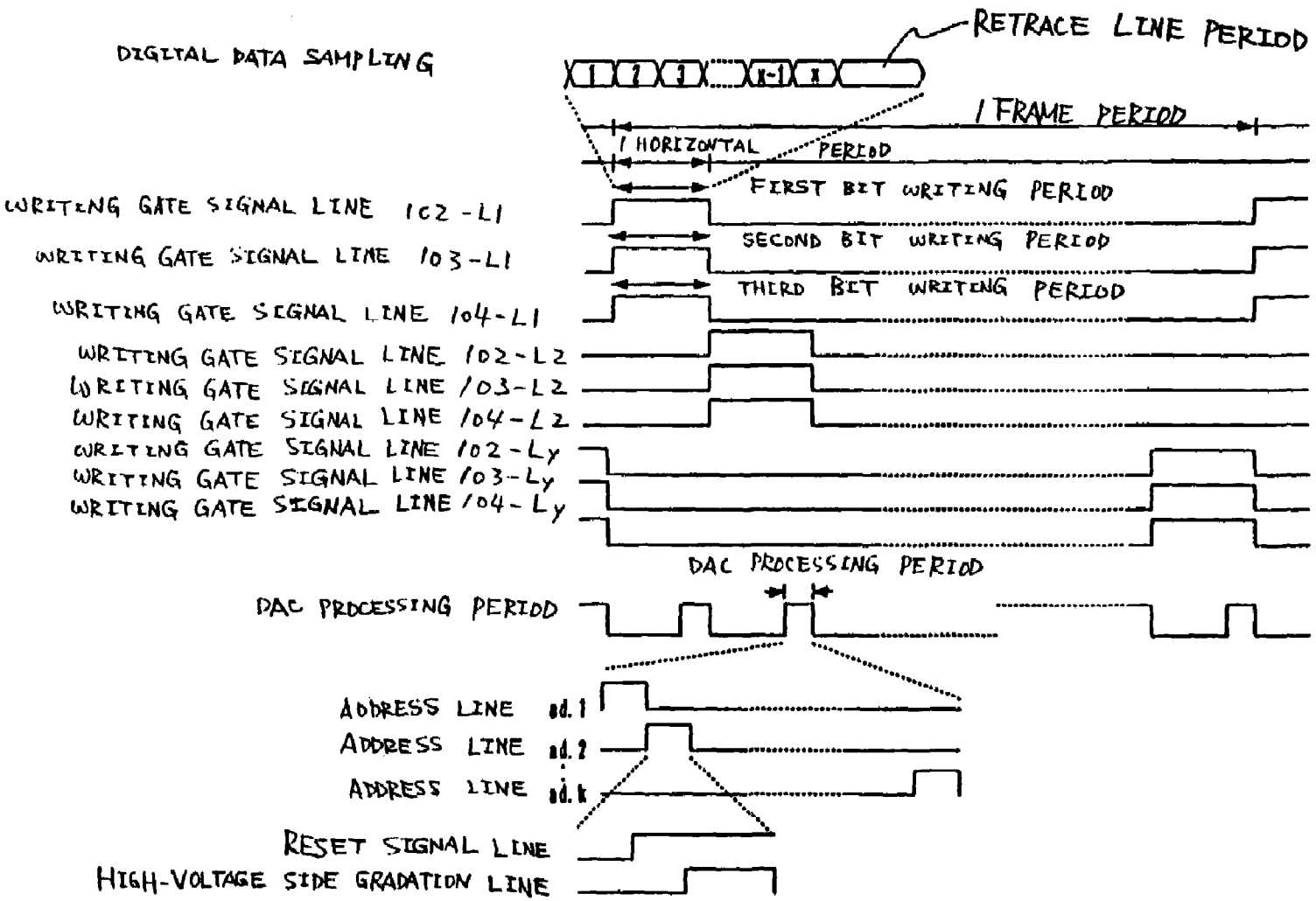
FIG. 29 is a timing chart showing a method of driving the liquid crystal display device of the present invention.

FIG. 29 is a timing chart showing the method of driving the circuit described in the present example. This method will be described, referring to FIGS. 20 and 29.

The operation which the stages from the shift register circuits 501 to the latch circuits (LAT1) 502 carry out is the same as in the above-mentioned embodiment or Example 1. Thus, the explanation thereof is omitted.

As illustrated in FIG. 29, writing in the memory circuits of the pixels is started immediately after latch operation (digital data sampling) at the first stage finishes. A pulse is inputted to a writing gate signal line 604 so that the writing TFTs 608 to 610 conduct. This results in a state that writing can be performed in the memory circuits 605 to 607. Digital picture signals in respective bits, held in the latch circuits 502, are simultaneously written via the three source signal lines 601 to 603, respectively, in FIG. 20.

When the digital picture signals held in the latch circuit at the first stage are written in the memory circuits, at the next stage the digital picture signals are held in the latch circuits in accordance with a subsequent sampling pulse. In such a way, writing is successively performed in the memory circuits.

In this way, digital picture signals corresponding to one pixel line are outputted. Thus, one horizontal term finishes. In a retrace line period during one horizontal term, a DAC processing period is set up.

The operation at the time of converting the digital signals held in the memory circuits of the respective pixels to analogue signals by the above-mentioned operation (i.e., in the DAC period) is the same as in Example 1. This operation can be understood from FIG. 29, in which the same reference numbers as in FIG. 4 are used. Therefore, the explanation thereof is omitted.

The same operation is repeated about all horizontal terms.

In this way, a display term for the first frame finishes.

Figure 12:
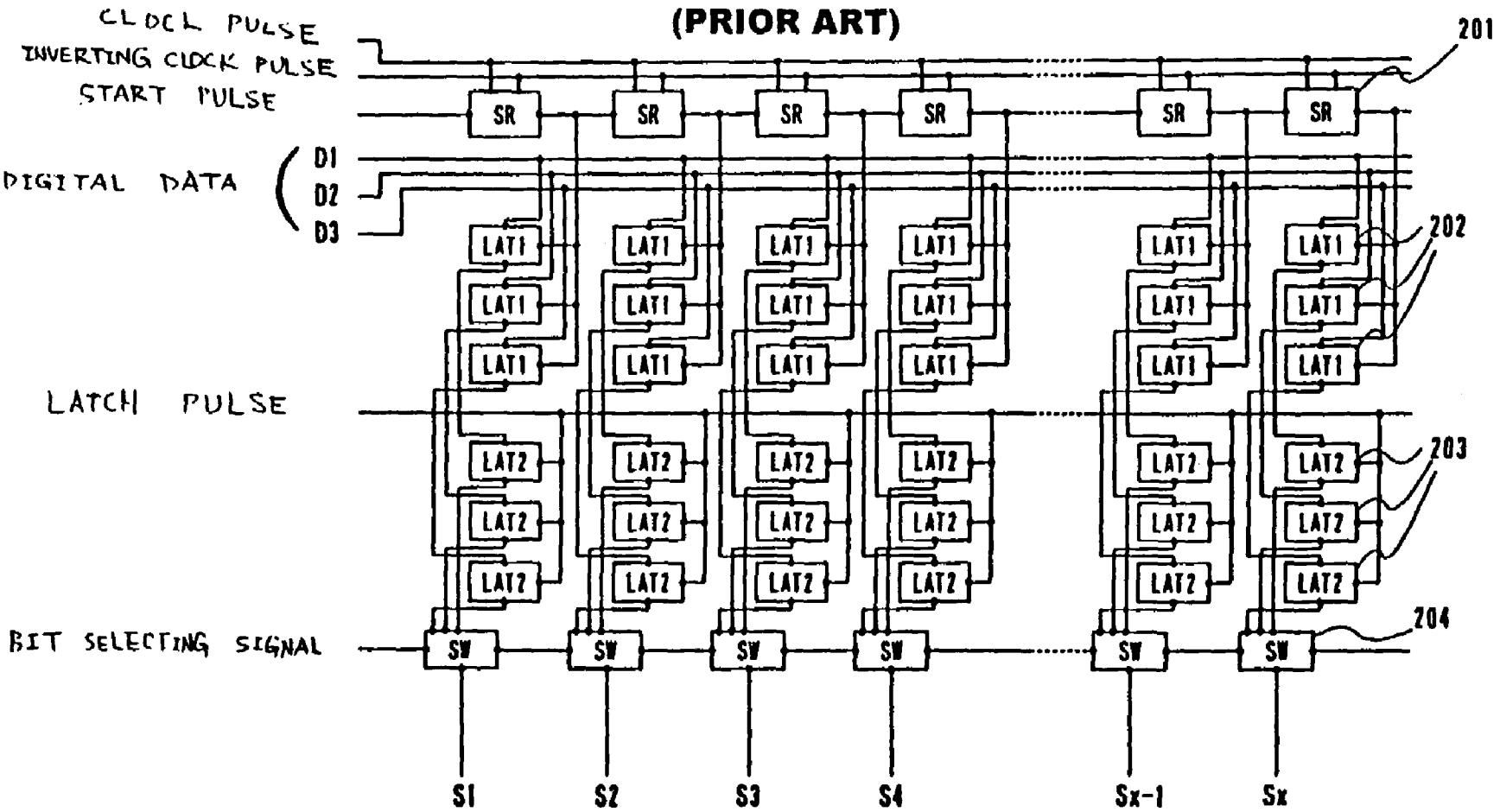
FIG.12 (PRIOR ART)
FIG. 12 is a view illustrating a configuration of a source signal line driving circuit of a liquid crystal display device.
Figure 13:
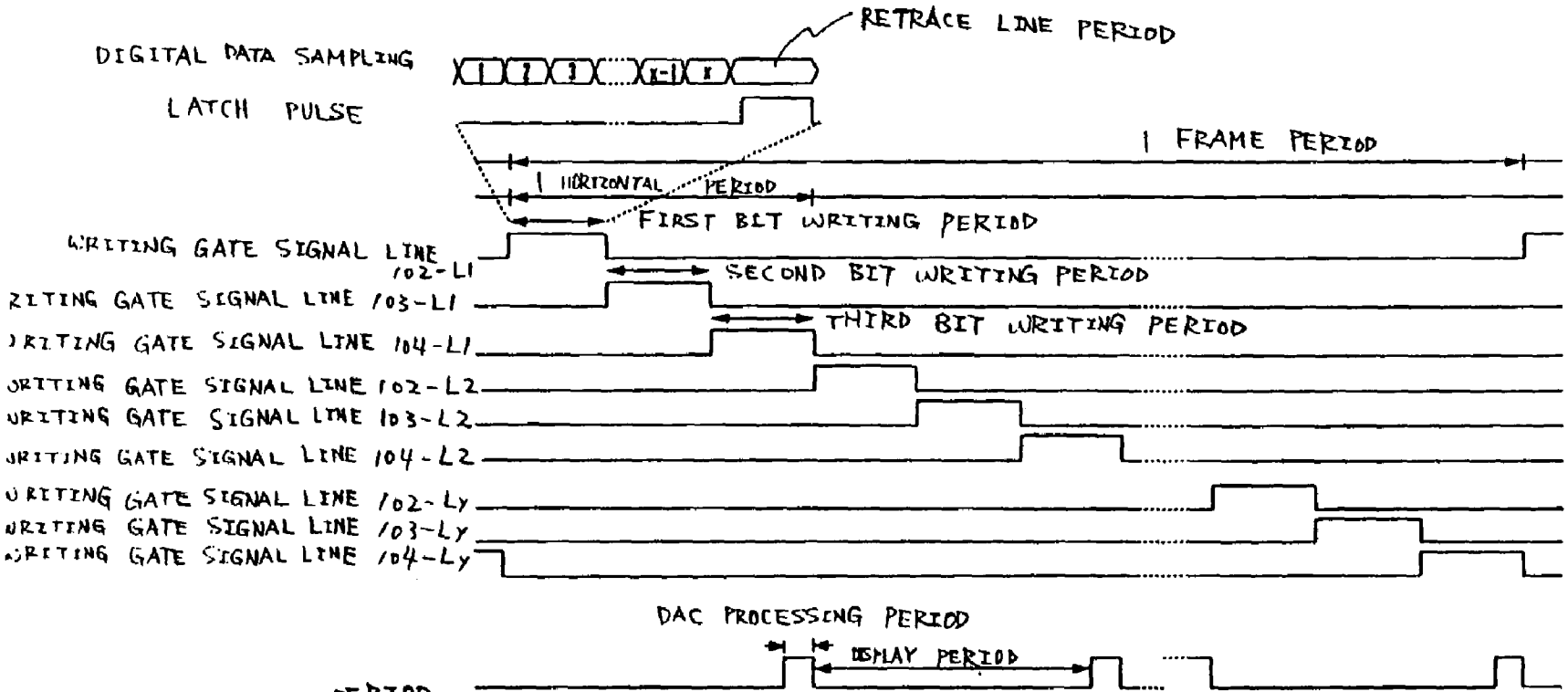
FIG. 13 (PRIOR ART)
FIG. 13 is a timing chart showing a method of driving a liquid crystal display device.

In the present circuit, the number of the latch circuits can be set to ½ of the number in the circuit illustrated in FIG. 12. Thus, the space for the arrangement of the circuits can be saved so that the whole of the device can be made small-sized.

The present example may freely be combined with one or more out of Examples 1 to 5.

Example 7

In the present example, there will be described an example wherein the circuit configuration of the liquid crystal display device which does not have the second latch circuit, described in Example 6, is used to perform writing in memory circuits in pixels by line-successive driving.

Figure 22:
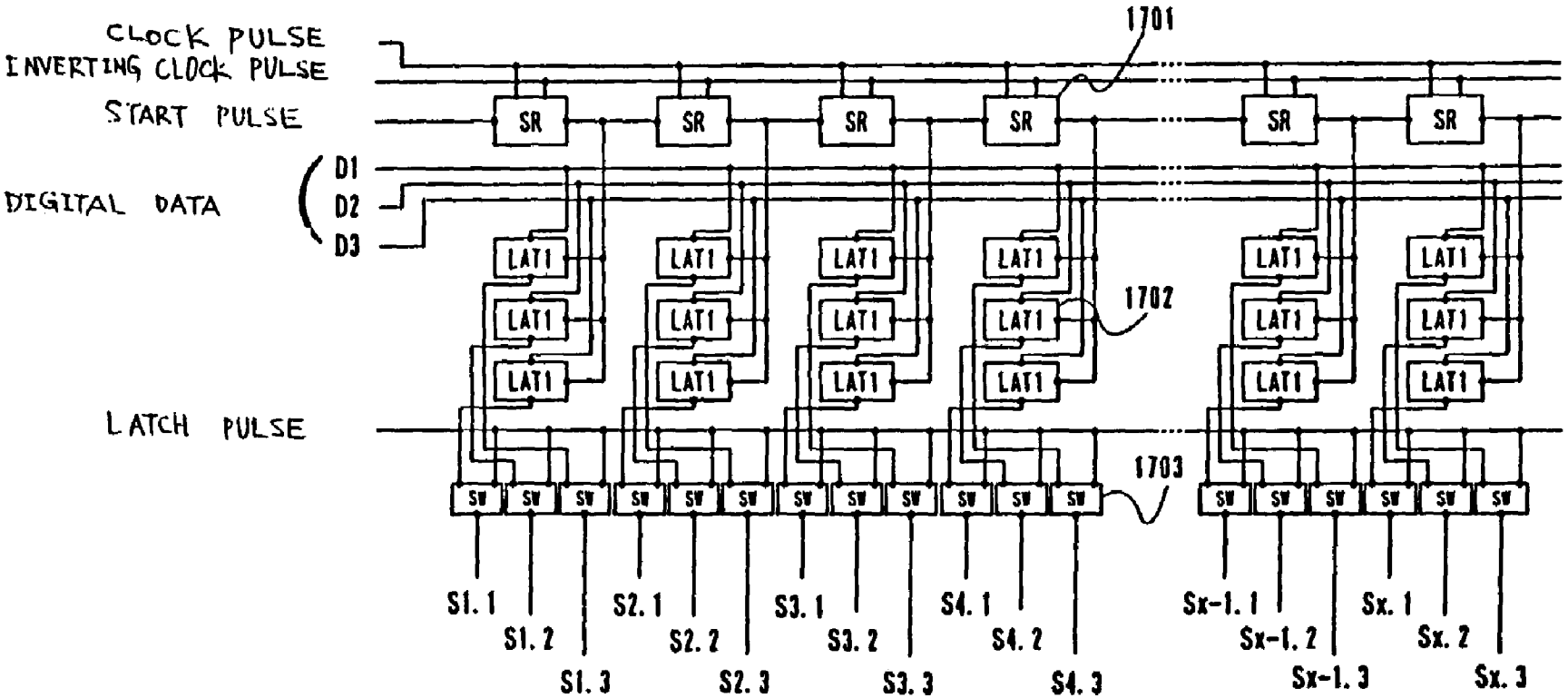
FIG. 22 is a view illustrating a configuration of a source signal line driving circuit of the liquid crystal display device of the present invention.

FIG. 22 shows an example of a source signal line driving circuit of the liquid crystal display device according to the present example. This circuit corresponds to 3-bit digital gradation signals, and has shift registers 1701, latch circuits 1702, and latch circuits 1703. Signals from this source signal line driving circuit are inputted to source signal lines S1.1 to S1.x, source signal lines S2.1 to S2.x, and source signal lines S3.1 to S3.x.

The circuit configuration of pixels may be the same as in Example 6. Therefore, FIG. 20 is referred to. In FIG. 22, the three source signal lines S1.1, S1.2 and S1.3 for inputting signals to pixels on a certain line correspond to the writing source signal lines 601 to 603, respectively, in FIG. 20.

Figure 21:
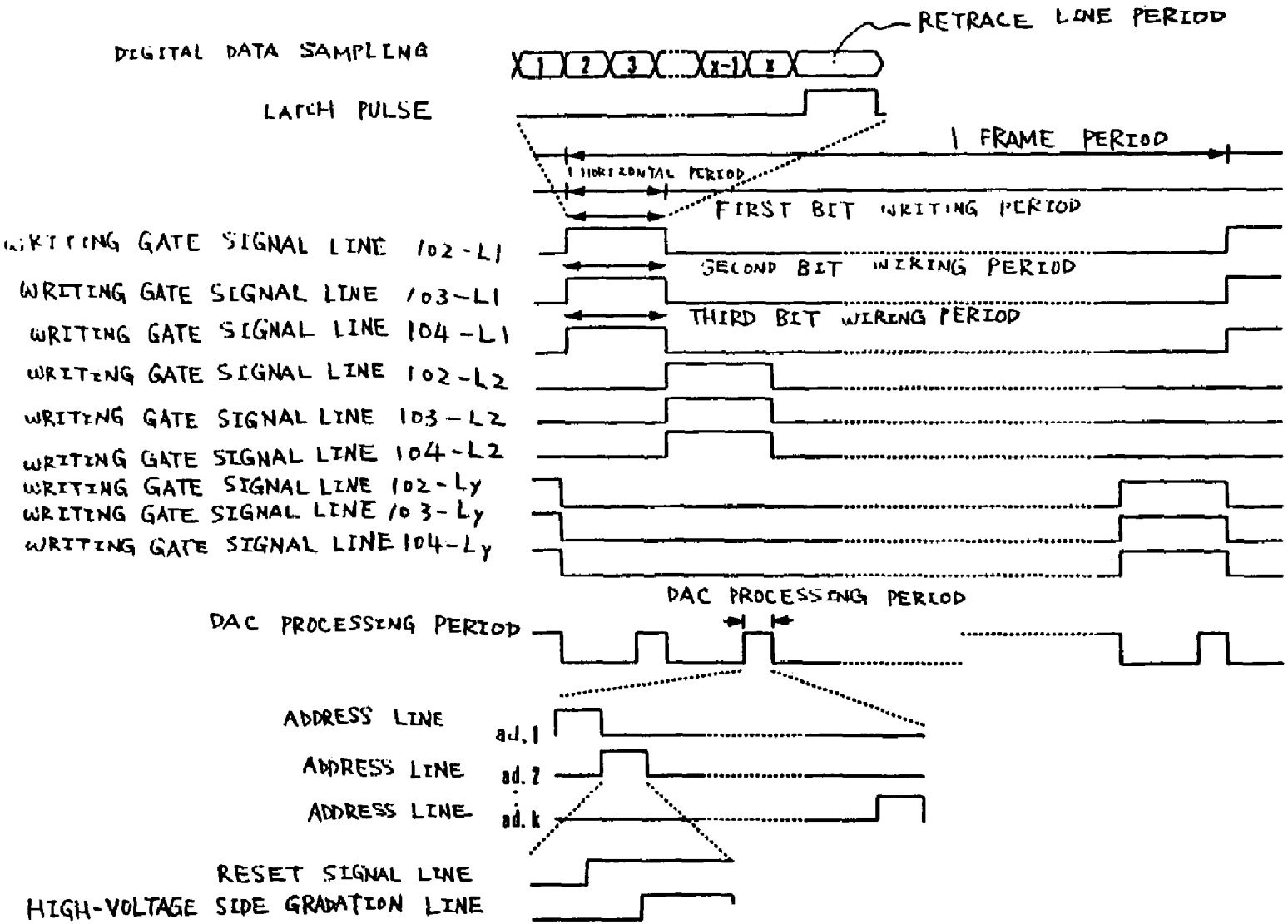
FIG. 21 is a timing chart showing a method of driving the liquid crystal display device of the present invention.

A timing chart about the method of driving the circuit described in the present example is shown in FIG. 21. This method will be described, referring to FIG. 21.

The operation from the output of sampling pulses from the shift registers 1701 to the holding of digital picture signals in the latch circuits 1702 in accordance with the sampling pulses is the same as in Example 6. The present example has the switch circuits 1703 between the latch circuits 1702 and pixels 1704; therefore, even if the holding of the digital picture signals in the latch circuits finishes, writing is not immediately started in the memory circuits of the respective pixels. The switch circuit 1703 is continuously closed until the digital sampling period finishes. During this period, the digital picture signals are continuously held in the latch circuits.

After the holding of the digital picture signals corresponding to one horizontal term finishes, a latch pulse is inputted in a subsequent retrace line period, so that all the switch circuits 1703 are opened. All the digital picture signals held in the latch circuits 1702 are outputted to the source signal lines S1.1 to S1.x, the source signal lines S2.1 to S2.x, and the source signal lines S3.1 to S3.x, and then written in the memory circuits of the respective pixels.

In the configuration of the source signal line driving circuit of the present example, digital picture signals in three bits, which correspond to one pixel line, are simultaneously inputted. In this way, writing is performed in the memory circuits of the pixels.

The operation inside the respective pixels concerned with the writing operation at this time is the same as in Example 6. The explanation thereof is omitted.

The operation at the time of converting the digital signals held in the memory circuits of the respective pixels to analogue signals (i.e., in the DAC processing period) is the same as in Example 1. This operation can be understood from FIG. 21, in which the same reference numbers as in FIG. 4 are used. Therefore, the explanation thereof is omitted.

By the above-mentioned method, line-subsequent writing driving can easily be performed in the source signal line driving circuit wherein the second latch circuit is omitted.

The present example may freely be combined with one or more out of Examples 1 to 5.

Example 8

Figure 23:
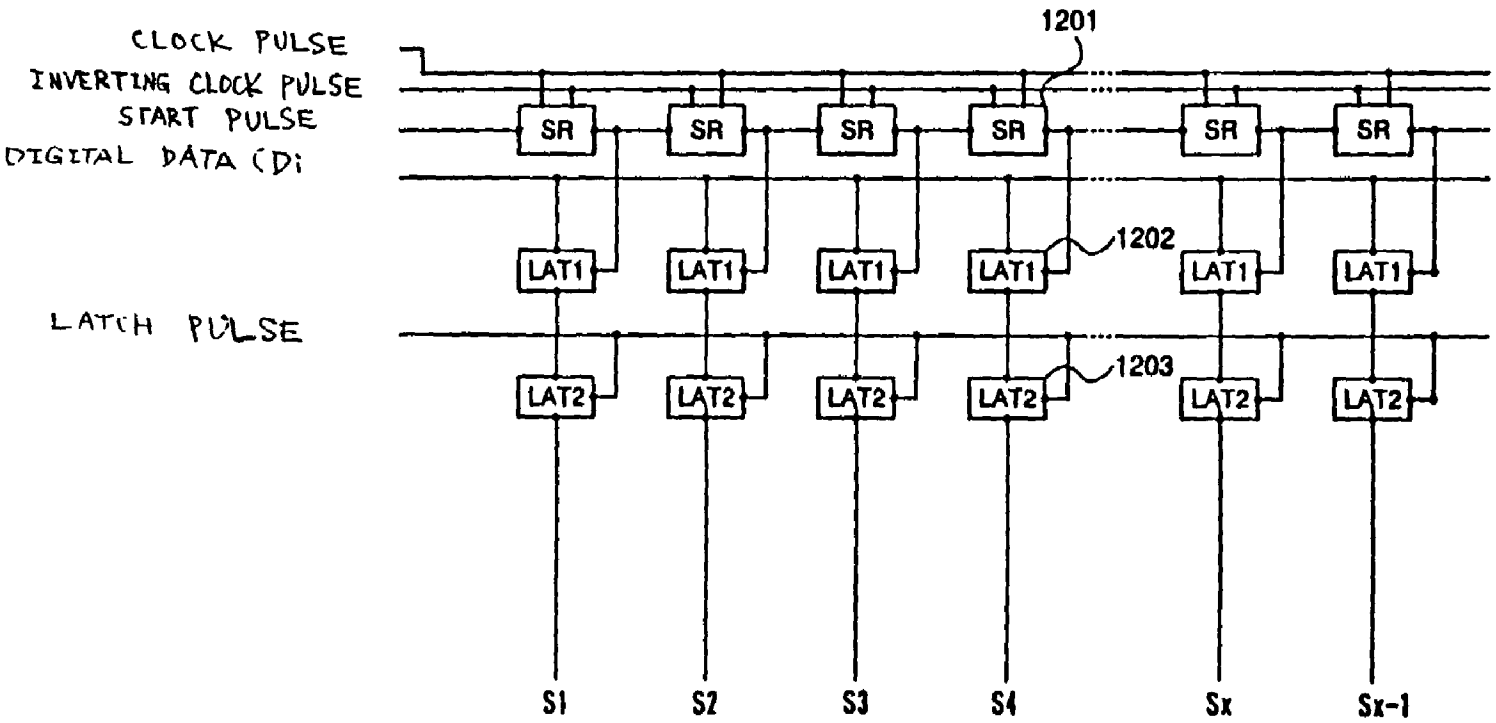
FIG. 23 is a view illustrating a configuration of a source signal line driving circuit of the liquid crystal display device of the present invention.

As illustrated in FIG. 23, the present example merely has latch circuits of a source signal line driving circuit which correspond to one bit. There will be described a manner of operating this source signal line driving circuit three times faster than the source signal line driving circuit illustrated in FIGS. 12 and so on, and inputting the first bit data, the second bit data and the third bit data successively to the source signal line driving circuit in one line period, so as to give the same effects as the source signal line driving circuit illustrated in FIG. 12.

The operation of the present example will be described, referring to the timing chart of FIG. 4 in the same way as in Example 1.

In Example 1, digital data sampling is performed only one time in one horizontal term. Thereafter, signals in the respective bits are successively outputted by bit selecting signals. In the present example, however, it is necessary to repeat the operation of digital data sampling three times in one horizontal term.

In FIG. 23, the source signal line driving circuit is composed of shift registers 1201, which are represented by "SR" in FIG. 23, first latch circuits 1202, which are represented by "LAT1", and second latch circuits 1203, which are represented by "LAT2".

By signals of a clock pulse and an inversion clock pulse inputted to the shift register, the first latch circuits (LAT1) 1202 sample digital data. The first bit signal of the digital data is held in the first latch circuits (LAT1) 1202. Thereafter, a latch pulse is inputted to transfer the first bit signal of the digital data to the second latch circuits (LAT2) 1203. In this way, the first bit signal is outputted to the source signal lines S1 to Sx. Thus, the first bit signal is memorized in the memory circuits of the respective pixels ("first bit writing period" in FIG. 4).

On the other hand, in the first latch circuits (LAT1) 1202, after the first bit signal is transferred to the second latch circuits, the sampling of the second bit signal starts. In the same way, the second bit signal is transferred to the second latch circuits by a latch pulse, so as to be outputted to the source signal lines S1 to Sx. In this way, the second bit signal is memorized in the memory circuits of the respective pixels ("second bit writing period" in FIG. 4).

On the other hand, in the first latch circuits (LAT1) 1202, after the second bit signal is transferred to the second latch circuits, the sampling of the third bit signal starts. The sampling of the third bit signal finishes and then the signal is transferred to the second latch circuits, so as to be outputted to the source signal lines S1 to Sx. In this way, the third bit signal is memorized in the memory circuits of the respective pixels ("third bit writing period" in FIG. 4).

In the above-mentioned way, one horizontal term finishes.

On the other hand, in the first latch circuits (LAT1) 1202, after the third bit signal is transferred to the second latch circuits, the sampling of the first bit signal in the next horizontal term starts.

In the DAC processing period set up during a retrace line period of the shift registers, which is a period from the finish of the third bit signal sampling to the start of the next first bit signal sampling, digital signals memorized in the memory circuits of the pixels are converted to analogue signals. The operation of this DAC processing period is the same as in Example 1. Therefore, the explanation thereof is omitted.

In this manner, it is necessary that a P/S (parallel/serial) converter circuit for converting digital data inputted to the source signal line driving circuit, in advance, to signals arranged in the order of bits, and so on are set up outside. However, the source signal line driving circuit itself can be made small.

The present example may freely be combined with Example 1 or 2.

Example 9

In the present example, there will be described a case in which rewriting of signals in each unit of gate signal lines (writing gate signals) is performed in the liquid crystal display device of the present invention.

In this case, it is desired to use an address decoder as the gate signal line driving circuit. An example thereof is illustrated in FIG. 18.

The following will describe a gate signal line driving circuit for outputting signals to pixels each of which has one writing gate signal line, as illustrated in FIG. 20. However, the present example is not limited thereto. The present example can be applied to a gate signal line driving circuit for outputting signals to pixels each of which has plural writing gate signal lines, as illustrated in FIG. 1 and so on.

Figure 18:
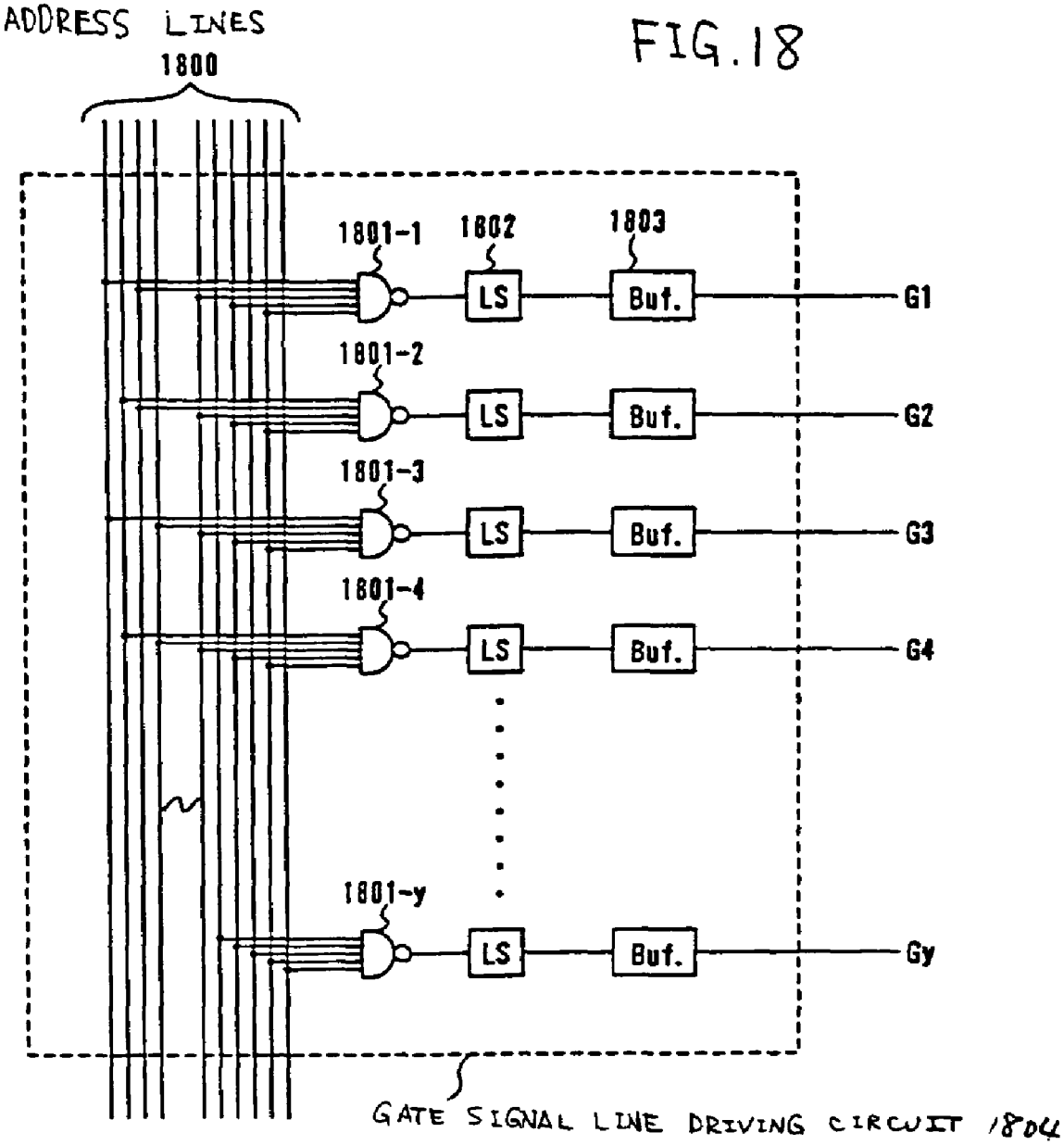
FIG. 18 is a view illustrating a configuration of a gate signal line driving circuit of the liquid crystal display device of the present invention.

In FIG. 18, a gate signal line driving circuit 1804 is composed of address lines 1800, NAND circuits 1801-1 to 1801-y, level shifters 1802, which are represented by "LS" in FIG. 18, and buffers 1803, which are represented by "Buf.", and outputs signals to gate signal lines G1 to Gy.

It is advisable to use, as the address decoder, a circuit disclosed in JP-A-8-101609 or the like circuit.

The address decoder or the like is used as a source signal line driving circuit to make partial rewriting possible in each unit of the source signal lines.

The present example may freely be combined with one or more out of Examples 1 to 8.

Example 10

In Embodiment 10, a method of simultaneously manufacturing TFTs of driving circuit portions provided in the pixel portion and the periphery thereof (a source signal line driving circuit, a gate signal line driving circuit and a DAC controller). However, in order to simplify the explanation, a CMOS circuit, which is the basic circuit for the driving circuit, is shown in the figures.

In relation to the pixel portion, the writing TFT, the source signal line and the retention capacitor (capacitor element) are only illustrated.

First, as shown in FIG. 24A, a base film 5002 made of an insulating film such as a silicon oxide film, a silicon nitride film, or a silicon nitride oxide film is formed on a substrate 5001 made of glass such as barium borosilicate glass or alumino borosilicate glass, typified by #7059 glass or #1737 glass of Corning Inc.

For example, a silicon nitride oxide film 5002*a* fabricated from $SiH_4$, $NH_3$ and $N_2O$ by a plasma CVD method is formed with a thickness of 10 to 200 nm (preferably 50 to 100 nm), and a hydrogenated silicon nitride oxide film 5002*b* similarly fabricated from $SiH_4$ and $N_2O$ is formed with a thickness of 50 to 200 nm (preferably 100 to 150 nm) to form a lamination. In Embodiment 10, although the base film 5002 is shown as the two-layer structure, the film may be formed of a single layer film of the foregoing insulating film or as a lamination structure of more than two layers.

Island-like semiconductor layers 5003 to 5006 are formed of a crystalline semiconductor film manufactured by using a laser crystallization method on a semiconductor film having an amorphous structure, or by using a known thermal crystallization method. The thickness of the island-like semiconductor films 5003 to 5006 is set from 25 to 80 nm (preferably between 30 and 60 nm). There is no limitation on the crystalline semiconductor film material, but it is preferable to form the film from a silicon or a silicon germanium (SiGe) alloy.

A laser such as a pulse oscillation type or continuous emission type excimer laser, a YAG laser, or a $YVO_4$ laser is used for manufacturing the crystalline semiconductor film in the laser crystallization method. A method of condensing laser light emitted from a laser oscillator into a linear shape by an optical system and then irradiating the light to the semiconductor film may be employed when these types of lasers are used. The crystallization conditions may be suitably selected by the operator, but the pulse oscillation frequency is set to 300 Hz, and the laser energy density is set from 100 to 400 mJ/cm$^2$ (typically between 200 and 300 mJ/cm$^2$) when using the excimer laser. Further, the second harmonic is utilized when using the YAG laser, the pulse oscillation frequency is set from 1 to 10 kHz, and the laser energy density may be set from 300 to 600 mJ/cm$^2$ (typically between 350 and 500 mJ/cm$^2$). The laser light which has been condensed into a linear shape with a width of 100 to 1000 μm, for example 400 μm, is then irradiated over the entire surface of the substrate. This is performed with an overlap ratio of 50 to 90%.

Next, a gate insulating film 5007 is formed covering the island-like semiconductor layers 5003 to 5006. The gate insulating film 5007 is formed of an insulating film containing silicon with a thickness of 40 to 150 nm by a plasma CVD method or a sputtering method. A 120 nm thick silicon nitride oxide film is formed in Embodiment 10. The gate insulating film is not limited to such a silicon nitride oxide film, of course, and other insulating films containing silicon may also be used, in a single layer or in a lamination structure. For example, when using a silicon oxide film, it can be formed by the plasma CVD method with a mixture of TEOS (tetraethyl orthosilicate) and $O_2$, at a reaction pressure of 40 Pa, with the substrate temperature set from 300 to 400° C., and by discharging at a high frequency (13.56 MHz) with electric power density of 0.5 to 0.8 W/cm$^2$. Good characteristics of the silicon oxide film thus manufactured as a gate insulating film can be obtained by subsequently performing thermal annealing at 400 to 500° C.

A first conductive film 5008 and a second conductive film 5009 are then formed on the gate insulating film 5007 in order to form gate electrodes. In Embodiment 10, the first conductive film 5008 is formed from Ta with a thickness of 50 to 100 nm, and the second conductive film 5009 is formed from W with a thickness of 100 to 300 nm.

The Ta film is formed by sputtering, and sputtering of a Ta target is performed by using Ar. If an appropriate amount of Xe or Kr is added to the Ar during sputtering, the internal stress of the Ta film will be relaxed, and film peeling can be prevented. The resistivity of an α phase Ta film is on the order of 20 μΩcm, and the Ta film can be used for the gate electrode, but the resistivity of β phase Ta film is on the order of 180 μΩcm and the Ta film is unsuitable for the gate electrode. The α phase Ta film can easily be obtained if a tantalum nitride film, which possesses a crystal structure near that of α phase Ta, is formed with a thickness of 10 to 50 nm as a base for Ta in order to form the a phase Ta film.

The W film is formed by sputtering with W as a target. The W film can also be formed by a thermal CVD method using tungsten hexafluoride ($WF_6$). Whichever is used, it is necessary to make the film low resistant in order to use it as the gate electrode, and it is preferable that the resistivity of the W film be set 20 μΩcm or less. The resistivity can be lowered by enlarging the crystals of the W film, but for cases where there are many impurity elements such as oxygen within the W film, crystallization is inhibited, and the film becomes high resistant. A W target having a purity of 99.9999% is thus used in sputtering. In addition, by forming the W film while taking sufficient care such that no impurities from the inside of the gas phase are introduced at the time of film formation, a resistivity of 9 to 20 μΩcm can be achieved.

Note that although the first conductive film 5008 and the second conductive film 5009 are formed from Ta and W, respectively, in Embodiment 10, the conductive films are not limited to these. Both the first conductive film 5008 and the second conductive film 5009 may also be formed from an element selected from the group consisting of Ta, W, Ti, Mo, Al, and Cu, or from an alloy material or a chemical compound material having one of these elements as its main constituent. Further, a semiconductor film, typically a polysilicon film, into which an impurity element such as phosphorous is doped, may also be used. Examples of preferable combinations other than that in Embodiment 10 include: the first conductive film 5008 formed from tantalum nitride (TaN) and the second conductive film 5009 formed from W; the first conductive film 5008 formed from tantalum nitride (TaN) and the second conductive film 5009 formed from Al; and the first conductive film 5008 formed from tantalum nitride (TaN) and the second conductive film 5009 formed from Cu.

Next, a mask 5010 is formed from resist, and a first etching process is performed in order to form electrodes and wirings. An ICP (inductively coupled plasma) etching method is used in Embodiment 10. A gas mixture of $CF_4$ and $Cl_2$ is used as an etching gas, and a plasma is generated by applying a 500 W RF electric power (13.56 MHz) to a coil shape electrode at 1 Pa. A 100 W RF electric power (13.56 MHz) is also applied to the substrate side (test piece stage), effectively applying a negative self-bias voltage. The W film and the Ta film are both etched on the same order when $CF_4$ and $Cl_2$ are mixed.

Edge portions of the first conductive layer and the second conductive layer are made into a tapered shape in accordance with the effect of the bias voltage applied to the substrate side with the above etching conditions by using a suitable resist mask shape. The angle of the tapered portions is from 15 to 45°. The etching time may be increased by approximately 10 to 20% in order to perform etching without any residue on the gate insulating film. The selectivity of a silicon nitride oxide film with respect to a W film is from 2 to 4 (typically 3), and therefore approximately 20 to 50 nm of the exposed surface of the silicon nitride oxide film is etched by this over-etching process. First shape conductive layers 5011 to 5016 (first conductive layers 5011*a* to 5016*a* and second conductive layers 5011*b* to 5016*b*) are thus formed of the first conductive layer and the second conductive layer by the first etching process. At this point, regions of the gate insulating film 5007 not covered by the first shape conductive layers 5011 to 5016 are made thinner by approximately 20 to 50 nm by etching. (FIG. 24B)

Then, a first doping process is performed to add an impurity element for imparting a n-type conductivity. Doping may be carried out by an ion doping method or an ion injecting method. The condition of the ion doping method is that a dosage is $1\times10^{13}$ to $5\times10^{14}$ atoms/cm$^2$, and an acceleration voltage is 60 to 100 keV. As the impurity element for imparting the n-type conductivity, an element belonging to group 15, typically phosphorus (P) or arsenic (As) is used, but phosphorus is used here. In this case, the conductive layers 5011 to 5016 become masks to the impurity element to impart the n-type conductivity, and first impurity regions 5017 to 5020 are formed in a self-aligning manner. The impurity element to impart the n-type conductivity in the concentration range of $1\times10^{20}$ to $1\times10^{21}$ atoms/cm$^3$ is added to the first impurity regions 5017 to 5020. (FIG. 24B)

Next, as shown in FIG. 24C, a second etching process is performed without removing the resist mask. The etching gas of the mixture of $CF_4$, $Cl_2$ and $O_2$ is used, and the W film is selectively etched. At this point, second shape conductive layers 5021 to 5026 (first conductive layers 5021*a* to 5026*a* and second conductive layers 5021*b* to 5026*b*) are formed by the second etching process. Regions of the gate insulating film 5007, which are not covered with the second shape conductive layers 5021 to 5026 are made thinner by about 20 to 50 nm by etching.

An etching reaction of the W film or the Ta film by the mixture gas of $CF_4$ and $Cl_2$ can be guessed from a generated radical or ion species and the vapor pressure of a reaction product. When the vapor pressures of fluoride and chloride of W and Ta are compared with each other, the vapor pressure of $WF_6$ of fluoride of W is extremely high, and other $WCl_5$, $TaF_5$, and $TaCl_5$ have almost equal vapor pressures. Thus, in the mixture gas of $CF_4$ and $Cl_2$, both the W film and the Ta film are etched. However, when a suitable amount of $O_2$ is added to this mixture gas, $CF_4$ and $O_2$ react with each other to form CO and F, and a large number of F radicals or F ions are generated. As a result, an etching rate of the W film having the high vapor pressure of fluoride is increased. On the other hand, with respect to Ta, even if F is increased, an increase of the etching rate is relatively small. Besides, since Ta is easily oxidized as compared with W, the surface of Ta is oxidized by addition of $O_2$. Since the oxide of Ta does not react with fluorine or chlorine, the etching rate of the Ta film is further decreased. Accordingly, it becomes possible to make a difference between the etching rates of the W film and the Ta film, and it becomes possible to make the etching rate of the W film higher than that of the Ta film.

Then, as shown in FIG. 25A, a second doping process is performed. In this case, a dosage is made lower than that of the first doping process and under the condition of a high acceleration voltage, an impurity element for imparting the n-type conductivity is doped. For example, the process is carried out with an acceleration voltage set to 70 to 120 keV and at a dosage of $1\times10^{13}$ atoms/cm$^2$, so that new impurity regions are formed inside of the first impurity regions formed into the island-like semiconductor layers in FIG. 24B. Doping is carried out such that the second shape conductive layers 5021 to 5026 are used as masks to the impurity element and the impurity element is added also to the regions under the first conductive layers 5021*a* to 5026*a*. In this way, second impurity regions 5027 to 5031 are formed. The concentration of phosphorous (P) added to the second impurity regions 5027 to 5031 has a gentle concentration gradient in accordance with the thickness of tapered portions of the first conductive layers 5021*a* to 5026*a*. Note that in the semiconductor layer that overlap with the tapered portions of the first conductive layers 5021*a* to 5026*a*, the concentration of impurity element slightly falls from the end portions of the tapered portions of the first conductive layers 5021*a* to 5026*a* toward the inner portions, but the concentration keeps almost the same level.

As shown in FIG. 25B, a third etching process is performed. This is performed by using a reactive ion etching method (RIE method) with an etching gas of $CHF_3$. The tapered portions of the first conductive layers 5021*a* to 5026*a* are partially etched, and the region in which the first conductive layers overlap with the semiconductor layer is reduced by the third etching process. Third shape conductive layers 5032 to 5037 (first conductive layers 5032*a* to 5037*a* and second conductive layers 5032*b* to 5037*b*) are formed. At this point, regions of the gate insulating film 5007, which are not covered with the third shape conductive layers 5032 to 5037 are made thinner by about 20 to 50 nm by etching.

By the third etching process, in the case of second impurity regions 5027 to 5031, second impurity regions 5027*a* to 5031*a* which overlap with the first conductive layers 5032*a* to 5037*a*, and third impurity regions 5027*b* to 5231*b* between the first impurity regions and the second impurity regions.

Then, as shown in FIG. 25C, fourth impurity regions 5039 to 5044 having a conductivity type opposite to the first conductivity type are formed in the island-like semiconductor layers 5004 forming p-channel TFTs. The third conductive layers 5033*b* are used as masks to an impurity element, and the impurity regions are formed in a self-aligning manner. At this time, the whole surfaces of the island-like semiconductor layers 5003, 5005, the retention capacitor portion 5006 forming the capacitor element and the wiring portion 5034 forming the wiring, which form n-channel TFTs are covered with a resist mask 5038. Phosphorus is added to the impurity regions 5039 to 5044 at different concentrations, respectively. The regions are formed by an ion doping method using diborane ($B_2H_6$) and the impurity concentration is made $2\times10^{20}$ to $2\times10^{21}$ atoms/cm$^3$ in any of the regions.

By the steps up to this, the impurity regions are formed in the respective island-like semiconductor layers. The third shape conductive layers 5032, 5033, 5035, and 5036 overlapping with the island-like semiconductor layers function as gate electrodes. The numeral 5034 functions as an island-like source signal line. The numeral 5037 functions as a capacitor wiring.

After the resist mask 5038 is removed, a step of activating the impurity elements added in the respective island-like semiconductor layers for the purpose of controlling the conductivity type. This step is carried out by a thermal annealing method using a furnace annealing oven. In addition, a laser annealing method or a rapid thermal annealing method (RTA method) can be applied. The thermal annealing method is performed in a nitrogen atmosphere having an oxygen concentration of 1 ppm or less, preferably 0.1 ppm or less and at 400 to 700° C., typically 500 to 600° C. In Embodiment 4, a heat treatment is conducted at 500° C. for 4 hours. However, in the case where a wiring material used for the third conductive layers 5037 to 5042 is weak to heat, it is preferable that the activation is performed after an interlayer insulating film (containing silicon as its main ingredient) is formed to protect the wiring line or the like.

Further, a heat treatment at 300 to 450° C. for 1 to 12 hours is conducted in an atmosphere containing hydrogen of 3 to 100%, and a step of hydrogenating the island-like semiconductor layers is conducted. This step is a step of terminating dangling bonds in the semiconductor layer by thermally excited hydrogen. As another means for hydrogenation, plasma hydrogenation (using hydrogen excited by plasma) may be carried out.

Figures 26A, 26B:
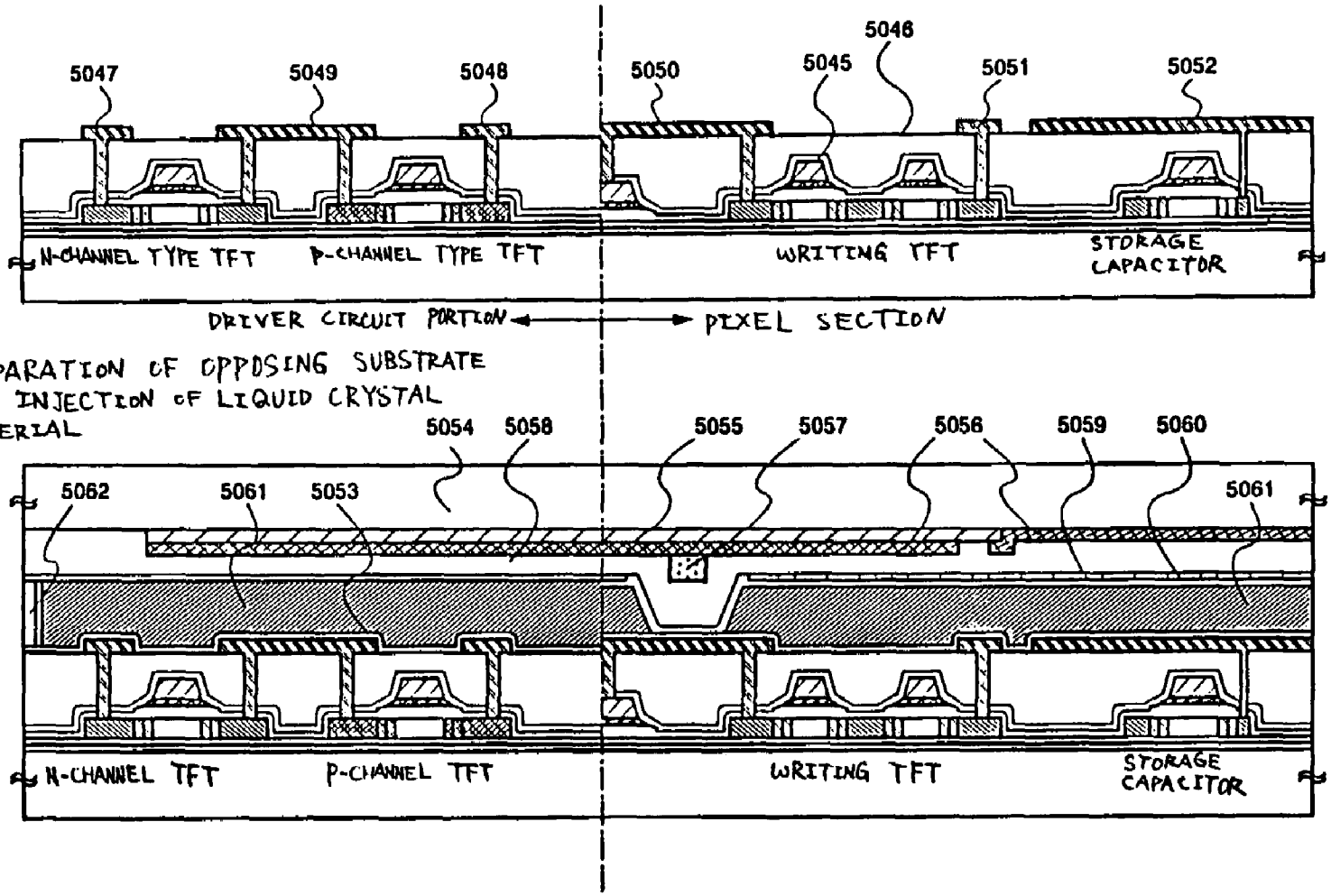
FIGS. 26A and 26B are views illustrating a process for producing the liquid crystal display device of the present invention.

Next, as shown in FIG. 26A, a first interlayer insulating film 5045 of a silicon oxynitride film is formed with a thickness of 100 to 200 nm. Then, a second interlayer insulating film 5046 of an organic insulating material is formed thereon. After that, etching is carried out to form contact holes.

Then, in the driving circuit portion, source wirings 5047 and 5048 for contacting the source regions of the island-like semiconductor layers, and a drain wiring 5049 for contacting the drain regions of the island-like semiconductor layers are formed. In the pixel portion, a connecting electrode 5050 and pixel electrodes 5051 and 5052 are formed (FIG. 26A). The connecting electrode 5050 allows electric connection between the source signal line 5034 and writing TFTs.

In this embodiment, though the writing TFT is shown as a double gate structure, a single gate structure, a triple gate structure or even a multi gate structure can also be used.

As described above, the driving circuit portion having the n-channel type TFT and the p-channel type TFT and the pixel portion having the writing TFT and the storage capacitor (capacitor element) can be formed on one substrate. Such a substrate is referred to as an active matrix substrate in this specification.

In this embodiment, end portions of the pixel electrodes are arranged so as to overlap source signal lines and writing gate signal lines for the purpose of shielding from light, spaces between the pixel electrodes without using a black matrix.

Further, according to the process described in this embodiment, the number of photomasks necessary for manufacturing an active matrix substrate can be set to five (a pattern for the island-like semiconductor layers, a pattern for the first wirings (source signal lines and capacitor wirings), a mask pattern for the p-channel regions, a pattern for the contact holes, and a pattern for the second wirings (including the pixel electrodes and the connecting electrodes)). As a result, the process can be made shorter, the manufacturing cost can be lowered, and the yield can be improved.

Next, after the active matrix substrate as illustrated in FIG. 26B is obtained, an orientation film 5053 is formed on the active matrix substrate and a rubbing treatment is carried out.

Meanwhile, an opposing substrate 5054 is prepared. Color filter layers 5055 to 5057 and an overcoat layer 5058 are formed on the opposing substrate 5054. The color filter layers are structured such that the red color filter layer 5055 and the blue color filter layer 5056 overlap over the TFTs so as to serve also as a light-shielding film. Since it is necessary to shield from light at least spaces among the TFTs, the connecting electrodes, and the pixel electrodes, it is preferable that the red color filter and the blue color filter are arranged so as to overlap such that these places are shielded from light.

The red color filter layer 5055, the blue color filter layer 5056, and the green color filter layer 5057 are overlapped so as to align with the connecting electrode 5050 to form a spacer. The respective color filters are formed by mixing appropriate pigments in an acrylic resin and are formed with a thickness of 1 to 3 μm. These color filters can be formed from a photosensitive material in a predetermined pattern using a mask. Taking into consideration the thickness of the overcoat layer 5058 of 1 to 4 μm, the height of the spacer can be made to be 2 to 7 μm, preferably 4 to 6 μm. This height forms a gap when the active matrix substrate and the opposing substrate are adhered to each other. The overcoat layer 5058 is formed of a photosetting or thermosetting organic resin material such as a polyimide resin or an acrylic resin.

The arrangement of the spacer may be arbitrarily determined. For example, as illustrated in FIG. 26B, the spacer may be arranged on the opposing substrate 5054 so as to align with the connecting electrode 5050. Or, the spacer may be arranged on the opposing substrate 5054 so as to align with a TFT of the driving circuit portion. Such spacers may be arranged over the whole surface of the driving circuit portion, or may be arranged so as to cover the source wirings and the drain wirings.

After the overcoat layer 5058 is formed, an opposing electrode 5059 is patterned to be formed, an orientation film 5060 is formed, and a rubbing treatment is carried out.

Then, the active matrix substrate having the pixel portion and the driving circuit portion formed thereon is adhered to the opposing substrate using a sealant 5062. Filler is mixed in the sealant 5062. The filler and the spacers help the two substrates to be adhered to each other with a constant gap therebetween. After that, a liquid crystal material 5061 is injected between the substrates, and encapsulant (not shown) carries out full encapsulation. As the liquid crystal material 5061, a known liquid crystal material may be used. In this way, an active matrix liquid crystal display device as illustrated in FIG. 26B is completed.

It is to be noted that, though the TFTs in the active matrix type display device formed in the above processes are of a top-gate structure, this embodiment may be easily applied to TFTs of a bottom-gate structure and of other structures.

Further, the glass substrate is used in this embodiment, but it is not limited. Other than glass substrate, such as the plastic substrate, the stainless substrate and the single crystalline wafers can be used to implement.

This embodiment can be freely combined to execute with Embodiments 1 to 9.

Example 11

Since the liquid crystal display device of the present invention has plural memory circuits in its pixel section, the number of elements constituting each pixel is larger than the number of elements constituting each of ordinary pixels. Thus, in the case of a transmission type liquid crystal display device, the brightness thereof may be insufficient because of a drop in the numerical aperture thereof. It is therefore desired that the present invention is applied to a reflection type liquid crystal display device. In the present example, an example of the process for producing the display device will be described.

Figures 27A, 27B:
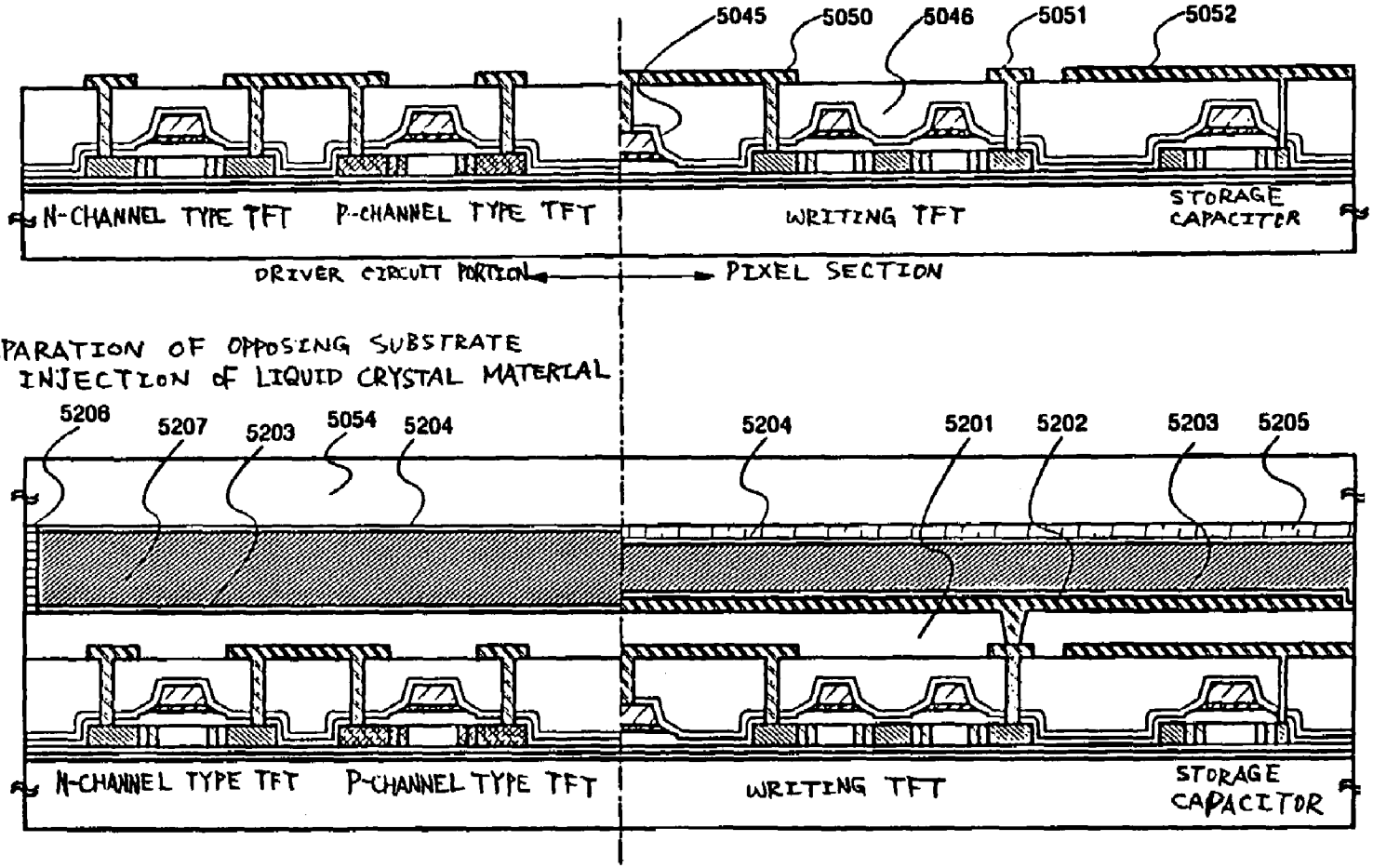
FIGS. 27A and 27B are views illustrating a process for producing the liquid crystal display device of the present invention.

In accordance with Example 9, an active matrix substrate illustrated in FIG. 27A, which is the same as in FIG. 26A, is produced. However, reference numbers 5051 and 5052 do not represent pixel-electrodes.

Subsequently, a resin film is formed as the third interlayer dielectric 5201, and then contact holes reaching the pixel electrode 5051 are made. In this way, a reflection electrode (corresponding to a pixel electrode) 5202 is formed to be electrically connected to the electrode 5051. It is desired to use, for the reflection electrode 5202, a material having superior reflectivity, for example, a film made mainly of Al or Ag, or a lamination made of such films.

A counter substrate 5054 is separately prepared. A counter electrode 5205 is formed on the counter substrate 5054. A transparent conductive film is used to form this counter electrode 5205. For the transparent conductive film, there may be a material made of a compound of indium oxide and tin oxide, which is called ITO, or a material made of a compound of indium oxide and zinc oxide.

When a color liquid crystal display device is produced, color filter layers, which are not illustrated, are formed. At this time, it is preferred to form adjacent color filter layers having different colors to overlap with each other, whereby the overlapping layers also function as a shading film for TFT parts.

Thereafter, oriented films 5203 and 5204 are formed on the active matrix substrate 5001 and the counter substrate 5054, and then the workpieces are subjected to raving treatment.

The counter substrate 5054 and the active matrix substrate 5001, on which the pixel section and the driving circuit section are formed, are attached to each other with a sealing agent 5206. A filler is incorporated in the sealing agent 5206. By means of this filler and a spacer, the two substrates are attached to each other so as to have a uniform interval. Thereafter, a liquid crystal material 5207 is injected between the two substrates, and then the resultant gap is sealed with a sealant (not illustrated). The liquid crystal material 5207 may be a known liquid crystal material. In this way, a reflection type liquid crystal display device illustrated in FIG. 27B is produced.

In the present example, it is allowable to use other than the glass substrate, for example, a plastic substrate, a stainless substrate, or a monocrystal wafer.

The present invention can easily be applied to the case in which a semi-transmission type display device, wherein one half of pixels are composed of reflection electrodes and the other half thereof are composed of transparent electrodes, is produced.

The present example may freely be combined with one or more out of Examples 1 to 9.

Example 12

In the present example, an example wherein the present invention is applied to a semi-transmission type liquid crystal display device will be described.

Figure 32:
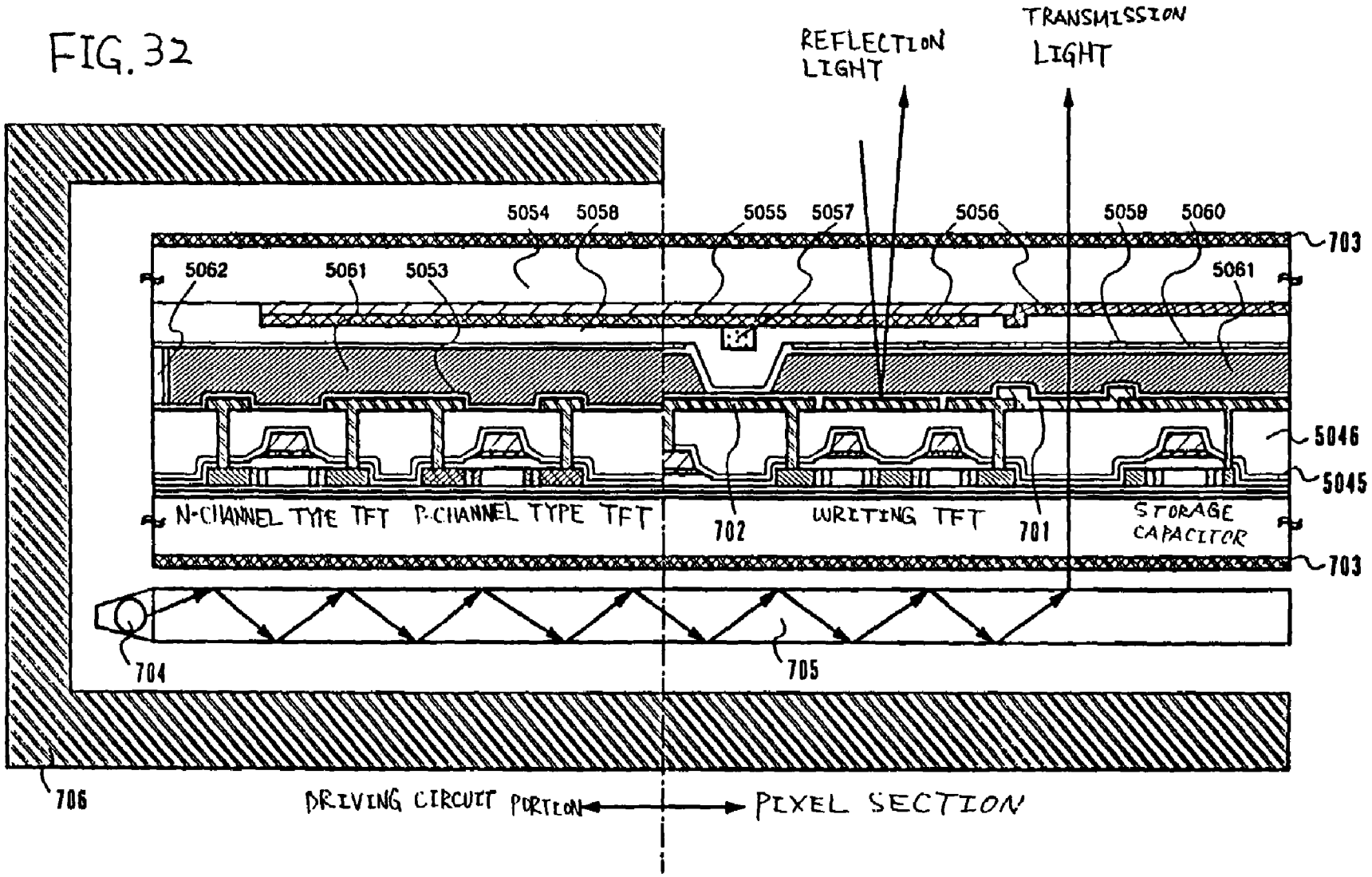
FIG. 32 is a sectional view illustrating a configuration of the liquid crystal display device.

In the semi-transmission type liquid crystal display device, its pixel electrodes are made of both of a conductive film having transparency and a metal material having reflectivity. An example of the semi-transmission type liquid crystal is illustrated in FIG. 32.

In accordance with Example 10, an active matrix substrate, the first interlayer dielectric 5045 and the second interlayer dielectric 5046 are formed.

The metal material having reflectivity is used in a pixel section, to form pixel electrodes (reflection portions) 702. The pixel electrodes (reflection portions) 702 contact source regions and drain regions of TFTs through contact holes made in a gate insulating film 5007, the first interlayer dielectric 5045 and the second interlayer dielectric 5046.

Next, the conductive film having transparency is used to form pixel electrodes (transmission portions) 701. The material of the conductive film having transparency may be ITO (alloy of indium oxide and tin oxide), alloy of indium oxide and zinc oxide, zinc oxide, or the like. The pixel electrodes (transmission portions) 701 are formed to overlap partially with the pixel electrodes (reflection portions) 702.

Next, an oriented film 5053 is formed. Subsequently, the workpiece is subjected to rubbing treatment.

Subsequent steps are the same as in Example 10. In this way, a liquid crystal material is injected and sealing with a sealant is performed.

Actually, polarizing plates 703, a backlight 704, and a light guide plate 705 are fitted to the workpiece. The workpiece is then covered with a cover 706, to complete an active matrix type liquid crystal display device as illustrated in FIG. 32.

Since the liquid crystal display device described in the present example is a semi-transmission type, the polarizing plates 703 are attached to both the substrate 5001 and the counter substrate 5054.

In the case that external light is sufficient, the display device of the present invention is driven as a reflection type. For the purpose thereof, the liquid crystal between the counter electrodes 5059 set up on the counter substrate 5054 and the pixel electrodes (reflection portions) 702 is controlled while the backlight 704 is in an off-state, thereby performing display. On the other hand, in the case that external light is insufficient, the display device of the present invention is driven as a transmission type. For the purpose thereof, the liquid crystal between the counter electrodes 5059 set up on the counter substrate 5054 and the pixel electrodes (transmission portions) 701 is controlled while the backlight 704 is in an on-state, thereby performing display.

In the case that the used liquid crystal is TN liquid crystal or STN liquid crystal, the twist angle of the liquid crystal changes dependently on the reflection type or the transmission type. Therefore, it is necessary to optimize the polarizing plate or a phase-difference plate. For example, it is necessary to separately set up an optical-rotation compensation mechanism (for example, a polarizing plate using a polymer liquid crystal) for adjusting the twist angle of the liquid crystal.

The description on the present example has been concerned with the semi-transmission type liquid crystal display device. However, if all pixel electrodes are made of a transparent conductive film, a transmission type liquid crystal display device can be produced. If pixel electrodes are made of a conductive film having a high reflectivity, a reflection type liquid crystal display device can be produced.

The present example may freely be combined with one or more out of Examples 1 to 9.

Example 13

In the present example, there will be described a configuration example of a memory circuit which a pixel of the liquid crystal display device of the present invention has.

Figure 28A:
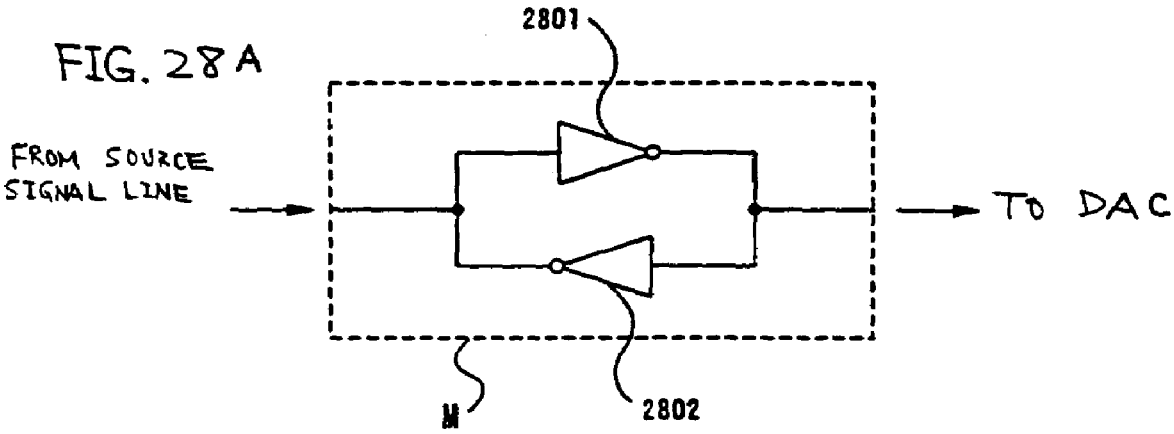
FIGS. 28A and 28B are views illustrating a configuration of a memory circuit of the liquid crystal display device of the present invention.

FIG. 28A illustrates an example of the memory circuit. A part M represented by a dotted line frame is the memory circuit. The memory circuit M is composed of two inverters 2801 and 2802. This memory circuit is a static random access memory (SRAM) using a flip-flop.

Figure 28B:
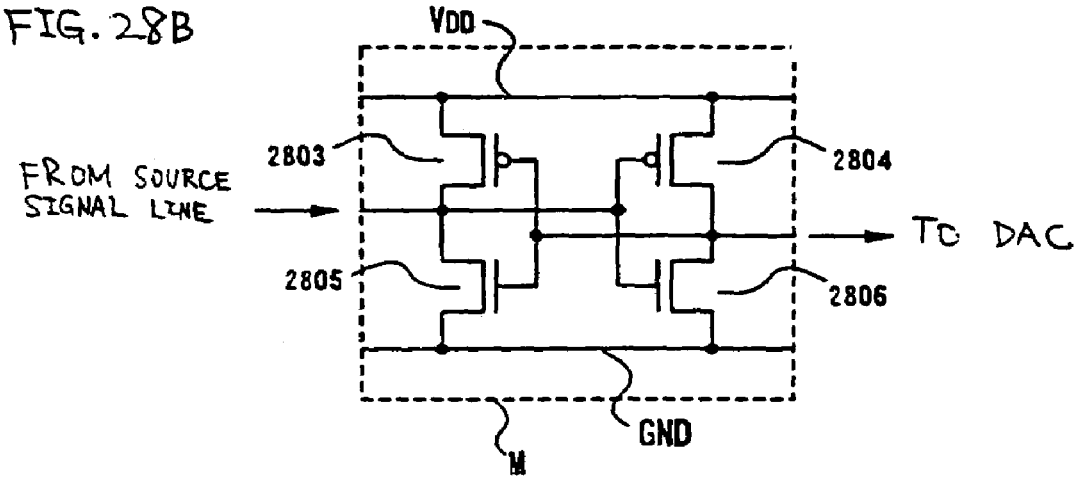

FIG. 28B is a view illustrating the circuit of FIG. 28A more specifically. TFTs 2803 and 2804 are p-channel TFTs, and TFTs 2805 and 2806 are n-channel TFTs. Symbols VDD and GND represent a power line and a ground line, respectively.

The present example may freely be combined with one or more out of Examples 1 to 12.

Example 14

In Example 13, the static random access memory (SRAM) is used to form the memory circuit of the pixel section in the liquid crystal display device of the present invention. However, the memory circuit which can be used in the pixel section in the liquid crystal display device of the present invention is not limited to the SRAM, and may be a dynamic random access memory (DRAM) or the like.

Ferroelectric random access memories (FRAMs), which are not illustrated, are used as memory circuits in a different form, so as to make it possible to constitute the pixel section of the liquid crystal display device of the present invention. The FRAM is a nonvolatile memory having a writing speed equivalent to those of the SRAM and DRAM. Using its characteristics, such as low writing voltage, the power consumption of the liquid crystal display device of the present invention can be made lower. The pixel section may be composed of flash memories.

The present example may freely be combined with one or more out of Examples 1 to 12.

Example 15

A display device of the present invention have various usage. In this embodiment, the semiconductor device comprising the display device formed along with the present invention is described.

The following can be given as examples of such semiconductor devices comprising the display device: a portable information terminal (such as an electronic book, a mobile computer, or a cell phone), a video camera; a digital camera; a personal computer and a television. Examples of those electronic equipments are shown in FIGS. 30 and 31.

Figure 31A:
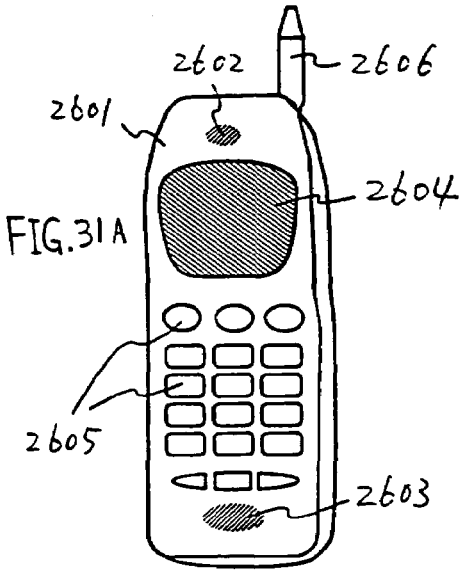
FIGS. 31A to 31F are views illustrating devices to which the liquid crystal display device of the present invention is applied.

FIG. 31A is a cell phone which includes a main body 2601, a voice outputted portion 2602, a voice inputted portion 2603, a display portion 2604, operation switches 2605, and an antenna 2606. The present invention can be applied to the display portion 2604.

Figure 31B:
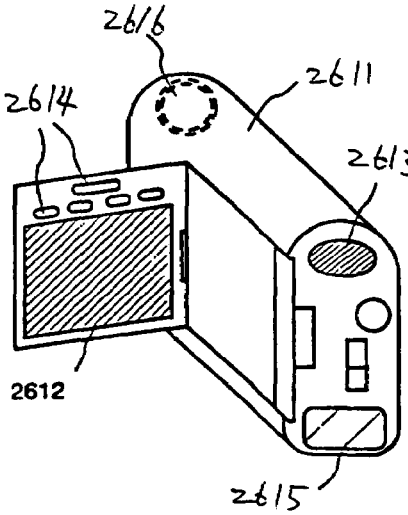

FIG. 31B illustrates a video camera which includes a main body 2611, a display portion 2612, an audio inputted portion 2613, operation switches 2614, a battery 2615, an image receiving portion 2616, or the like. The present invention can be applied to the display portion 2612.

Figure 31C:
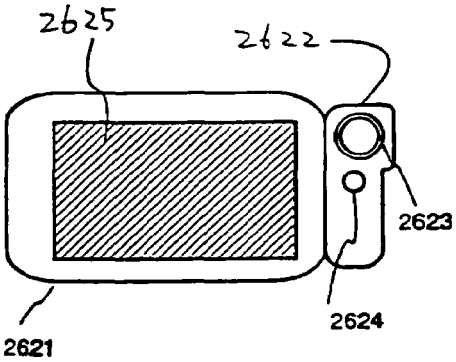

FIG. 31C illustrates a mobile computer or portable information terminal which includes a main body 2621, a camera section 2622, an image receiving section 2623, operation switches 2624, a display portion 2625, or the like. The present invention can be applied to the display portion 2625.

Figure 31D:
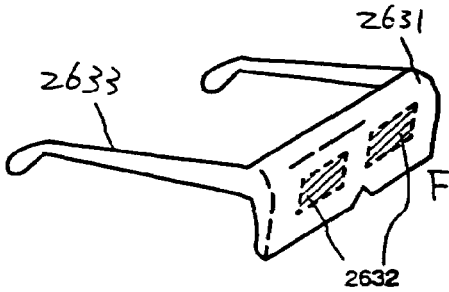

FIG. 31D illustrates a head mounted display which includes a main body 2631, a display portion 2632 and an arm portion 2633. The present invention can be applied to the display portion 2632.

Figure 31E:
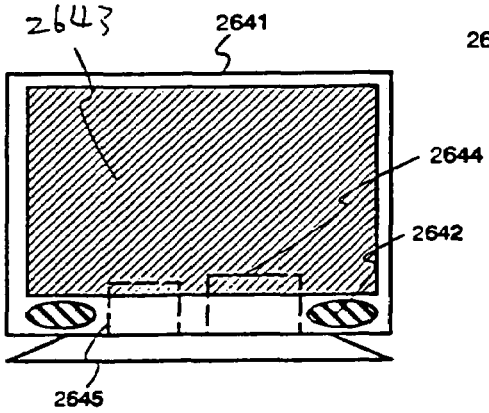

FIG. 31E illustrates a television which includes a main body 2641, a speaker 2642, a display portion 2643, a receiving device 2644 and an amplifier device 2645. The present invention can be applied to the display portion 2643.

Figure 31F:
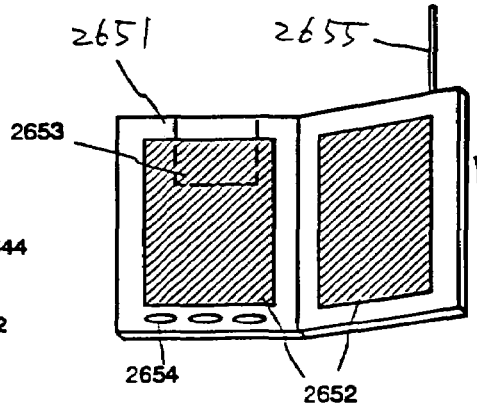

FIG. 31F illustrates a portable electronic book which includes a main body 2651, display portion 2652, a memory medium 2653, an operation switch 2654 and an antenna 2655 and the portable electronic book displays a data recorded in mini disc (MD) and DVD (Digital Versatile Disc) and a data recorded by an antenna. The present invention can be applied to the display portions 2652.

Figure 30A:
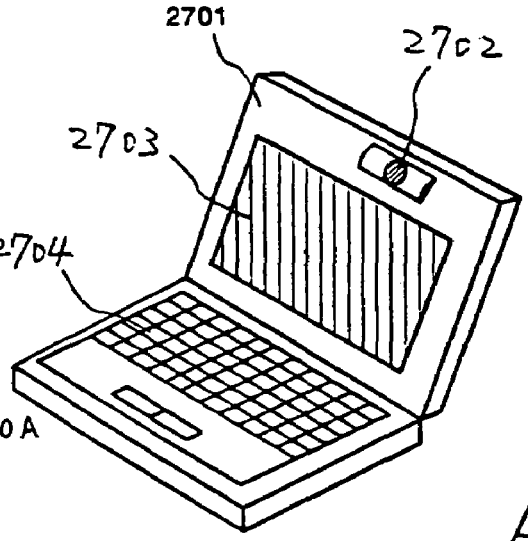
FIGS. 30A to 30D are views illustrating devices to which the liquid crystal display device of the present invention is applied.

FIG. 30A illustrates a personal computer which includes a main body 2701, an image inputted portion 2702, a display portion 2703, a key board 2704, or the like. The present invention can be applied to the display portion 2703.

Figure 30B:
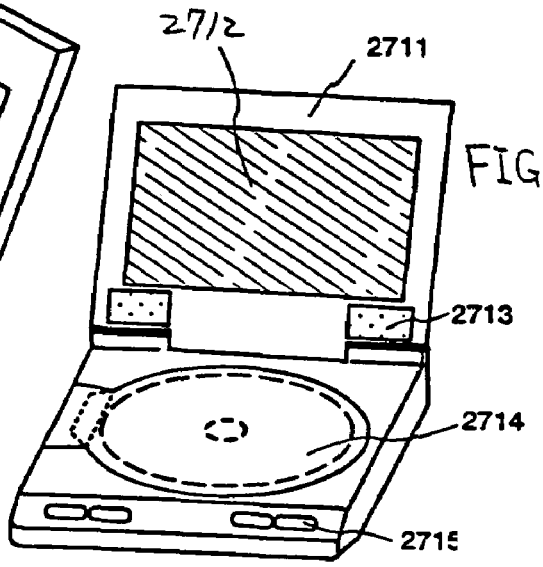

FIG. 30B illustrates a player using a recording medium which includes a main body 2711, a display portion 2712, a speaker section 2713, a recording medium 2714, and operation switches 2715. This player uses DVD (digital versatile disc), CD, etc. for the recording medium, and can be used for music appreciation, film appreciation, games and Internet. The present invention can be applied to the display portion 2712.

Figure 30C:
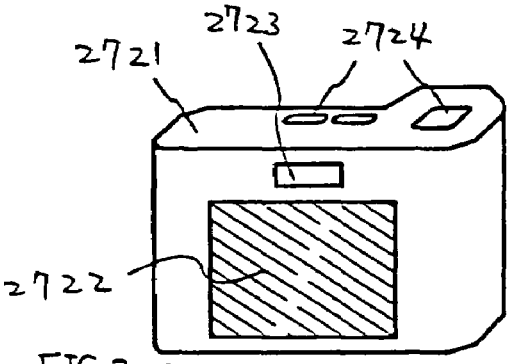

FIG. 30C illustrates a digital camera which includes a main body 2721, a display portion 2722, a view finder portion 2723, operation switches 2724, and an image receiving section (not shown in the figure). The present invention can be applied to the display portion 2722.

Figure 30D:
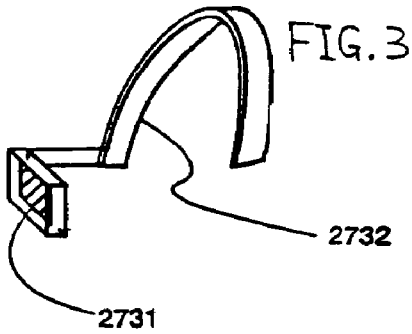

FIG. 30D illustrates a one-eyed head mounted display which includes a main body 2731 and band portion 2732. The present invention can be applied to the display portion 2731.

This embodiment can be freely combined to execute with Embodiments 1 to 14.

According to the present invention, a display device making it possible to lower the power consumption thereof and a method of driving the same can be provided by arranging memory circuits in each of pixels.

In the present invention, the memory circuits are arranged in each of the pixels as described above, and further the plural pixels share a DAC. In this way, the area ratio of DACs in the display section can be made lower. As a result, the number of the arranged memory circuits can be made larger.

What is claimed is:

1. A personal computer comprising:

a key board; and a liquid crystal display device, wherein n-bit digital picture signals are used to represent gradation in said liquid crystal display device where n is a natural number of 2 or more, said liquid crystal display device comprising:

k pixels wherein k is a natural number of 2 or more, each of the k pixels comprising n memory circuits and a liquid crystal element, and the k pixels comprising a D/A converter circuit;

means for memorizing the n-bit digital picture signals in the n memory circuits;

means for selecting one out of the k pixels and then inputting the n-bit digital picture signals memorized in the selected pixel to the D/A converter circuit; and means for inputting analogue signals outputted from the D/A converter circuit to the liquid crystal element of the selected pixel.

2. A computer according to claim 1, wherein the n memory circuits are static random access memories (SRAMs).

3. A computer according to claim 1, wherein the n memory circuits are ferroelectric random access memories (FRAMs).

4. A computer according to claim 1, wherein the n memory circuits are dynamic random access memories (DRAMs).

5. A digital camera comprising:

an image receiving section; and a liquid crystal display device, wherein n-bit digital picture signals are used to represent gradation in said liquid crystal display device where n is a natural number of 2 or more, said liquid crystal display device comprising:

k pixels wherein k is a natural number of 2 or more, each of the k pixels comprising n memory circuits and a liquid crystal element, and the k pixels comprising a D/A converter circuit;

means for memorizing the n-bit digital picture signals in the n memory circuits;

means for selecting one out of the k pixels and then inputting the n-bit digital picture signals memorized in the selected pixel to the D/A converter circuit; and means for inputting analogue signals outputted from the D/A converter circuit to the liquid crystal element of the selected pixel.

6. A camera according to claim 5, wherein the n memory circuits are static random access memories (SRAMs).

7. A camera according to claim 5, wherein the n memory circuits are ferroelectric random access memories (FRAMs).

8. A camera according to claim 5, wherein the n memory circuits are dynamic random access memories (DRAMs).

9. A television comprising:

a speaker; and a liquid crystal display device, wherein n-bit digital picture signals are used to represent gradation in said liquid crystal display device where n is a natural number of 2 or more, said liquid crystal display device comprising:

k pixels wherein k is a natural number of 2 or more, each of the k pixels comprising n memory circuits and a liquid crystal element, and the k pixels comprising a D/A converter circuit;

means for memorizing the n-bit digital picture signals in the n memory circuits;

means for selecting one out of the k pixels and then inputting the n-bit digital picture signals memorized in the selected pixel to the D/A converter circuit; and means for inputting analogue signals outputted from the D/A converter circuit to the liquid crystal element of the selected pixel.

10. A television according to claim 9, wherein the n memory circuits are static random access memories (SRAMs).

11. A television according to claim 9, wherein the n memory circuits are ferroelectric random access memories (FRAMs).

12. A television according to claim 9, wherein the n memory circuits are dynamic random access memories (DRAMs).

13. A player comprising:

a recording medium; and a liquid crystal display device, wherein n-bit digital picture signals are used to represent gradation in said liquid crystal display device where n is a natural number of 2 or more, said liquid crystal display device comprising:

k pixels wherein k is a natural number of 2 or more, each of the k pixels comprising n memory circuits and a liquid crystal element, and the k pixels comprising a D/A converter circuit;

means for memorizing the n-bit digital picture signals in the n memory circuits;

means for selecting one out of the k pixels and then inputting the n-bit digital picture signals memorized in the selected pixel to the D/A converter circuit; and means for inputting analogue signals outputted from the D/A converter circuit to the liquid crystal element of the selected pixel.

14. A player according to claim 13, wherein the n memory circuits are static random access memories (SRAMs).

15. A player according to claim 13, wherein the n memory circuits are ferroelectric random access memories (FRAMs).

16. A player according to claim 13, wherein the n memory circuits are dynamic random access memories (DRAMs).

17. A cell phone comprising:

an antenna; and a liquid crystal display device, wherein n-bit digital picture signals are used to represent gradation in said liquid crystal display device where n is a natural number of 2 or more, said liquid crystal display device comprising:

k pixels wherein k is a natural number of 2 or more, each of the k pixels comprising n memory circuits and a liquid crystal element, and the k pixels comprising a D/A converter circuit;

means for memorizing the n-bit digital picture signals in the n memory circuits;

means for selecting one out of the k pixels and then inputting the n-bit digital picture signals memorized in the selected pixel to the D/A converter circuit; and means for inputting analogue signals outputted from the D/A converter circuit to the liquid crystal element of the selected pixel.

18. A phone according to claim 17, wherein the n memory circuits are static random access memories (SRAMs).

19. A phone according to claim 17, wherein the n memory circuits are ferroelectric random access memories (FRAMs).

20. A phone according to claim 17, wherein the n memory circuits are dynamic random access memories (DRAMs).

21. A video camera comprising:

an image receiving portion; and a liquid crystal display device, wherein n-bit digital picture signals are used to represent gradation in said liquid crystal display device where n is a natural number of 2 or more, said liquid crystal display device comprising:

k pixels wherein k is a natural number of 2 or more, each of the k pixels comprising n memory circuits and a liquid crystal element, and the k pixels comprising a D/A converter circuit;

means for memorizing the n-bit digital picture signals in the n memory circuits;

means for selecting one out of the k pixels and then inputting the n-bit digital picture signals memorized in the selected pixel to the D/A converter circuit; and means for inputting analogue signals outputted from the D/A converter circuit to the liquid crystal element of the selected pixel.

22. A camera according to claim 21, wherein the n memory circuits are static random access memories (SRAMs).

23. A camera according to claim 21, wherein the n memory circuits are ferroelectric random access memories (FRAMs).

24. A camera according to claim 21, wherein the n memory circuits are dynamic random access memories (DRAMs).

25. An electronic book comprising:

a memory medium; and a liquid crystal display device, wherein n-bit digital picture signals are used to represent gradation in said liquid crystal display device where n is a natural number of 2 or more, said liquid crystal display device comprising:

k pixels wherein k is a natural number of 2 or more, each of the k pixels comprising n memory circuits and a liquid crystal element, and the k pixels comprising a D/A converter circuit;

means for memorizing the n-bit digital picture signals in the n memory circuits;

means for selecting one out of the k pixels and then inputting the n-bit digital picture signals memorized in the selected pixel to the D/A converter circuit; and means for inputting analogue signals outputted from the D/A converter circuit to the liquid crystal element of the selected pixel.

26. A book according to claim 25, wherein the n memory circuits are static random access memories (SRAMs).

27. A book according to claim 25, wherein the n memory circuits are ferroelectric random access memories (FRAMs).

28. A book according to claim 25, wherein the n memory circuits are dynamic random access memories (DRAMs).

* * * * *